US008820340B2

(12) United States Patent
Hughes

(10) Patent No.: US 8,820,340 B2
(45) Date of Patent: Sep. 2, 2014

(54) FRAMES AND HINGES

(75) Inventor: Anthony D. Hughes, Knutsford (GB)

(73) Assignee: Hughes Safety Showers Limited (GB)

( * ) Notice: Subject to any disclaimer, the term of this patent is extended or adjusted under 35 U.S.C. 154(b) by 79 days.

(21) Appl. No.: 13/146,757

(22) PCT Filed: Jan. 29, 2010

(86) PCT No.: PCT/GB2010/050147

§ 371 (c)(1),
(2), (4) Date: Oct. 11, 2011

(87) PCT Pub. No.: WO2010/086668

PCT Pub. Date: Aug. 5, 2010

(65) Prior Publication Data

US 2012/0017961 A1 Jan. 26, 2012

(30) Foreign Application Priority Data

Jan. 30, 2009 (GB) ..... 0901543.9
May 8, 2009 (GB) ..... 0907941.9

(51) Int. Cl.
*E04H 15/38* (2006.01)
*E04H 15/50* (2006.01)

(52) U.S. Cl.
USPC ..... 135/131; 135/145

(58) Field of Classification Search
USPC ..... 135/130, 131, 124, 157, 158, 139, 143, 135/144, 145, 147; 16/374, 376, 377; 403/116
See application file for complete search history.

(56) References Cited

U.S. PATENT DOCUMENTS

| | | | | | |
|---|---|---|---|---|---|
| 1,170,188 | A | * | 2/1916 | Rasmussen et al. | 135/149 |
| 2,812,961 | A | | 11/1957 | Brown et al. | |
| 4,074,682 | A | | 2/1978 | Yoon | |
| 4,140,141 | A | * | 2/1979 | Marks | 135/136 |
| 4,540,306 | A | | 9/1985 | Wang | |
| 4,649,947 | A | | 3/1987 | Tury et al. | |
| 4,844,109 | A | | 7/1989 | Navarro | |
| 5,069,238 | A | * | 12/1991 | Marks | 135/153 |
| 5,249,591 | A | | 10/1993 | Gamadi | |
| 5,263,507 | A | * | 11/1993 | Chuang | 135/140 |
| 5,584,311 | A | * | 12/1996 | Schaefer | 135/128 |
| 5,771,651 | A | * | 6/1998 | Shiina | 52/641 |

(Continued)

FOREIGN PATENT DOCUMENTS

| | | |
|---|---|---|
| EP | 0248540 | 12/1987 |
| EP | 1043509 | 10/2000 |

(Continued)

OTHER PUBLICATIONS

International Search Report dated Sep. 2, 2010 (International Patent Application No. PCT/GB2010/050147).

(Continued)

*Primary Examiner* — Noah Chandler Hawk
(74) *Attorney, Agent, or Firm* — Niels Haun; Dann Dorfman Herrell & Skillman, PC

(57) ABSTRACT

A collapsible shelter frame including members articulated by pivot means and having a pair of opposed pivot members, such as plates, joined at a common axle about which a surface of a first pivot member of the pair is slidingly rotatable over a surface of a second pivot member of the pair in parallel opposition thereto.

8 Claims, 59 Drawing Sheets

(56) References Cited

U.S. PATENT DOCUMENTS

| | | | | |
|---|---|---|---|---|
| 5,956,810 | A * | 9/1999 | Spaeth | 16/358 |
| 6,397,433 | B1 | 6/2002 | Chen | |
| 7,584,763 | B2 * | 9/2009 | Yoon | 135/131 |
| 2005/0121260 | A1 | 6/2005 | Leng | |
| 2005/0268434 | A1 | 12/2005 | Burbrink et al. | |
| 2006/0037636 | A1 | 2/2006 | Lin | |
| 2006/0162756 | A1 | 7/2006 | Gao | |
| 2008/0029143 | A1 | 2/2008 | Yoon | |
| 2008/0257394 | A1 | 10/2008 | Tseng | |

FOREIGN PATENT DOCUMENTS

| | | |
|---|---|---|
| EP | 1310616 | 5/2003 |
| EP | 1975347 | 10/2008 |
| GB | 210350 | 1/1924 |
| GB | 470241 | 8/1937 |
| GB | 2417256 | 2/2006 |
| JP | 50052712 U | 5/1975 |
| WO | 20081120071 | 10/2008 |

OTHER PUBLICATIONS

Written Opinion dated Sep. 2, 2010 (International Patent Application No. PCT/GB2010/050147).

UK Search Report dated Jul. 31, 2009 (Application No. GB0901543.9).

UK Search Report dated Aug. 13, 2009 (Application No. GB0907941.9).

UK Examination Report dated Jan. 20, 2012 (Application No. GB0901543.9).

* cited by examiner

DETAIL B

DETAIL C

SECTION A-A

SECTION A-A

DETAIL C

SECTION B-B

DETAIL D
SCALE 1 : 1

SECTION A-A

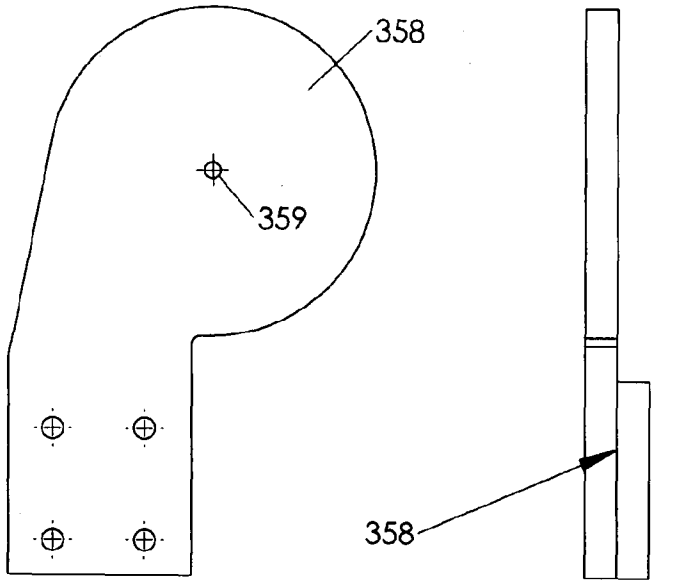
Figure 52A
Figure 52B
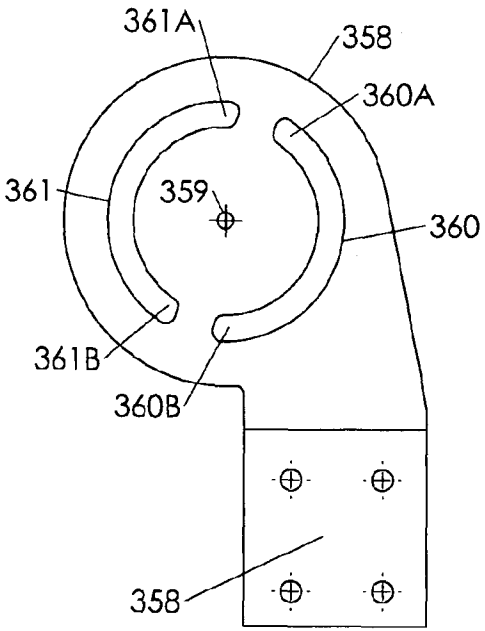
Figure 52C

FRAMES AND HINGES

PRIORITY APPLICATIONS

This application is a 371 application of International Application No. PCT/GB2010/050147 filed Jan. 29, 2010, which claims priority to United Kingdom Patent Application No. 0901543.9 filed Jan. 30, 2009 and United Kingdom Patent Application No. 0907941.9 filed May 8, 2009. Each of the foregoing applications is hereby incorporated herein by reference.

The present invention in one aspect relates to frames for shelters, their construction, assembly and use, and methods thereof. In particular, though not exclusively, the invention may relate to collapsible frames for shelters such as tents. The present invention in another aspect relates to hinges, their construction, assembly and use, and methods thereof. In particular, though not exclusively, the invention may relate to hinges for articulated joints between components of assemblies such as frames (e.g., for collapsible frames, tent frames etc), scaffolds or other equipment.

Shelters may be required for rapid deployment and removal in emergency situations and/or for temporary use. Examples include emergency decontamination stations, medical stations and/or forensic stations. In each case, a sheltered environment or temporary dwelling may be required where none otherwise exists.

Large inflatable tents are available for this purpose in order to enable a rapid and simple deployment and provision of a relatively large shelter. However, such inflatable tents are complex and expensive in construction, prone to ruptures or punctures and require the use of a powered pump for inflation. The volume of material required to provide inflatable parts of the tent also greatly increase the bulk and weight of the tent when deflated and stored.

The invention in one aspect at least, aims to provide means which may be used to address these matters. An alternative rapidly deployable shelter structure is provided.

Hinges for connecting together components of an articulated assembly come in many forms. The majority are simple in structure and comprise an axle or pivot bearing member about which hinge limbs are separately joined substantially in isolation of each other. An example is a hinge pin around different sections of the length of which are parts of each of two hinge limbs disposed to rotatably clasp the pin along sections of its length.

On the one hand, this simplicity typically prohibits provision within the structure of the hinge of means for locking such a hinge in a desired state of splay/configuration. Such locking may often only be achieved by provision of additional locking or securing means external to a hinge.

On the other hand, while the clasping, by hinge limbs, of lengths of the hinge pin may provide some degree of strength in the hinge against forces transverse to the pin, this is at the expense of having to provide a long pin—the greater the length of pin clasped by a hinge limb, the greater the lateral strength the of the hinge.

In articulated frames, such as collapsible frames for shelters, both of these consequences may be undesirable in terms of the inability to safely lock the articulated frame in a desired configuration, or the volume occupied by elongated hinges providing articulation with suitable strength.

The invention in one aspect at least, aims to provide means which may be used to address these matters. An alternative hinge structure is provided.

In a first of its aspects, the invention provides a collapsible frame for a shelter including members articulated by a pivot (e.g. hinge) comprising a pair of opposed pivot members (e.g. plates) joined at a common axle about which a surface of a first pivot member of the pair is slidingly rotatable over a surface of a second pivot member of the pair in parallel opposition thereto. Thus, opposed parallel surfaces (e.g. plate surfaces) of the pivot members may slide against each other by action of the pivot to provide lateral strength in a laterally compact form.

In a second of its aspects, the invention may provide a (e.g. one-piece) collapsible shelter frame comprising two or more beam assemblies each including at least two beam members joined at a pivot (e.g. hinge) means and reversibly pivotable thereat to a relatively splayed position collectively to form an arch, wherein at least two said beam assemblies are joined by cross-brace means slideably coupled thereto to reversibly expand therebetween to separate the joined beam assemblies permitting concertina-like expansion and collapse of the shelter frame. Accordingly, not only a concertina collapsibility of arched is provided, but also a folding collapse of arches thereafter. This enables rapid collapse or assembly of the frame from a compact collapsed/storage state. Sliding coupling of the cross-brace means to each of the two beam assemblies it joins, enables a smooth and quick concertina action therebetween. The pivot (e.g. hinge) means preferably comprised a pair of opposed plates joined at a common axle about which a face of one plate of the pair is slidingly rotatable over a face of the other plate of the pair in parallel opposition thereto. A pivot means of the shelter frame may be according to the invention in its first or third aspect. A beam member of a beam assembly may be connected to one plate of the pair and another beam member of the beam assembly may be connected to the other plate of the pair. Providing a pivot means using opposed facing plates in this way strengthens the pivot means against transverse forces and torques by enabling such influences to be spread over the opposing plate areas. It also provides a laterally compact form.

A face of one plate of the pair of plates may include one or more lug parts extending therefrom and/or disposed thereupon to extend into an arcuate (e.g. circular) channel (e.g. slot) formed across the opposing face of the other plate of the pair of plates, the lug part being slideable along the arcuate channel from one end of the channel to another end thereof by action of relative rotation of the opposed plates. The channel may be dimensioned such that the lug part abuts or engages one end of the channel when the pivot means is in a fully splayed/opened state, and/or such that the lug part abuts or engages the other end of the channel when the pivot means is in the closed state. A second such lug and corresponding arcuate (e.g. circular) channel (e.g. slot) may be formed in the opposed plates. Two such lugs may be formed to extend from the same face of a common plate at locations there upon diametrically opposed across the common axle. Two such channels may be formed in the same face of a common plate such that an end (e.g. each end) of any one of the two channels is diametrically opposed across the common axle from an end of the other of the two channels.

An aforesaid lug preferably projects outwardly of a plate surface in a direction parallel to the axis of the common axle. An opposed corresponding channel (e.g. slot) may have a depth dimension which extends into the surface of a plate in a direction parallel to the axis of the common axle.

The cross-brace means may include one or more pairs of crossed arms wherein one arm of a pair is coupled to a said beam assembly to permit sliding movement thereof along the beam assembly and the other arm of the pair is fixed (e.g. in position) to the beam assembly, and/or may be coupled thereto at a fixed location. The other arm of the pair may be pivotably so fixed to the beam assembly in this way. As a result of fixing the location at which one crossed arm couples to a beam assembly, a sliding movement of the location at which the other crossed arm couples to the same beam assembly urges a displacement of the location, relative to the beam assembly, at which the crossed arms cross. This preferably urges an expansion or contraction of the cross-brace. Most preferably, one, some or all crossed arms of a cross-brace means are rigid.

The cross-brace means may comprise a pair of crossed arms pivotably joined where they cross to permit a scissor action enabling said reversible expansion of the cross-brace means.

The cross-brace means may include a second said pair of crossed arms pivotably joined where they cross, and each arm of any one pair of crossed arms is pivotably joined to an arm of the other pair of crossed arms. Accordingly, an expansion or contraction of one pair of crossed arms may urge corresponding effects in the other pair of crossed arms.

The cross-brace means may be operable to maintain an expanded state to permit the relative positions of beam assemblies separated thereby to be maintained thereby to permit arches formed by the joined beam assemblies to stand upright in tandem.

The cross-brace means may include locking means (e.g. brace locking means) arranged to releasably fix the location (s) upon a said beam assembly at which the cross-brace means couples thereto when the cross-brace means is in an expanded state. The locking means may comprise a catch, latch, hook, belt, strap, cable or other retaining means arranged to enable a part of the cross-brace means slidingly coupled to a beam assembly to fixedly couple or attach thereto at a desired location which maintains the expanded state of the cross-brace means.

The locking means may include stop means arranged to prevent sliding movement of the one arm of the pair therebeyond along a beam assembly towards the location at which the other arm of the pair is fixed to the beam assembly, and retaining means operable to retain the one arm at the stop means. In this way, the location upon a beam assembly at which a part of the cross-brace means slidingly couples thereto, may be jammed wedged or otherwise held against a part of the beam assembly it is coupled to.

Each one of the at least two beam members may comprise two beam member portions joined at a pivot means together collectively defining an articulated beam member. The articulated beam member may have an upper beam member portion uppermost in use, and a lower beam member portion lowermost in use, joined to the upper beam member portion by a pivot means (e.g. a hinge). The upper beam member portion may be a roof beam member portion for the frame when erected. The lower beam member portion may be a wall beam member portion forming a wall member portion of the frame when erected. The upper and lower beam member portions may be joined by a hinge arranged to reversibly splay the joined beam member portions from a closed state of parallel adjacency to a maximally splayed state disposing the upper and lower beam member portions at a selected angle of splay (e.g. exceeding 90 degrees). Upper beam member portions of two pivotably joined articulated beam member portions of a beam assembly may be joined by a hinge arranged to reversibly splay the joined upper beam member portions from a closed state of parallel adjacency to a maximally splayed state disposing the upper beam member portions at a selected angle of splay (e.g. exceeding 90 degrees).

Beam members or beam member portions may be joined at a pivot means arranged to reversibly splay the beam members (or portions) from a position of parallel adjacency to a relatively splayed position.

Beam members may be joined at a pivot means arranged to reversibly splay the beam members to a state of fixed splay angle.

The cross-brace means may join adjacent equivalent beams of adjacent articulated beam assemblies which are lowermost in use of the frame (e.g. wall beams). Alternatively, the cross-brace means may join adjacent equivalent beams of adjacent articulated beam assemblies which are upper in use of the frame (e.g. roof beams).

The one-piece collapsible shelter frame may further comprise three separate beam assemblies two of which are separately coupled via a respective one of two said cross-brace means to a common intermediate beam assembly therebetween, wherein the respective cross-brace means couple to the intermediate beam assembly at a common slideable coupling means such that expansion/collapse of one cross-brace means urges the same in the other.

Cross-brace means may be slideably coupled to a beam assembly via a slideable coupling disposed within in a longitudinal channel or slot extending along a beam assembly and arranged to slide therealong in response to expansion/collapse of the cross-brace means.

Beam assemblies may be joined at an apex of the frame in use, by a pair of collapsible top-braces articulated at a joint between ends thereof.

The top braces may be joined by a tensioning means operable to urge the opposed joints together to abut each other at their articulated joints.

In a third of its aspects, the invention may provide pivot (e.g. hinge) means comprising a pair of opposed plates joined at a common axle about which a face of one plate of the pair is slidingly rotatable over a face of the other plate of the pair in parallel opposition thereto. A pivot means of the shelter frame according to the invention in its first or second aspect may be according to the invention in its third or fifth aspect. A beam member of a beam assembly may be connected to one plate of the pair and another beam member of the beam assembly may be connected to the other plate of the pair. Providing a pivot means using opposed facing plates in this way strengthens the pivot means against transverse forces and torques by enabling such influences to be spread over the opposing plate areas.

Each of the pair of opposed plates may be rotatably coupled upon the common axle via a threading disposed thereupon to engage with a reciprocal threading upon the common axle such that sliding rotation of one plate face over another plate face of the pair results in a relative displacement between the plates along the axis of the common axle. This may be a progressive displacement in a manner analogous to that of a threaded nut along the shaft of a threaded bolt. The opposed plates may be arranged such that relative rotation thereof to open the pivot means displaces the plates to urge the opposed faces together, such as progressively towards (and ultimately into) contact between opposed faces when the pivot means is maximally splayed/open. A frictional or interference fit may be achieved in this state of interface.

A face of one plate of the pair of plates may possess one or more lug parts extending therefrom and disposed thereupon to extend into an arcuate (e.g. circular) channel formed across the opposing face of the other plate of the pair of plates, the lug part being slideable along the arcuate channel from one end of the channel to another end thereof by action of relative rotation of the opposed plates. The channel may be dimensioned such that the lug part abuts or engages one end of the channel when the pivot means is in a fully splayed/opened state, and/or such that the lug part abuts or engages the other end of the channel when the pivot means is in the closed state. A second such lug and corresponding arcuate (e.g. circular) channel may be formed in the opposed plates. Two such lugs may be formed to extend from the same face of a common plate at locations there upon diametrically opposed across the common axle. Two such channels may be formed in the same face of a common plate such that an end (e.g. each end) of any one of the two channels is diametrically opposed across the common axle from an end of the other of the two channels.

An aforesaid lug preferably projects outwardly of a plate surface in a direction parallel to the axis of the common axle. An opposed corresponding channel may have a depth dimension which extends into the surface of a plate in a direction parallel to the axis of the common axle.

One plate of the pair may possess a through-opening extending through the plate to the face thereof, and the other plate of the pair may have an orifice (which may be a through-opening extending through the plate to the face thereof) disposed in the opposing face thereof to be positionable in register with the through-opening by rotation of one or both plates about their common axle. The pivot means may include a pin insertable into the through-opening and dimensioned to extend along the through-opening and into the orifice when the through-opening and orifice are in register. When the orifice is a through opening, the pin may be dimensioned to extent through both through (and optionally beyond) openings in register. The two through openings may be disposed in the opposing plates to be positionable in register when the pivot is in a fully splayed/opened state. A pin may be placeable to extend simultaneously along the through openings when so registered thereby to lock the plates in the fully splayed state.

The through-opening is preferably accessible in use of the pivot means. When used as the pivot means of a beam assembly of the frame, the through-opening is accessible at any relative orientation of beam members joined by the pivot means.

The pin may be extractably insertable into the through-opening and concurrently into the orifice when in register. The pin may have a moveable shaft part moveable relative to the body of the pin along a long axis thereof along the through opening and into the orifice when in register.

The body of the pin may comprise a sleeve part through which an axial bore extends within which the shaft part is slidingly moveable. The shaft and sleeve parts may be structured and arranged to retain the shaft part within the sleeve part.

The moveable shaft part may be moveable along the bore between a retracted state in which the shaft part does not extend from the sleeve part via an end of the bore, and a projecting state in which the shaft part projects from the sleeve part via an end of the bore. In the projecting state, the shaft part is preferably dimensioned to project from the sleeve part into an orifice of a said plate of the pivot means when in register with a through-opening in an opposing said plate within which the sleeve part is housed but does not project (e.g. does not project into the through-opening when in register). When the through-opening and orifice are not in register, the shaft portion is preferably arranged to adopt the retracted state. The opposing faces of the plates of the pivot means are preferably disposed such that the opposing face of the plate containing the orifice covers the end of the through-opening via which the shaft part is moveable to project into the orifice when in register therewith. This covering may maintain the shaft in one plate in the retracted state until in register with the orifice in the opposing plate. The plates of the pivot means may thus be slidingly rotatable about their common axle when the shaft of the pin is retracted, and locked in relative position by the pin when brought into register.

Preferably the pivot means, e.g. when a pivot means of a beam assembly such as the frame of an aspect of the invention, achieves a maximally splayed/opened state of beam members joined thereby when the through-opening and orifice or respective opposed plate faces are in register.

The moveable shaft part of the pin may include a hand-operable head part turnable by hand to turn the shaft part about its axis within the bore of the sleeve part. The sleeve part may have an end part nearmost the head part of the shaft shaped to engage with the head part when the shaft part is in a projecting state, and to disengage from the head part when the shaft part is in a retracted state. Accordingly, in the engaged state the moveable shaft is preferably turnable only if the sleeve part is so turnable, while in the disengaged state the shaft part is turnable independently of the sleeve part.

The head part of the shaft may possess a projecting part disposed to be reversibly moveable, by movement of the head part relative to the sleeve part, from a first position in which it engages a recess part of the sleeve part when the shaft part is in the projecting state, to a second position in which it engages parts of the sleeve part adjacent the recessed part thereof to retain the shaft part in the retracted state. A pull and turn action upon the head of the shaft part may effect this movement from the projecting state to a maintained state of retraction.

The head part and sleeve part of the pin may possess reciprocally-shaped opposable parts dimensioned to intermesh when engaged such that the shaft part becomes turnable about its axis by turning the head part. Reciprocally-shaped opposable parts include recesses dimensioned to receive opposable projections. This enables the pin as a whole to be turned in unison about its axis when the shaft part is projecting into an orifice of a plate from a through-opening of an opposed plate containing the sleeve part of the pin. As such, the sleeve part may be externally threaded with a thread arranged to engage a reciprocal threading disposed on the walls of the bore of the through-opening containing it. This enables the pin, with projecting shaft part, to be screwed down along the bore of the through-opening to urge until stopped by the opposing plate containing the orifice in register.

The moveable shaft part may be spring-loaded within the sleeve part so as to be urged in to a quiescent state of projection therefrom. The bore of the sleeve part may separated by a spring from and opposed abutment surface of the moveable shaft part such that retraction of the shaft into the bore compresses the spring.

The pivot means may possess two such pins as described above, each being associated with a respective through-opening in one plate of the pivot means, and a corresponding orifice in the opposed plate thereof. The through-openings and corresponding orifices may be disposed in a respective plate at opposite sides of the common axle.

In a fourth of its aspects, the invention may provide a one-piece collapsible frame comprising a shelter frame described above. The invention may comprise a one-piece collapsible tent frame and a may include a covering adapted to fit intimately over the collapsible tent frame when fully expanded thereby to provide a tent. The covering may be adapted to attach to the frame to depend from and under arches of the frame when fully expanded thereby to provide a tent.

Some or all pivot means, and/or beam members may be formed from a metal, such as Aluminium, or a plastic or fibre glass.

It is to be understood that the above describe realisations of equivalent methods of erecting a frame for a shelter or a shelter (e.g. tent) including such a frame. The invention, in yet further aspects, provides such equivalent methods as would be readily apparent to the skilled person from the foregoing.

In a fifth of its aspects, the invention may provide a lockable hinge including: a pair of opposed hinge members (e.g. opposed plates such as flat plates) connected at a common axle about which a face or surface of a first hinge member of the pair is by operation of the hinge slidingly rotatable over a face or surface of a second hinge member of the pair in parallel opposition thereto; lock means operable to move a locking member by a movement substantially parallel to a said surface reversibly into a position which obstructs said sliding rotation of one of the pair of hinge members relative to the other of the pair hinge members from a position which does not so obstruct thereby reversibly to lock the hinge. Either or each of the first and second hinge members may be so slidingly rotatable relative to each other. The opposed surfaces preferably are in contact (e.g. sliding contact), preferably all opposed parts of said opposed surfaces are in contact.

In a sixth of its aspects the invention may provide a collapsible frame for a shelter, such as according to the invention in its first, second or fourth aspect, including members articulated by a lockable hinge described herein (e.g. the invention in its fifth aspect).

Provision of opposed sliding surfaces desirably imbues the hinge with strength against forces transverse to the axle of the hinge without requiring an axially elongated hinge structure. Using opposed facing surfaces (e.g. flat surfaces, or plates, or disks etc) in this way strengthens the hinge means by enabling such influences to be spread over the opposing plate areas. The opposed surfaces preferably extend in a direction transverse to the common axle and may extend a distance greater than the length of the common axle. Use of extended and opposed sliding surfaces permits a simple lock structure which may, for example also operate by sliding the locking member to and from the position of obstruction. The lock means may be operable to rotate the locking member into said obstructing position. The rotation of the locking member may be about an axis transverse to the opposed sliding surfaces of the hinge members such that parts of the locking member may revolve about that axis to and from the obstructing/locking position.

The locking member may include a cam mounted upon a rotatable cam shaft. The cam shaft may be operable reversibly to rotate the cam such that an eccentric portion of the cam is positioned to obstruct said sliding rotation thereby reversibly to lock the hinge. The cam may provide an eccentric portion shaped substantially as (or to incorporate) a circular segment. The circular segment may have a distal peripheral edge defined by a constant maximal radius centred upon the cam shaft. The cam may define elsewhere a peripheral edge closer to the cam shaft. The cam may be dimensioned such that when no part of the distal peripheral edge obstructs sliding rotation of the hinge members, then nor does any other part of the peripheral edge of the cam. In alternative embodiments the lock means may be operable to move the locking member by a linear movement reversibly into the obstructing position. For example, the lock member may be a rod, block or bolt (arranged on one hinge member) operable to be slid into a slot, opening, orifice arranged on the other hinge member.

The lock member may be attached to one of the hinge members of the pair adjacent an edge of the other of the hinge members which edge presents a locking recess in which said edge is closer to the common axle than are parts of said edge immediately adjacent the locking recess and is shaped and adapted to admit the locking member to lock the hinge. The locking recess may reciprocate or be complementary to the shape of those parts of the locking means it is adapted to admit, preferably intimately.

The lock member may be attached to one of the hinge members of the pair adjacent an edge of the other of the hinge members which edge presents a locking recess in which said edge is further from the common axle than are parts of said edge immediately adjacent the locking recess and is shaped and adapted to admit the locking member to lock the hinge. The locking recess may be disposed to be positionable between the locking member and the common axle, or the locking member may be disposed to be positionable by between the common axle and the locking recess, when the locking recess is positioned (by relative rotation of the sliding surfaces) to admit the locking member.

The hinge member comprising the locking recess may include a plurality of separate such locking recesses spaced about said edge to permit the locking of the hinge in any one of a respective plurality of hinge configurations.

The locking member (e.g. when a bolt) may be linearly slidable towards/from the common axle or generally towards the centre of the plate or hinge part containing the locking recess. Alternatively, the locking member may be arranged to slide transversely to the radial direction as from the common axle and reversibly to abut a surface of the locking recess forming a chord at a circular peripheral edge of a hinge member (e.g. rotatable plate) of the pair. This permits linear movement of a locking member on one hinge member to obstruct rotational movement of an opposing hinge member.

The hinge member comprising the locking recess may be rotatable to revolve the edge defining the recess about the common axle reversibly to draw the locking recess into register with the locking member to permit the locking recess to admit the locking member. For example, the locking recess may be formed in a (e.g. an edge part) part of one of the hinge members comprising the slidable surface thereof (e.g. formed by-in the edge bounding the slidable surface) and may be positionable adjacent a locking member arranged at an adjacent part of the other hinge member to permit admission of the locking member into the recess as desired. Alternatively, for example, the locking member may be attached to a part of one of the hinge members comprising the slidable surface thereof and may be positionable adjacent a locking recess arranged in an adjacent part of the other hinge member for admission into the recess as desired.

One or each hinge member may comprise a flat plate or disk part comprising a sliding opposed surface/face as described above. The outer peripheral edge of such plate/disk of such a hinge member may be shaped to define the locking recess. The edge may define a plurality of locking recesses spaced along the edge of each positionable in register with the locking member by rotating the hinge member to a respective different configuration or relative position.

The locking recess and those parts of the locking member to be admitted into the locking recess may be complementarily shaped. The may be arranged such that the locking member is positionable to substantially fully occupy the locking recess. For example, the parts of the locking member adapted to be positionable within the locking recess may have an outermost edge or surface which at least in part has a constant radius of curvature. This may define an eccentric portion of the locking member in the manner of a cam. The locking recess may present a concave recess edge having a radius of curvature centred on the same point of curvature and preferably having the same (or marginally larger) radius as the eccentric. The angular extent of the eccentric may be equal to or greater than the angular extent of the correspondingly shaped locking recess. This enables the eccentric to fill the locking recess in use. The benefit is increased locking strength and rigidity and the ability to excavate unwanted accumulated debris/dirt from within the locking recess by a scooping of pushing action of the locking member as it is rotated into the locking recess. In alternative embodiments the convex cam eccentric may simply be slideable in and out of the concave locking recess by a linear sliding movement e.g. radial to the common axle. In this example, the cam need not be rotatable. Alternatively the locking recess may be a linear slot (e.g. radial to the common axle) and the locking member a bolt, rod or elongate block dimensioned to removably fill the slot.

Opposed edges of the pair of hinge members may collectively define a discharge conduit extending from a discharge inlet opening immediately adjacent the locking recess to a discharge outlet opening at the periphery of the hinge and adapted to conduct debris urged therein from the locking recess by action of rotation of the locking member into the locking recess and towards the discharge inlet. In this way, turning the locking member into the locking recess serves to push unwanted debris out of the locking recess and into a dedicated conduit along and out of the exit end of which the debris may be pushed either by subsequent debris forced in behind it by further use of the locking member, or by future relative rotation of the hinge members which provide the opposing edges defining the conduit. That us to say, the opposing edges defining the conduit are preferably relatively moveable in opposite senses by rotation of one hinge member relative to the other. This assists is evacuating the conduit of debris which might otherwise jam the hinge. It has been found that provision of a rotating lock means and a hinge with slidingly rotatable opposing surfaces is particularly effective in enabling such a cleaning mechanism.

The lock means may include a rotation stop means arranged relative to the locking member to prevent continued rotation thereof beyond a position in which the locking member does not obstruct relative rotation of said hinge members. This enables a user to determine when the locking member is cleared of the locking recess and the hinge in an unlocked state. The lock means may include a rotation stop means arranged relative to the locking member to prevent continued rotation thereof beyond a position in which the locking member obstructs e.g. fully obstructs, relative rotation of said hinge members. This enables a user to determine when the locking member fully occupies, or is fully within, the locking recess and the hinge in a locked state.

The lock means may include a locking surface against which a surface of the locking member is moveable into a frictional interference fit by action of rotation of the locking member to releasably retain the locking member. The interference fit may be achieved by rotation of the locking member into a position which obstructs said sliding rotation (e.g. the hinge locked) thereby to releasably retain the locking member so positioned and/or may be achieved by rotation of the locking member into a position which does not obstruct said sliding rotation (e.g. the hinge unlocked) thereby to releasably retain the locking member so positioned. The locking surface may be provided by a concave surface part of the locking recess. The peripheral edge of the locking member (e.g. the edge of the eccentric of a cam) may be shaped with a radius of convex curvature which increases at parts of the locking member which trail when the locking member is rotated to the locking position so as to be brought into a frictional interface with the concave surface of the locking recess over which parts of the locking member of lesser radius otherwise freely pass. The parts of the locking member with increased radius may be disposed upon the locking member at parts thereof which are rotatable into the locking recess only after the locking recess has been filled by the preceding parts of the locking member. Those parts may then serve to wedge the locking member into the locking recess fully occupied.

One or each of the first and second hinge members may include a plate portion providing a respective one of the two said parallel opposed surfaces.

The lockable hinge may include a third hinge member comprising a plate portion connected to the second hinge member at said common axle about which a surface of the third hinge member is by operation of the hinge slidingly rotatable over another surface of the second hinge member in parallel opposition thereto such that the plate portion of the second hinge member is sandwiched between the plate portions of the third and first hinge members which are slidingly rotatable thereover in unison. The first and third hinge portions may be fixed together. In this way a laminate structure may be provided comprising four opposing slidable surfaces, two of which are opposite sides of a middle plate sandwiched between two outer plates. The two outer plates may be joined so as to rotate together in tandem/unison. This provides additional lateral strength to the hinge.

The lockable hinge may include a fourth hinge member comprising a plate portion connected to the first hinge member at said common axle about which a surface of the fourth hinge member is by operation of the hinge slidingly rotatable over another surface of the first hinge member in parallel opposition thereto such that the plate portion of the first hinge member is sandwiched between the plate portions of the fourth and second hinge members which are slidingly rotatable thereover in unison. The second and fourth hinge portions may be fixed together. In this way a laminate structure may be provided comprising six opposing slidable surfaces, two of which are opposite sides of a first intermediate plate sandwiched between a first outer plate and a second intermediate plate, and another two of which are opposite sides of the second intermediate plate sandwiched between the first intermediate plate and a second outer plate. The locking member may be attached to one plate of a laminate and the locking recess formed in the edge of an opposing other plate of the laminate.

A surface of one said hinge member may include one or more lug parts extending therefrom and disposed thereupon to extend into a respective one of one or more arcuate channels formed across an opposing surface of another said hinge member. An arcuate channel(s) may be formed in the first hinge member and a lug part(s) may be formed on the second hinge member. The hinge member containing the locking recess may also contain the arcuate channel(s). When three hinge members are employed in the hinge, e.g. as described above, an intermediate hinge member or plate may contain the arcuate channel(s) and an outer hinge member/plate may contain the lug part(s).

When four hinge members/plates are employed in the hinge, e.g. as described above, a first outer hinge member/plate may contain the lug part(s), an adjacent first intermediate hinge member/plate may contain the arcuate channel(s) and the locking member, a second intermediate hinge member/plate adjacent the first intermediate hinge member may contain the locking recess positionable to admit the locking member, and a second outer hinge member/plate adjacent the second intermediate hinge member/plate. The first outer hinge member may be fixed to the second intermediate hinge member such that the lug part(s) and the locking recess are revolvable in unison by rotation of those hinge members in tandem. The second outer hinge member may be fixed to the first intermediate hinge member such that the locking member and the arcuate channel(s) are revolvable in unison by rotation of those hinge members in tandem. When the locking member comprises a cam with a cam shaft, the first intermediate hinge member and the second outer hinge member may each include a bore within which is intimately received a respective part of the cam shaft on opposite sides of the cam. The cam shaft may be rotatable about its axis when so received, to correspondingly rotate the cam attached to it. The cam may be sandwiched between the first intermediate hinge member and the second outer hinge member. An inner terminal end of the cam shaft may be located within the cam bore of the first intermediate hinge member. An outer terminal end of the cam shaft may protrude from the outermost surface of the second outer hinge member to be manually accessible and operable in use to turn rotate the cam shaft about its axis.

The outer terminal end of the cam shaft may have attached to it a handle extending generally transversely to the axis of the cam shaft to point in a first direction relative to the second outer hinge member when the hinge is in the unlocked state and to point in a second direction relative to the second outer hinge member when the hinge is in the locked state. This enables that, in use, the first direction may be configured to correspond to vertically upwards and the second direction vertically downwards such that the weight of gravity acting upon the cam handle may produce a torque which urges the cam handle to draw the cam in to a position which locks the hinge. This is a safety feature to prevent undesired unlocking of hinges used in frames or assemblies.

A lug part(s) may be slideable along a respective arcuate channel from one end thereof to another end thereof by action of relative rotation of the hinge members.

The arcuate channel(s) may be dimensioned such that a lug part(s) abuts or engages an end thereof when the hinge members are positioned such that the locking member is rotatable to lock the hinge.

In a seventh of its aspects, the invention provides a kit of parts (e.g. for a shelter frame, e.g. a one-piece frame, e.g. as described above) including a lockable hinge comprising a pair of opposed hinge members connected at a common axle about which a face or surface of a first hinge member of the pair is by operation of the hinge slidingly rotatable over a face or surface of a second hinge member of the pair in parallel opposition thereto; lock means operable to move a locking member by a movement substantially parallel to a said surface reversibly into a position which obstructs said sliding rotation of one of the pair of hinge members relative to the other of the pair hinge members from a position which does not so obstruct thereby reversibly to lock the hinge wherein the lock member is attached to one of the hinge members of the pair adjacent an edge of the other of the hinge members which edge presents a locking recess in which said edge is closer to (or in the alternative further from) the common axle than are parts of said edge immediately adjacent the locking recess and is shaped and adapted to admit the locking member to lock the hinge; and one or more spare hinge members each adapted to replace the said other of the pair of hinge members within the hinge and presenting a respective locking recess adapted to permit locking of the hinge in a configuration of hinge members which differs from that permitted by the hinge member so replaced. For example, the spare hinge member(s) may each have a locking recess positioned relatively differently about an otherwise generally common/shared hinge member shape or structure. This enables a modular product in which the hinge can be adapted to be lockable in one or more positions selectable by selecting the appropriate spare locking member.

In an eighth of its aspects, or further in accordance with the invention in its sixth or seventh aspect, the invention may provide hinge (or pivot) means comprising a pair of opposed plates joined at a common axle about which a face of one plate of the pair is slidingly rotatable over a face of the other plate of the pair in parallel opposition thereto. A first member of an articulated assembly may be connected to one plate of the pair and second member of the articulated assembly may be connected to the other plate of the pair. Providing a hinge means using opposed facing plates in this way strengthens the hinge means against transverse forces and torques by enabling such influences to be spread over the opposing plate areas.

Each of the pair of opposed plates may be rotatably coupled upon the common axle via a threading disposed thereupon to engage with a reciprocal threading upon the common axle such that sliding rotation of one plate face over another plate face of the pair results in a relative displacement between the plates along the axis of the common axle. This may be a progressive displacement in a manner analogous to that of a threaded nut along the shaft of a threaded bolt. The opposed plates may be arranged such that relative rotation thereof to open the hinge means displaces the plates to urge the opposed faces together, such as progressively towards (and ultimately into) contact between opposed faces when the hinge means is maximally splayed/open. A frictional or interference fit may be achieved in this state of interface.

A face of one plate of the pair of plates may possess one or more lug parts extending therefrom and disposed thereupon to extend into an arcuate (e.g. circular) channel (e.g. a groove with a base, or a slot without base) formed across the opposing face of the other plate of the pair of plates. The lug part may be slideable along the arcuate channel from one end of the channel to another end thereof by action of relative rotation of the opposed plates. The channel may be dimensioned such that the lug part abuts or engages one end of the channel when the hinge means is in a fully splayed/opened state, and/or such that the lug part abuts or engages the other end of the channel when the hinge means is in the closed state. A second such lug and corresponding arcuate (e.g. circular) channel may be formed in the opposed plates. Two such lugs may be formed to extend from the same face of a common plate at locations there upon diametrically opposed across the common axle. Two such channels may be formed in the same face of a common plate such that an end (e.g. each end) of any one of the two channels is diametrically opposed across the common axle from an end of the other of the two channels.

An aforesaid lug(s) preferably projects outwardly of a plate surface in a direction parallel to the axis of the common axle. An opposed corresponding channel may have a depth dimension which extends into the surface of a plate in a direction parallel to the axis of the common axle.

In a ninth of its aspects, the invention may provide a frame (e.g. a collapsible frame), such as a tent frame or frame for a shelter, including members articulated by a pivot or hinge as described above. The frame may be a one-piece frame. The frame may comprise a one-piece collapsible tent frame and the invention may include a covering adapted to fit intimately over the collapsible tent frame when fully expanded thereby to provide a tent. The covering may be adapted to attach to the frame to depend from the frame when fully expanded thereby to provide a tent.

Some or all hinge members (e.g. plates) of the hinge may be formed from a glass-reinforced polyester (GRP), such as a high-density GRP, which has been found to have the desired strength without being brittle. GRP has also been found to have desirable "slidability" qualities as between opposed sliding surfaces and does not suffer from the tendency of Aluminium opposed sliding plates to stick, bond or fuse together in use. The cam may be Aluminium. Preferably those hinge members/plates sandwiched between outer hinge members/plates are made from GRP and the outermost (sandwiching) hinge members/plates are made from Aluminium.

A metal, such as Aluminium, Nylon, or a plastic or fibre glass, may be used to form hinge members/plates.

It is to be understood that the above describe realisations of equivalent methods of constructing a hinge. The invention, in yet further aspects, provides such equivalent methods as would be readily apparent to the skilled person from the foregoing.

In a tenth of its aspects the invention may provide a frame including members articulated by a hinge as described above. The frame may be as described above in any aspect.

In an eleventh of its aspects, the invention may provide a kit of parts (e.g. for a collapsible shelter frame) including:

a lockable hinge comprising a pair of opposed hinge members connected at a common axle about which a face or surface of a first hinge member of the pair is by operation of the hinge slidingly rotatable over a face or surface of a second hinge member of the pair in parallel opposition thereto; lock means operable to move a locking member by a movement substantially parallel to a said surface reversibly into a position which obstructs said sliding rotation of one of the pair of hinge members relative to the other of the pair hinge members from a position which does not so obstruct thereby reversibly to lock the hinge wherein the lock member is attached to one of the hinge members of the pair adjacent an edge of the other of the hinge members which edge presents a locking recess in which said edge is closer to the common axle than are parts of said edge immediately adjacent the locking recess and is shaped and adapted to admit the locking member to lock the hinge; one or more spare hinge members each adapted to replace the said other of the pair of hinge members within the hinge and presenting a respective locking recess adapted to permit in use locking of the hinge in a configuration of hinge members which differs from that permitted by the hinge member so replaced. The kit of parts may include a parts for a collapsible shelter frame as described above.

In the kit of parts the lock means may be operable to rotate a locking member reversibly into a position which obstructs said sliding rotation of one of the pair of hinge members relative to the other of the pair hinge members from a position which does not so obstruct thereby reversibly to lock the hinge.

In the kit of parts the lock means may be operable by a linear movement to move a locking member reversibly into a position which obstructs said sliding rotation of one of the pair of hinge members relative to the other of the pair hinge members from a position which does not so obstruct thereby reversibly to lock the hinge.

In a twelfth of its aspects, the invention may provide a kit of parts (e.g. for a collapsible shelter frame) comprising:

a hinge comprising a pair of opposed plates connected at a common axle about which a surface of one plate of the pair is slidingly rotatable over a surface of the other plate of the pair in parallel opposition thereto; the surface of one plate of the pair includes two lug parts formed to extend therefrom at locations thereupon diametrically opposed across the common axle and disposed thereupon to extend into a respective one of two arcuate channels formed across the opposing surface of the other plate of the pair of plates; wherein the two arcuate channels are formed such that an end of any one of the two channels is diametrically opposed across the common axle from an end of the other of the two arcuate channels in which one, some or each said lug(s) is slideable along a respective arcuate channel to the other end thereof by action of said relative rotation of the opposed plates; one or more spare plates each adapted to replace the said other of the pair of plates within the hinge and comprising two said arcuate channels adapted to permit in use a configuration of the plates of the hinge which differs from that permitted by the plate so replaced when a said lug(s) is at an end of a said respective arcuate channel.

In the kit of parts preferably, one, either or each of the two arcuate channels is an arcuate slot.

In a thirteenth of its aspects, the invention may provide a kit of parts (e.g. for a collapsible shelter frame) comprising:

a hinge comprising a pair of opposed plates connected at a common axle about which a surface of one plate of the pair is slidingly rotatable over a surface of the other plate of the pair in parallel opposition thereto; the surface of one plate of the pair includes two lug parts formed to extend therefrom at locations thereupon diametrically opposed across the common axle and disposed thereupon to extend into a respective one of two arcuate channels formed across the opposing surface of the other plate of the pair of plates; wherein the two arcuate channels are formed such that an end of any one of the two channels is diametrically opposed across the common axle from an end of the other of the two arcuate channels in which one, some or each said lug(s) is slideable along a respective arcuate channel to the other end thereof by action of said relative rotation of the opposed plates; one or more spare plates each adapted to replace the said lug-bearing plate of the pair of plates within the hinge and comprising two said lug parts adapted to permit in use a configuration of the plates of the hinge which differs from that permitted by the plate so replaced when a said lug(s) is at an end of a said respective arcuate channel.

In the kit of parts preferably one, either or each of the two arcuate channels is an acruate slot.

Non-limiting examples of embodiments of the invention are described below with reference to the accompanying drawings of which:

Figure 1:
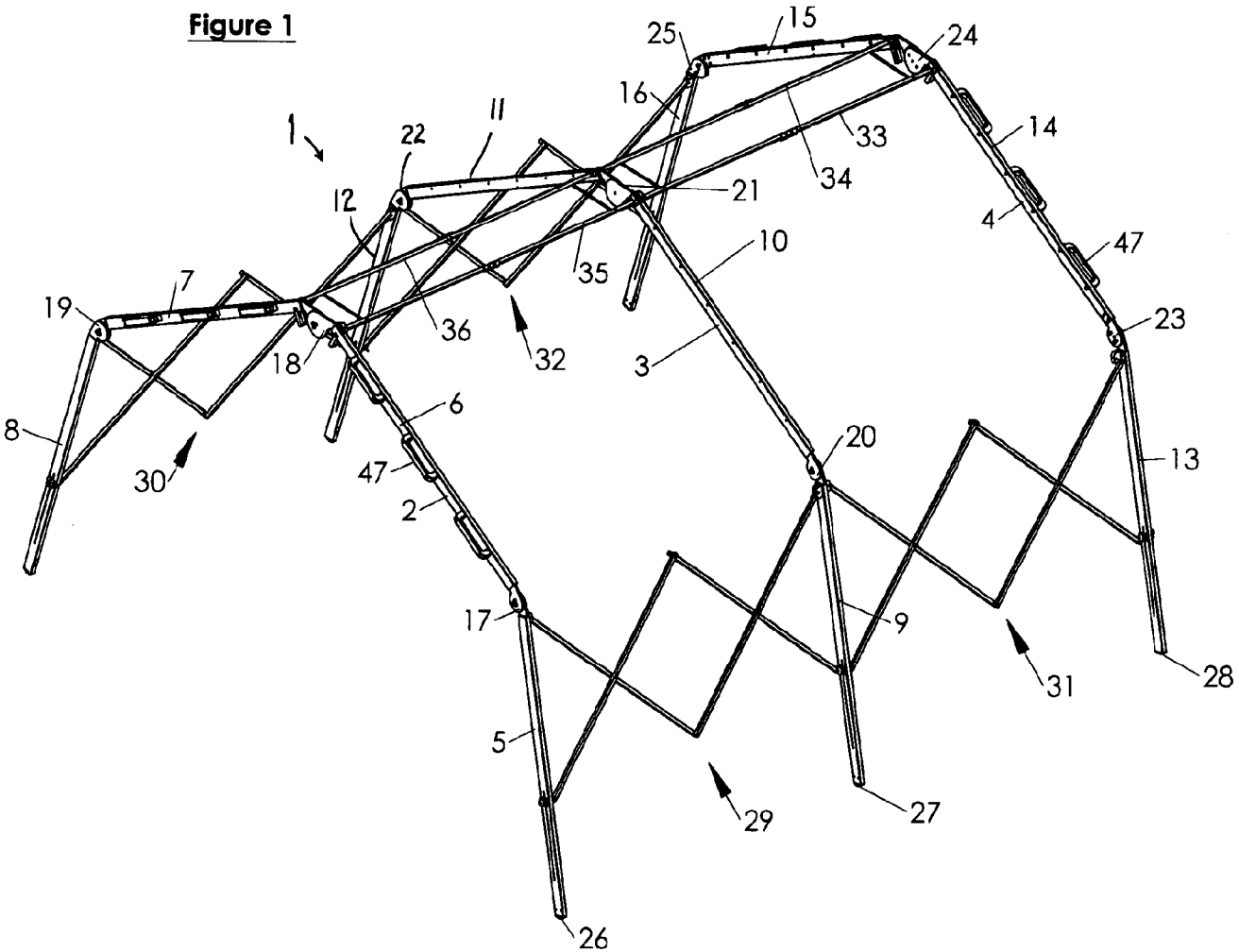
FIG. 1 illustrates an erected tent frame in perspective view.
Figure 23:
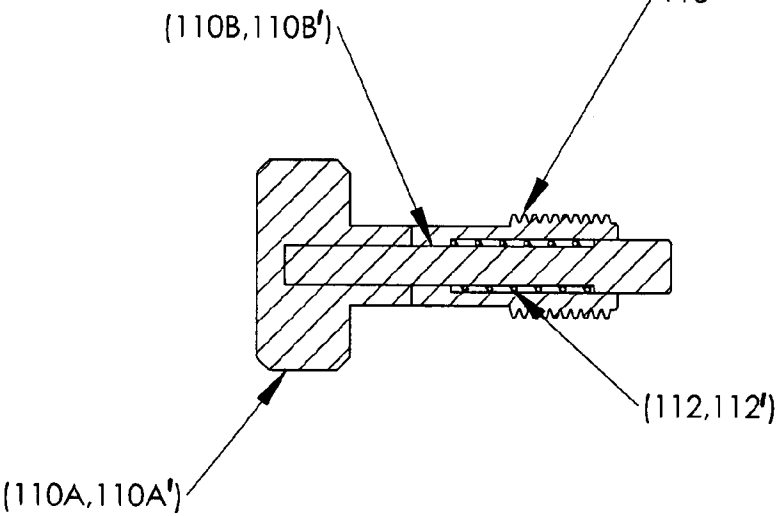
Figure 24:
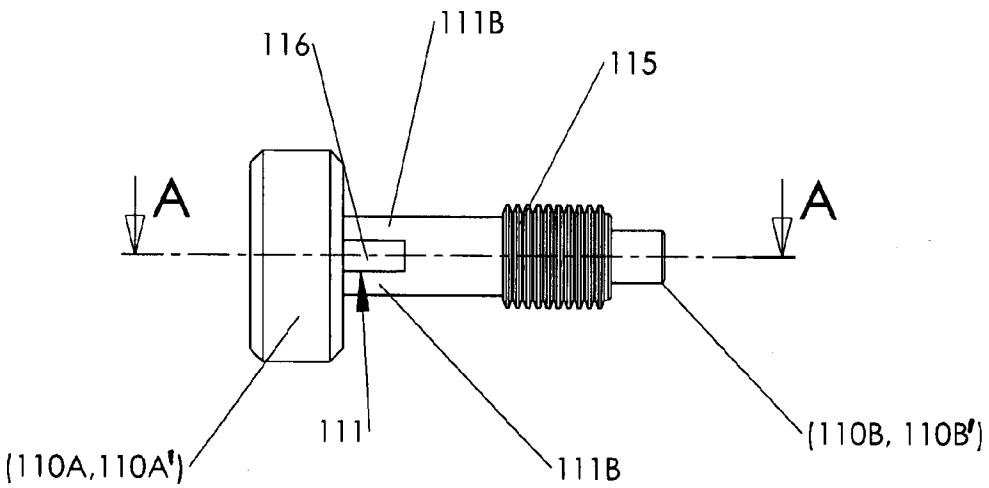

FIGS. 13, 14 15 and 16 illustrate a closed hinge part of the tent frame of FIG. 1 in magnified view;

FIGS. 17, 18, 19, 20, 21 and 22 illustrate an open hinge part of the erected tent frame of FIG. 1 in magnified view;

FIGS. 23 and 24 illustrate a hinge locking pin of the tent frame of FIG. 1 in magnified view;

FIGS. 25, 26, 27 and 28 illustrate magnified views of locked, open hinges of the erected tent frame of FIG. 1.

Figure 27:
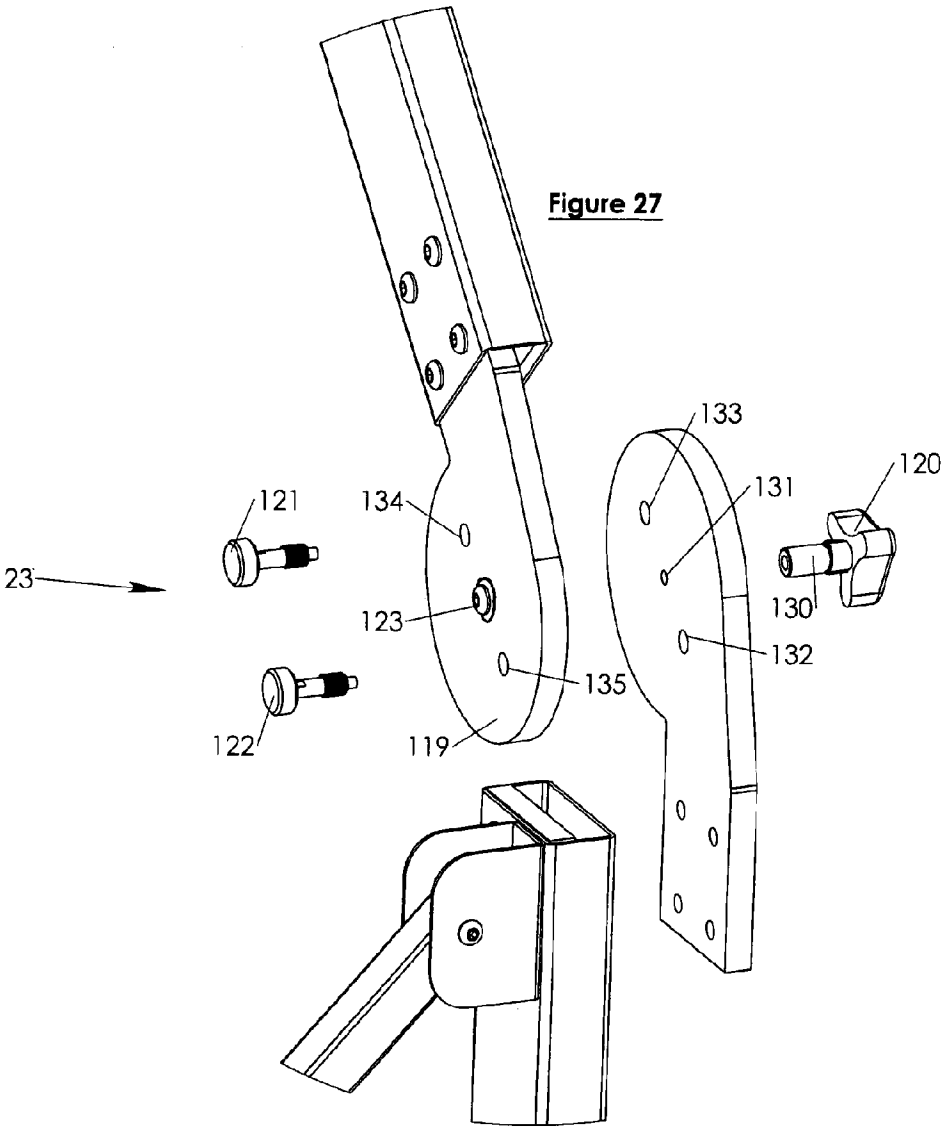
Figure 28:
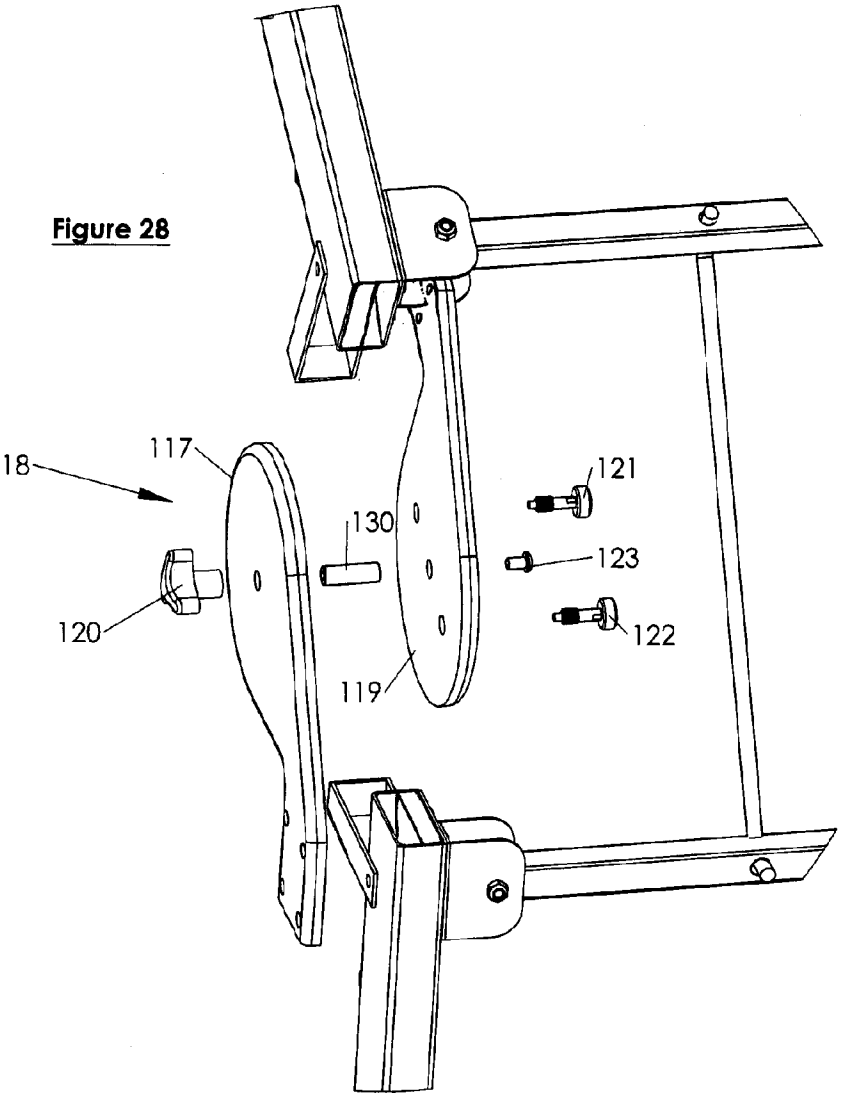
Figure 29:
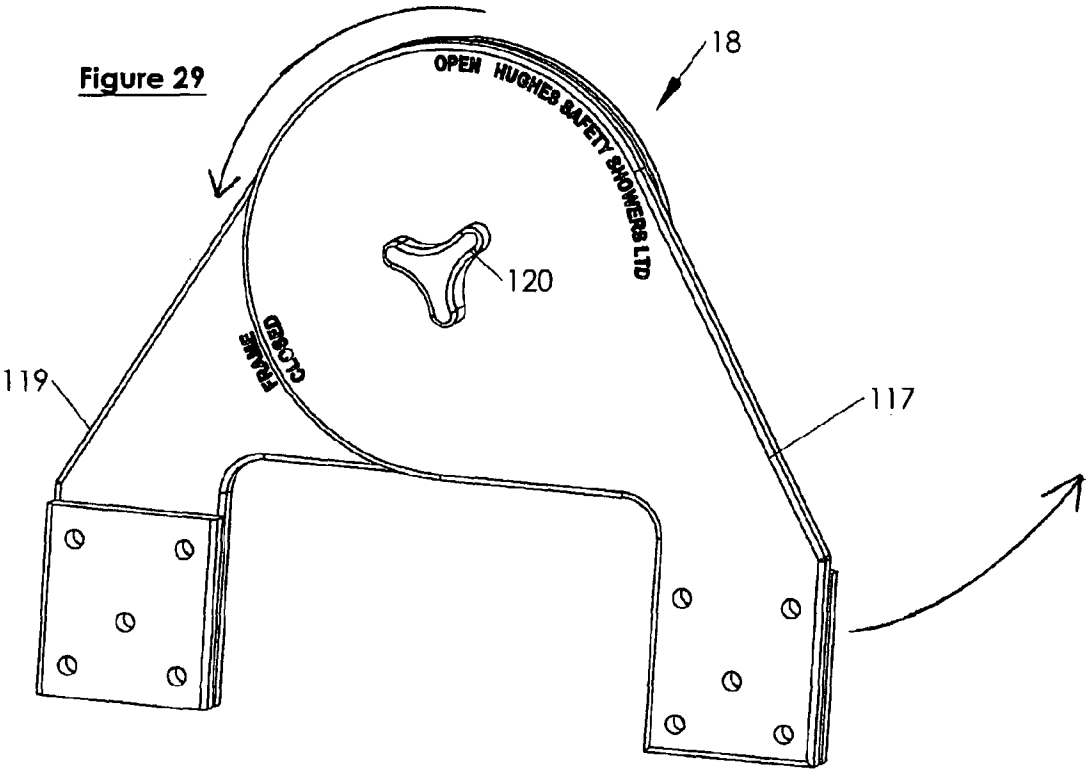
Figure 30:
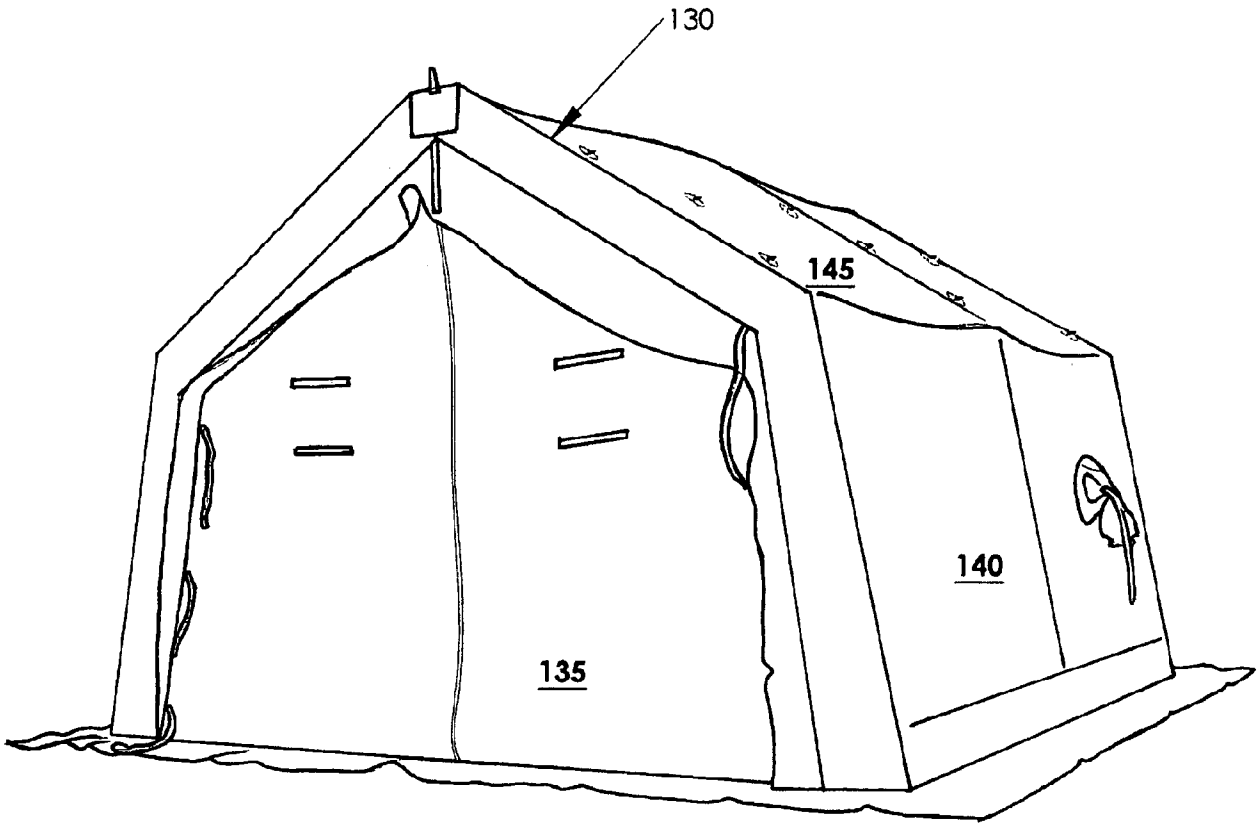
Figures 31A, 31B, 31C:
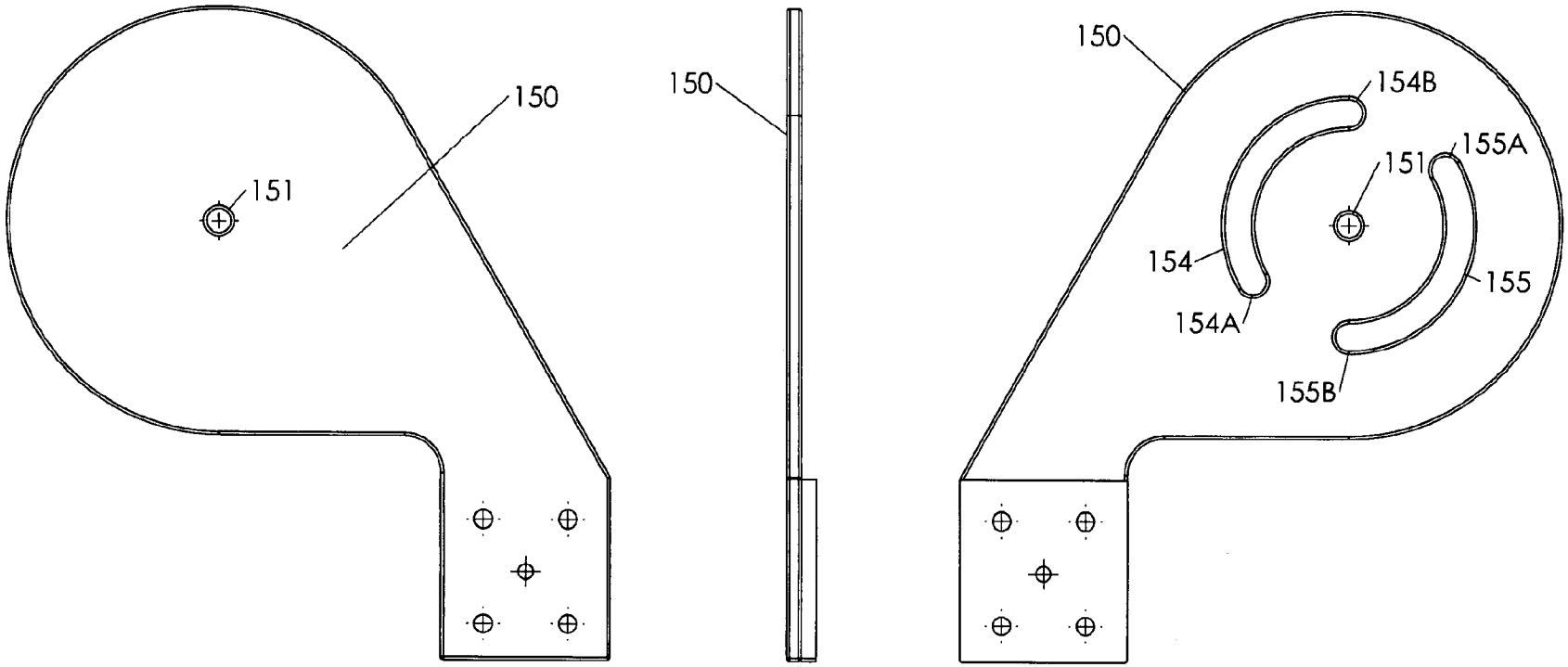
Figure 32C:
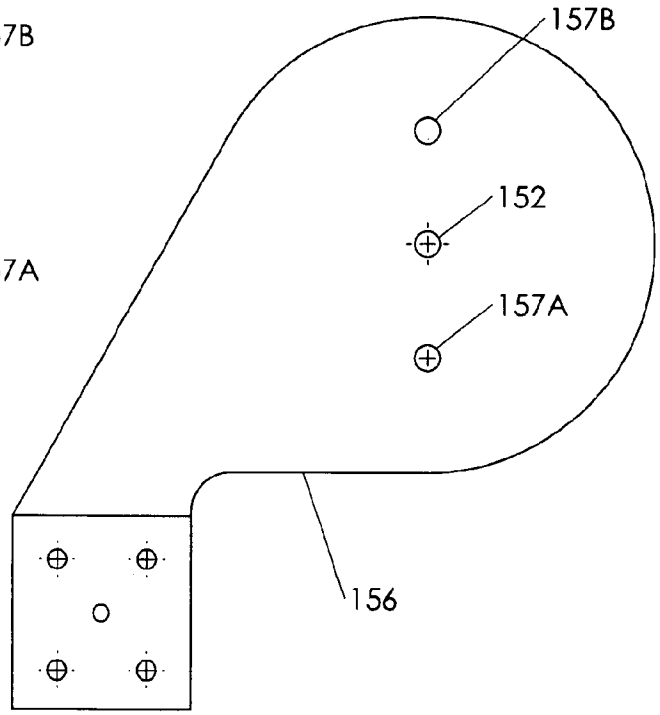
Figure 32B:
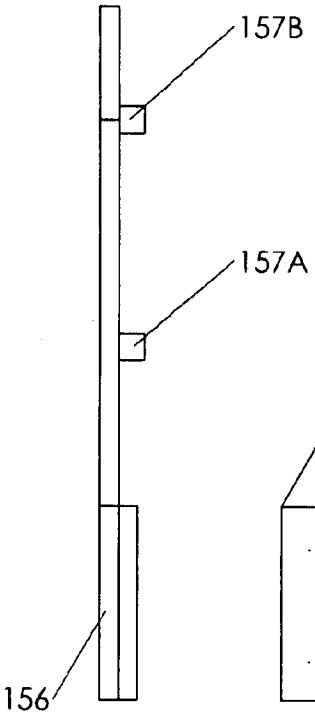
Figure 32A:
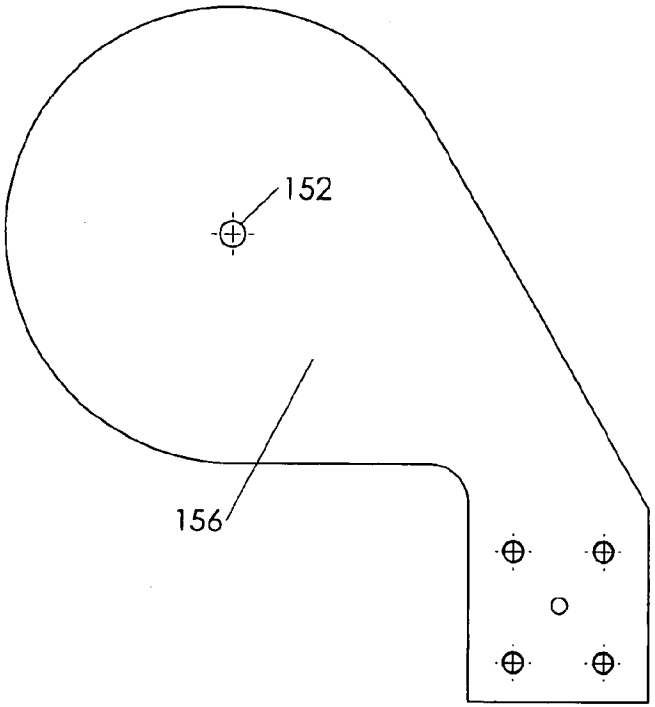
Figure 33C:
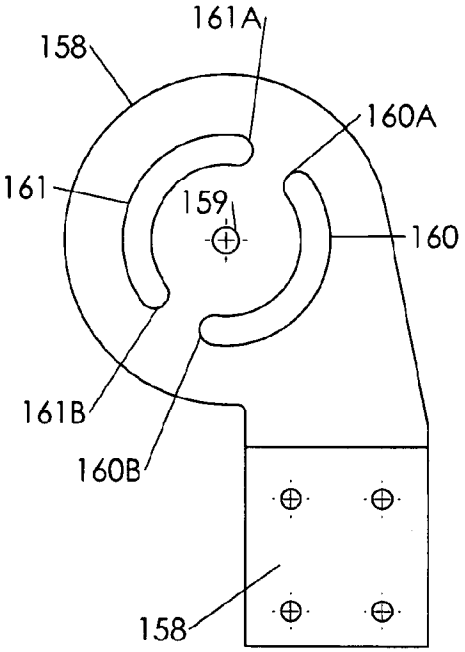
Figure 33B:
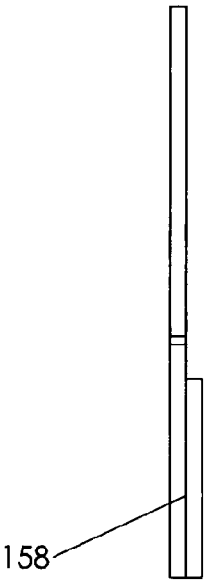
Figure 33A:
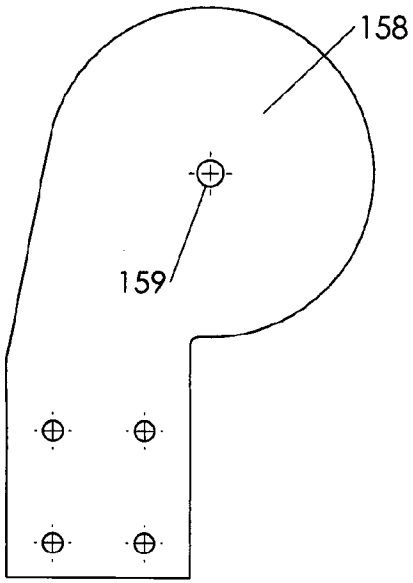
Figure 34C:
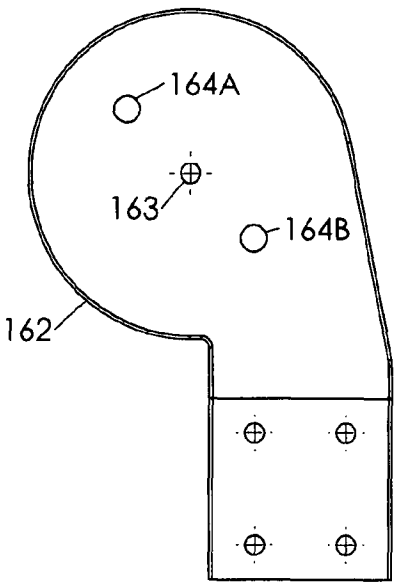
Figure 34B:
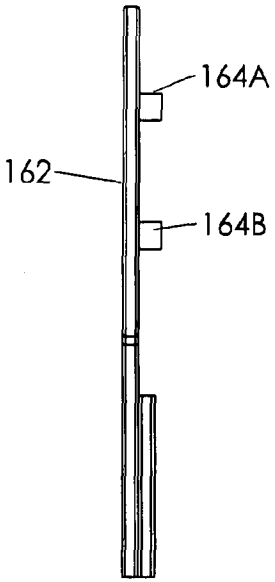
Figure 34A:
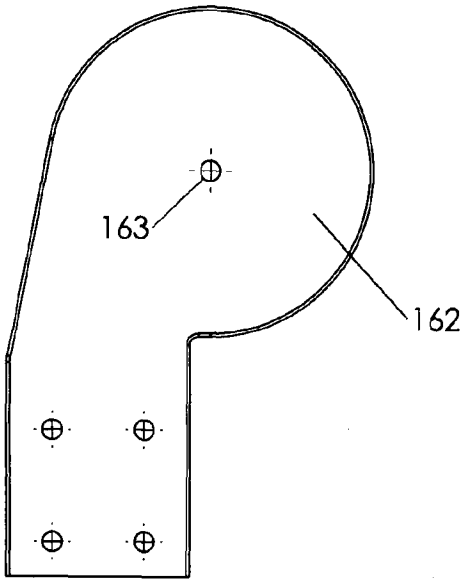
Figures 35, 36:
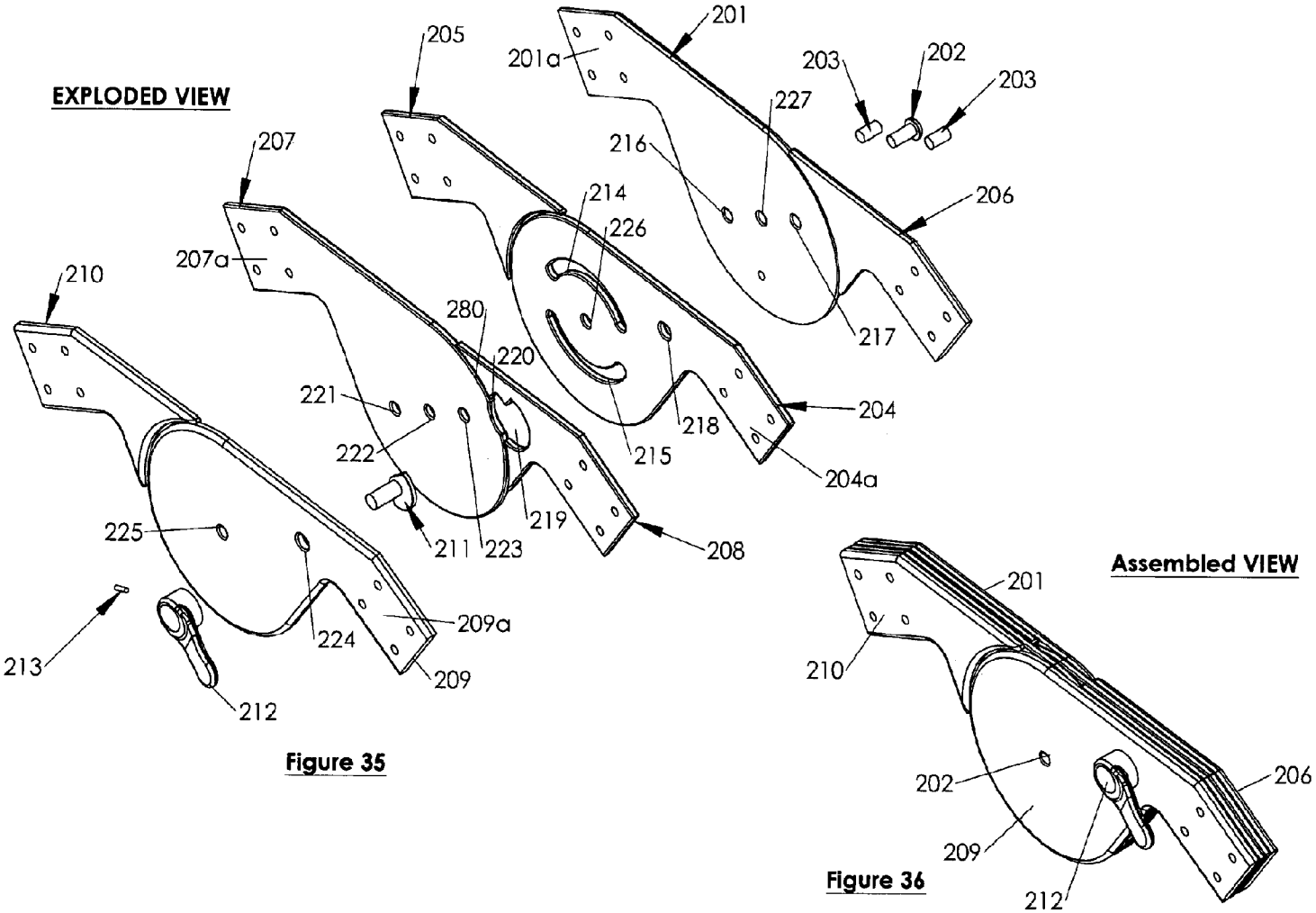
Figure 38:
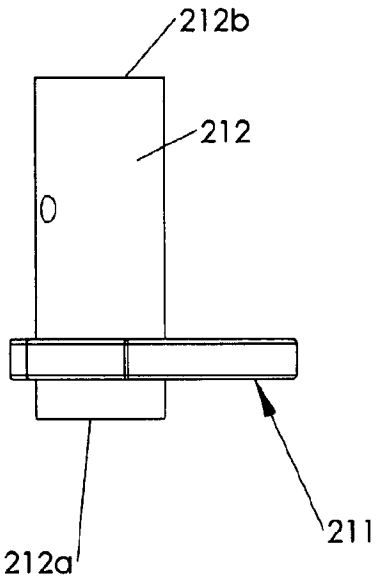
Figure 37:
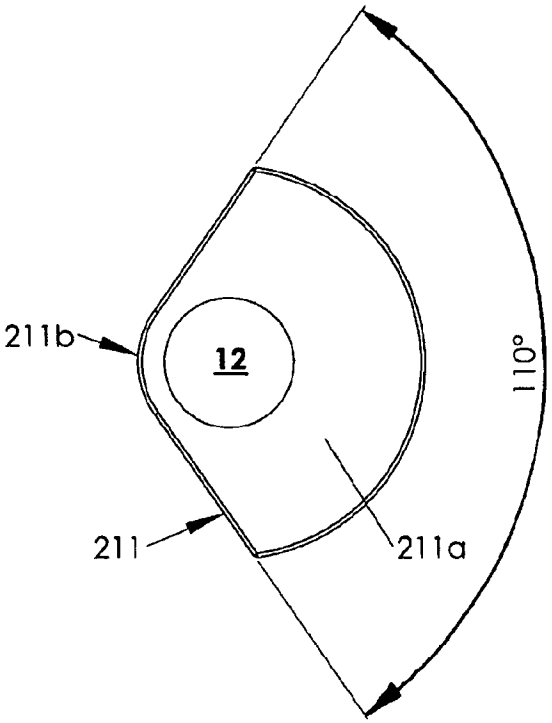
Figure 39B:
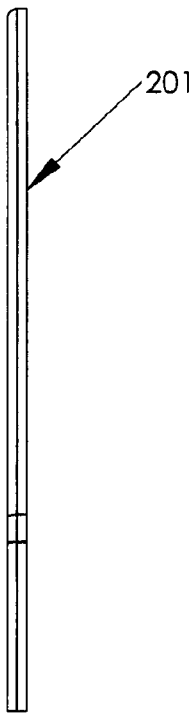
Figure 39A:
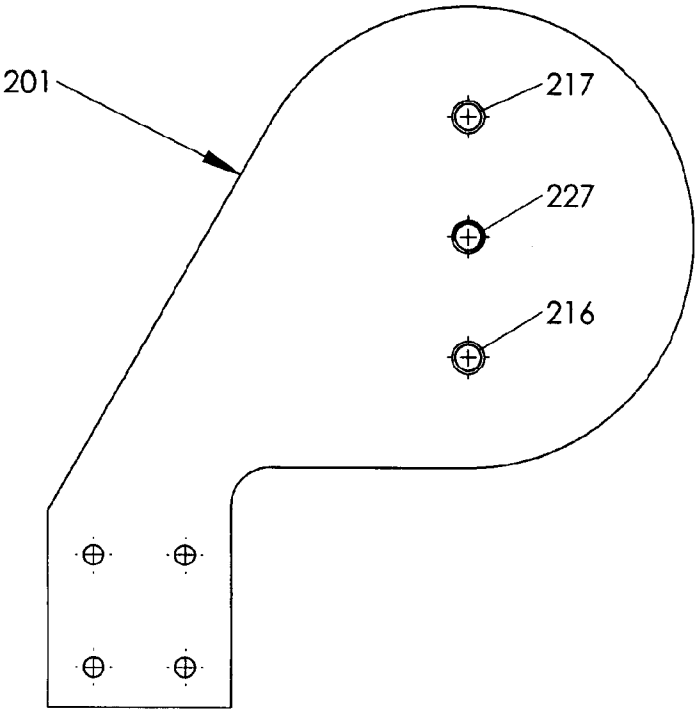
Figure 40B:
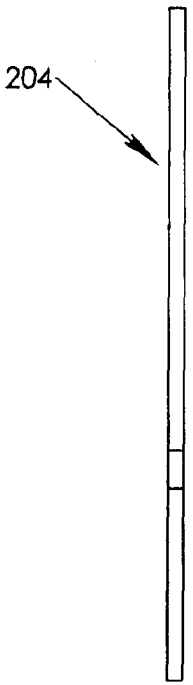
Figure 40A:
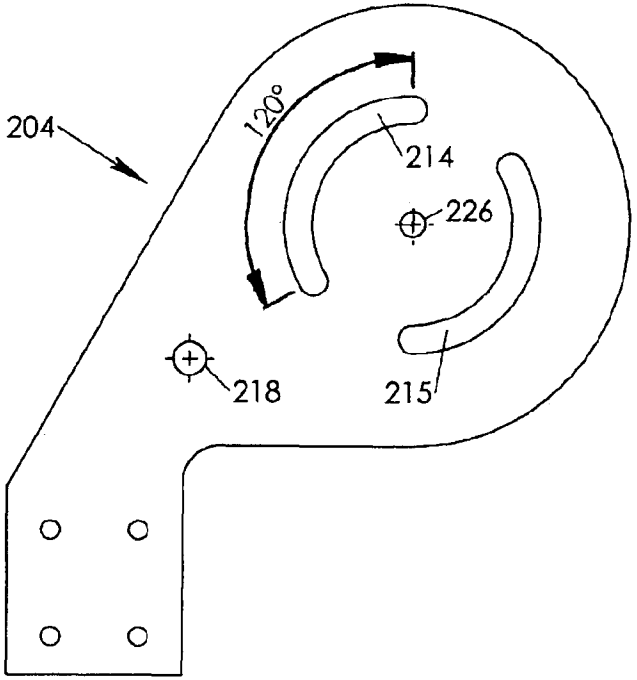
Figure 41B:
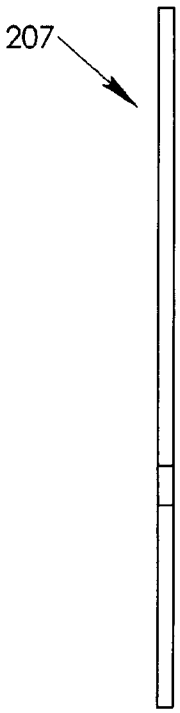
Figure 41A:
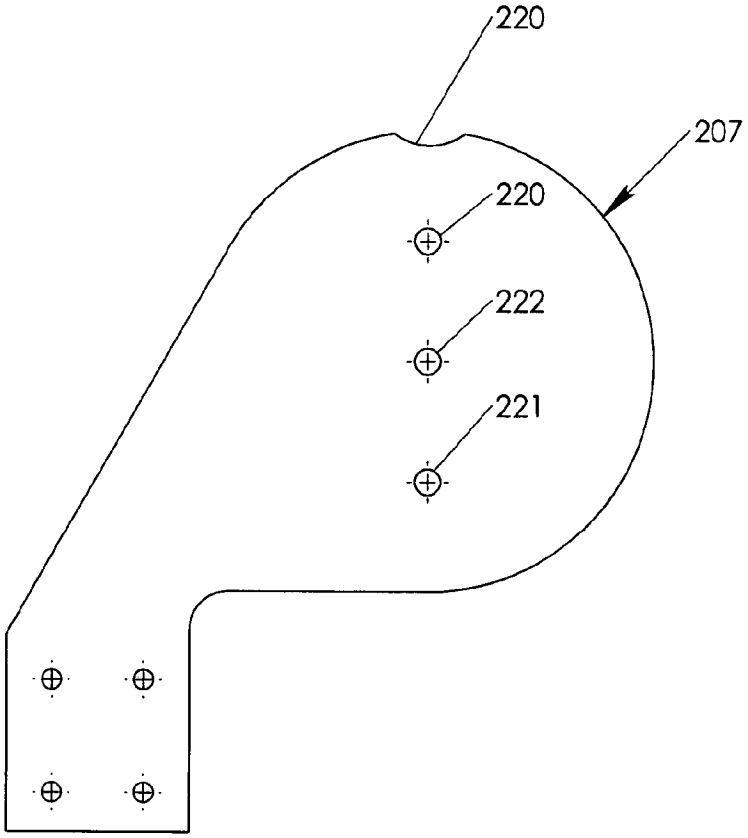
Figure 42B:
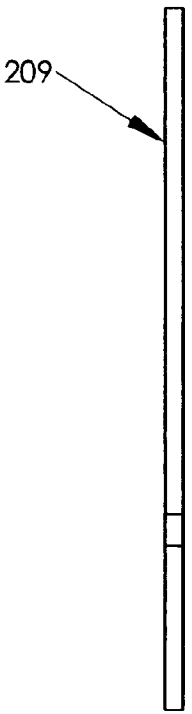
Figure 42A:
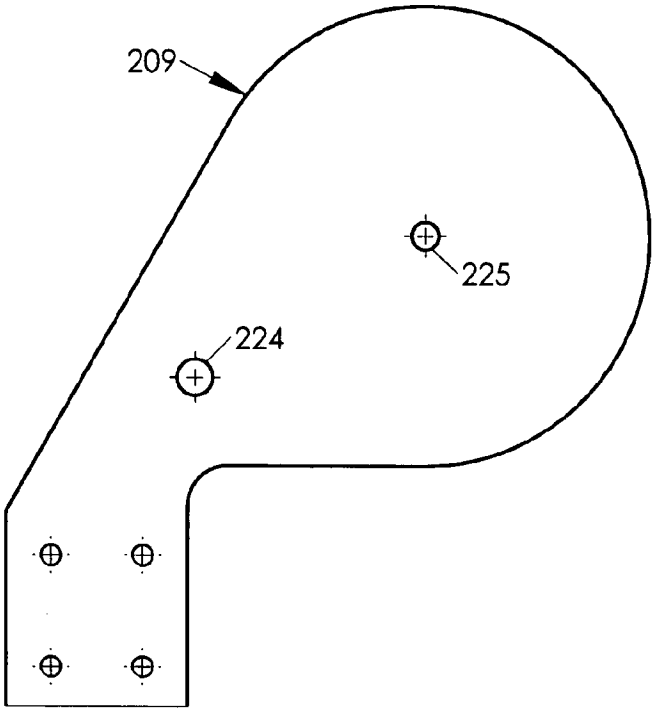
Figure 43B:
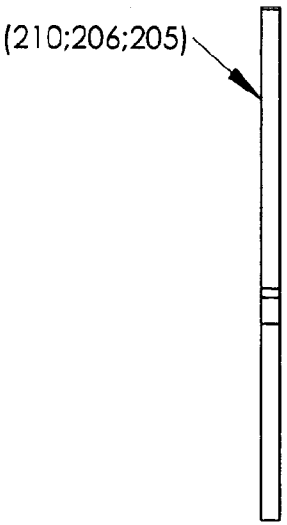
Figure 43A:
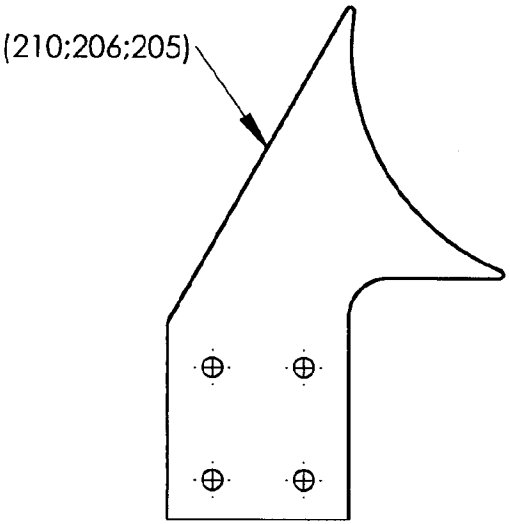
Figure 44B:
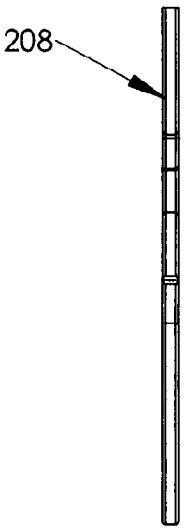
Figure 44A:
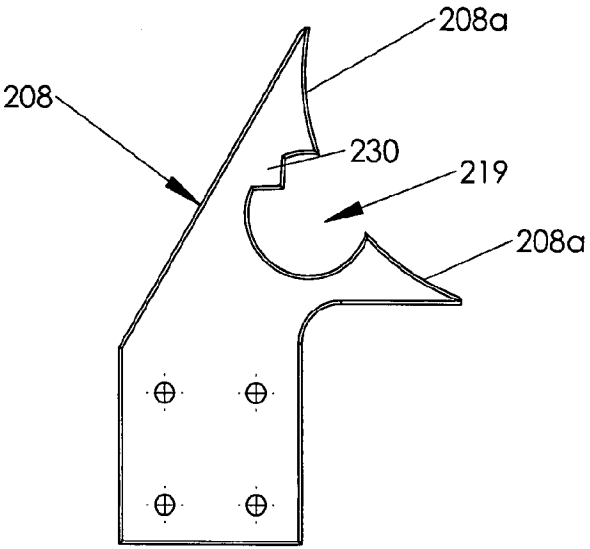
Figure 45:
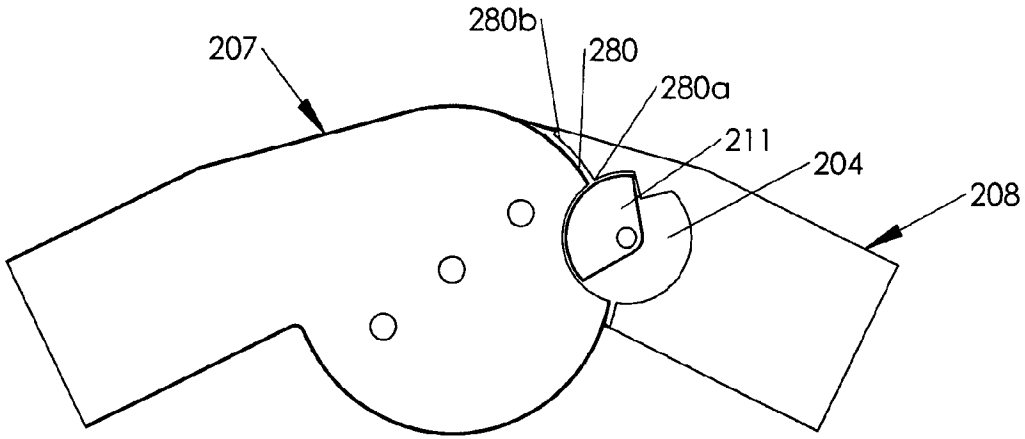
Figure 46:
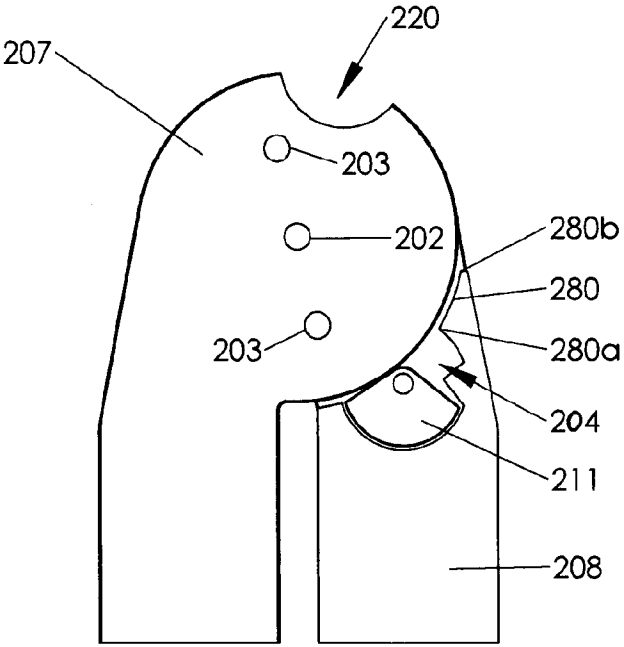
Figure 47:
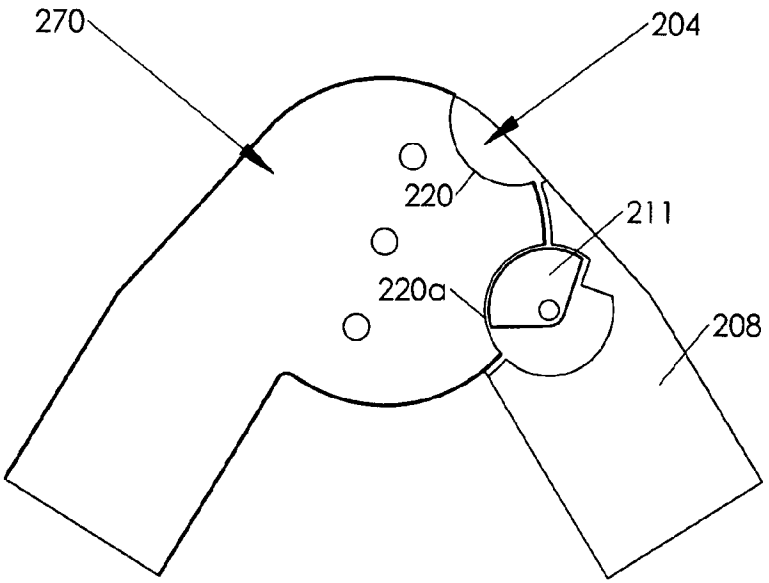
Figure 48:
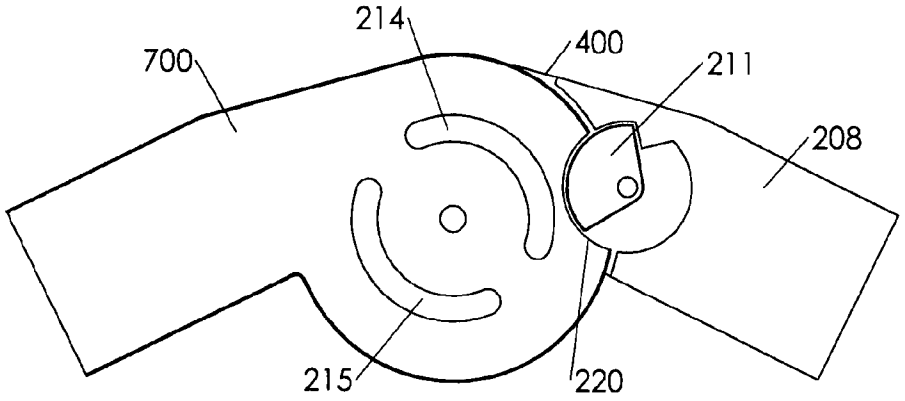
Figure 49:
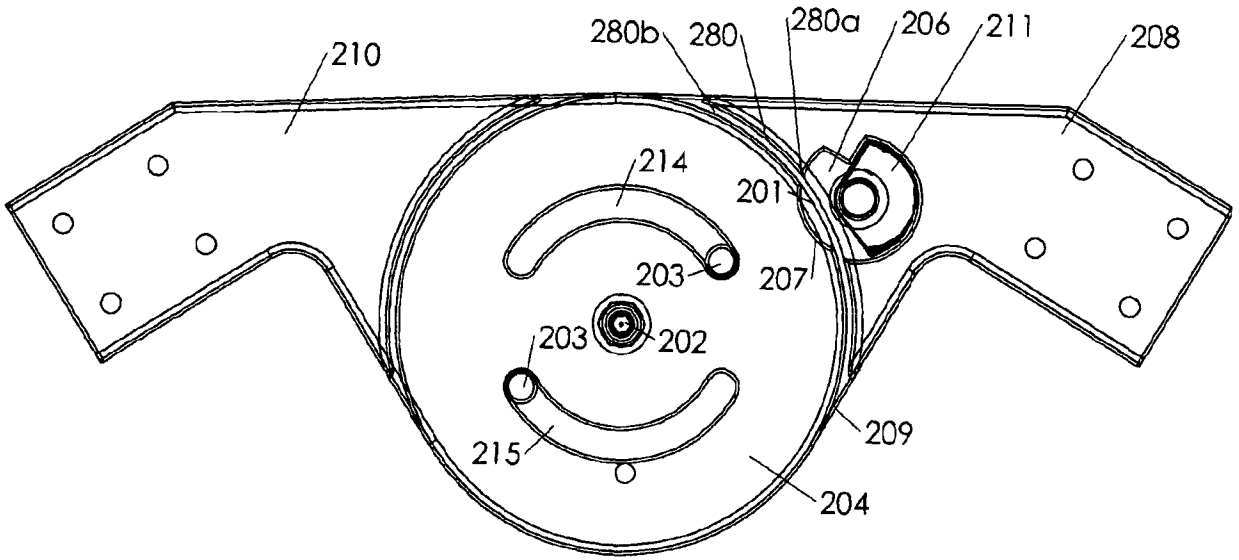
Figure 50C:
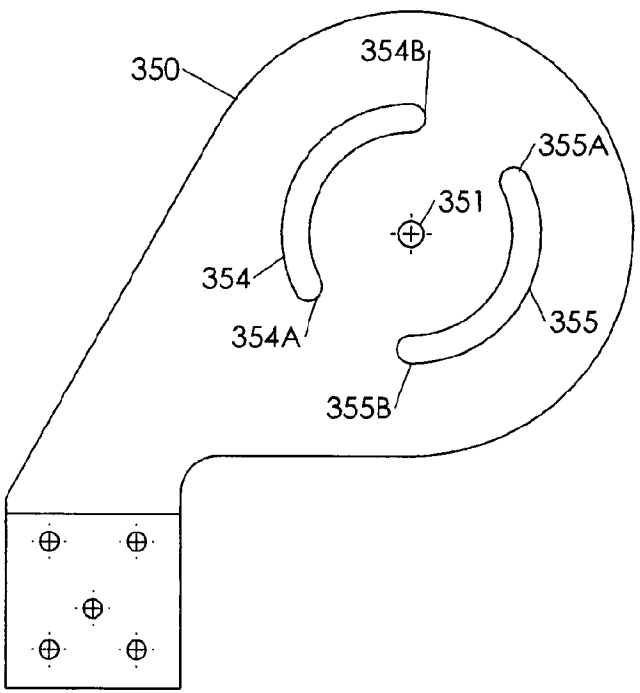
Figure 50B:
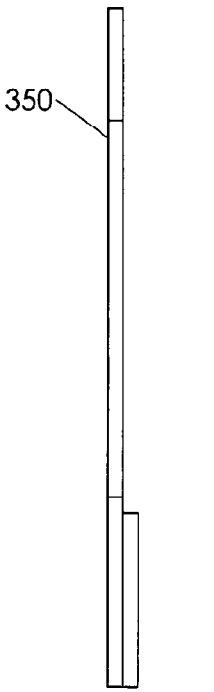
Figure 50A:
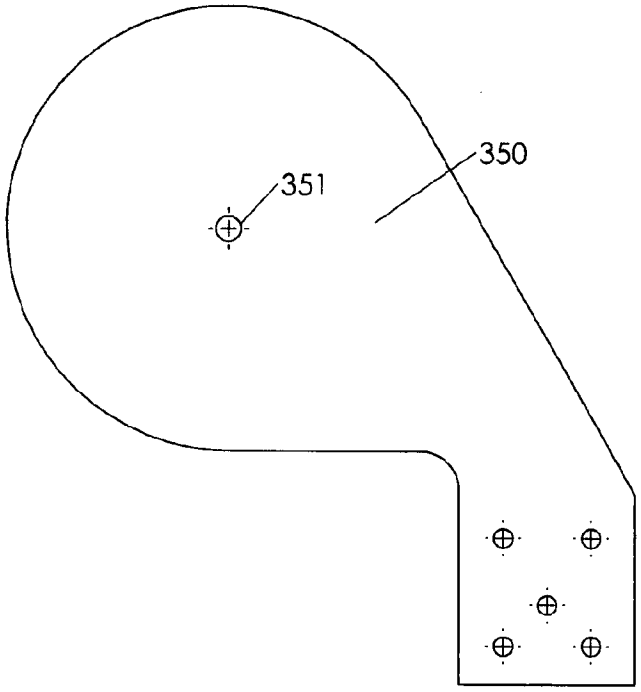
Figure 51C:
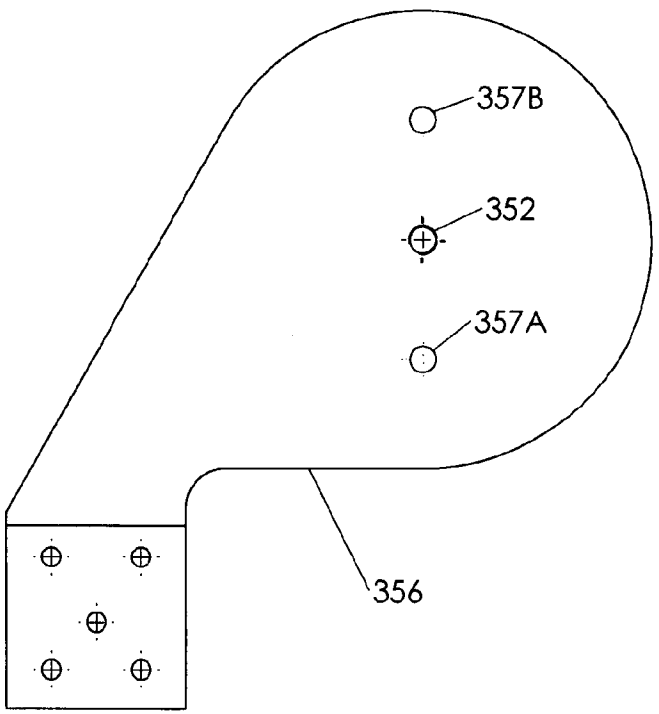
Figure 51B:
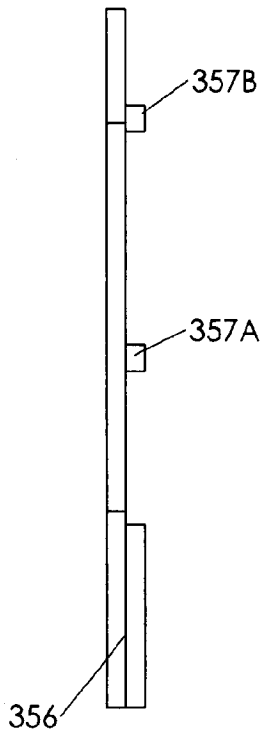
Figure 51A:
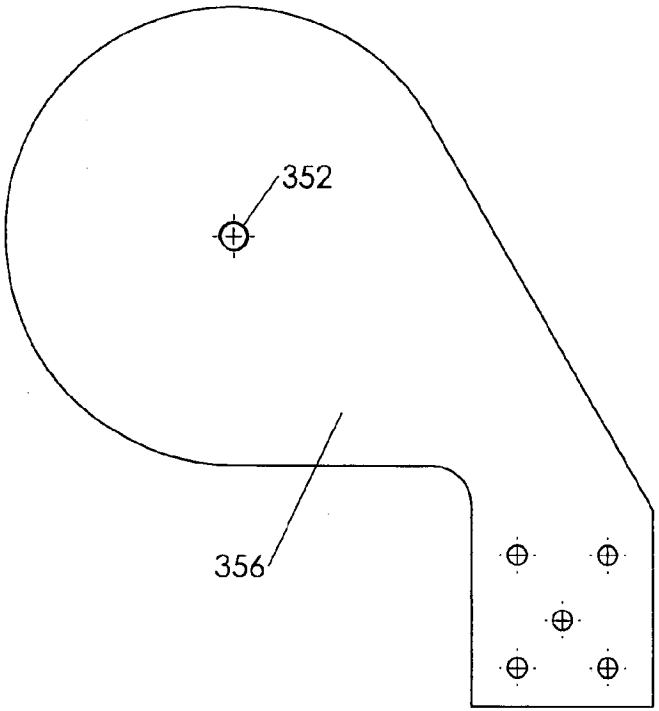
Figure 53C:
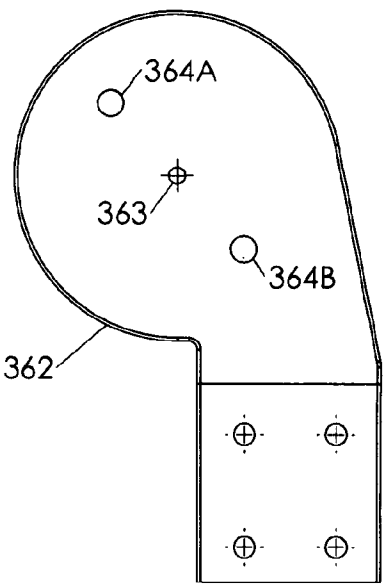
Figure 53B:
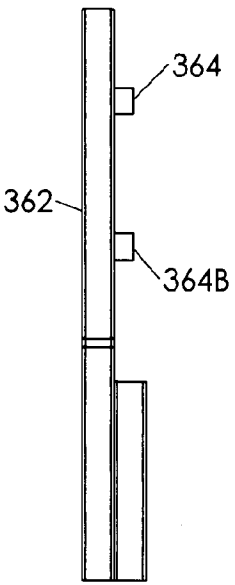
Figure 53A:
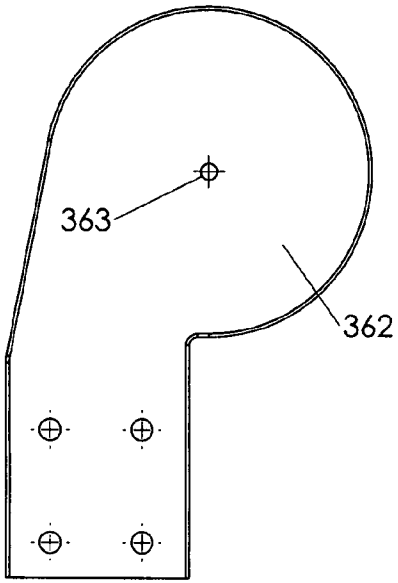
Figure 54:
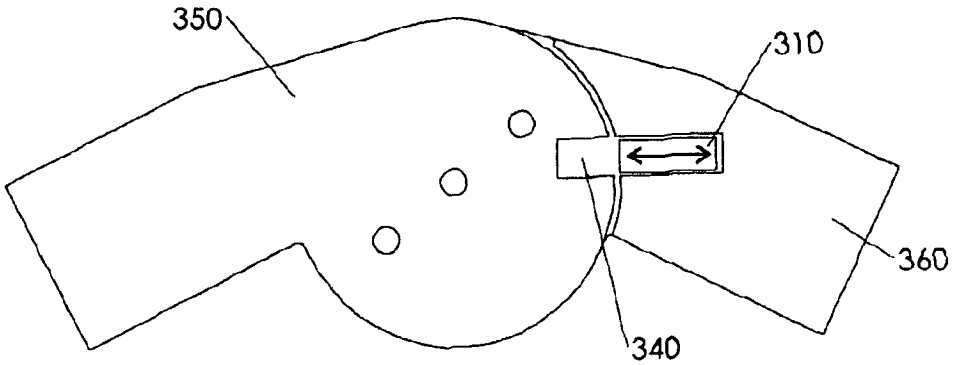
Figure 55:
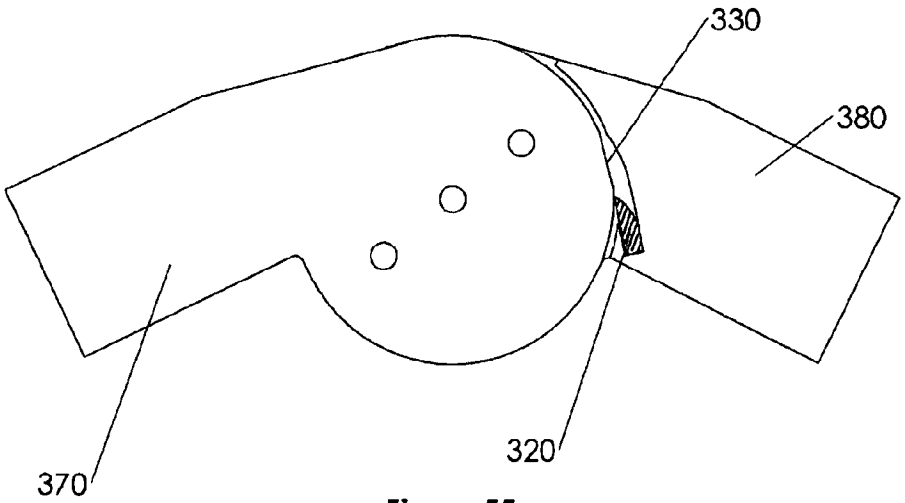

FIGS. 27 and 28 are exploded views;

FIG. 29 shows a closed hinge of the tent frame of FIG. 1 in magnified view;

FIG. 30 illustrates a tent incorporating the erected tent frame of FIG. 1;

FIGS. 31A, 31B and 31C illustrate a first top hinge part of the erected tent frame of FIG. 1 in an alternative embodiment;

FIGS. 32A, 32B and 32C illustrate a second top hinge part of the erected tent frame of FIG. 1 in an alternative embodiment;

FIGS. 33A, 33B and 33C illustrate a first side hinge part of the erected tent frame of FIG. 1 in an alternative embodiment;

FIGS. 34A, 34B and 34C illustrate a second side hinge part of the erected tent frame of FIG. 1 in an alternative embodiment;

FIG. 35 illustrates an exploded view of a hinge;

FIG. 36 illustrates the hinge of FIG. 35 in assembled form;

FIG. 37 illustrates a plan view of a cam on a cam shaft;

FIG. 38 illustrates a side view of the cam of FIG. 37;

FIGS. 39A and 39B illustrate a first hinge member of the hinge of FIG. 35 in plan and side view respectively;

FIGS. 40A and 40B illustrate a second hinge member of the hinge of FIG. 35 in plan and side view respectively;

FIGS. 41A and 42B illustrate a third hinge member of the hinge of FIG. 35 in plan and side view respectively;

FIGS. 42A and 42B illustrate a fourth hinge member of the hinge of FIG. 35 in plan and side view respectively;

FIGS. 43A and 43B illustrate a guide plate of the hinge of FIG. 35 in plan and side view respectively;

FIGS. 44A and 44B illustrate another guide plate of the hinge of FIG. 35 in plan and side view respectively;

FIG. 45 illustrates a schematic view of a locked hinge according to an embodiment of the invention;

FIG. 46 illustrates a schematic view of an unlocked hinge according to FIG. 45;

FIG. 47 illustrates a schematic view of a locked hinge according to yet another embodiment of the invention;

FIG. 48 illustrates a schematic view of a locked hinge according to yet a further embodiment of the invention;

FIG. 49 illustrates a transparent view of the hinge of FIG. 36;

FIGS. 50A, 50B and 50C illustrate views of a hinge member according to an aspect of the invention;

FIGS. 51A, 51B and 51C illustrate views of a hinge member according to an aspect of the invention;

FIGS. 52A, 52B and 52C illustrate views of a hinge member according to an aspect of the invention;

FIGS. 53A, 53B and 53C illustrate views of a hinge member according to an aspect of the invention;

FIGS. 54 and 55 illustrate a lockable hinge with linearly moveable locking members.

In the drawings, like articles are assigned like reference symbols.

FIG. 1 illustrates a one-piece collapsible shelter frame (1) comprising three beam assemblies (2,3,4) each including four beam members (5,6,7,8;9,10,11,12;13,14,15,16). Each beam member of a given beam assembly is joined by a pivot unit (17,18,19;20,21,22;23,24,25) to an adjacent beam member of the beam assembly so as to be reversibly pivotable thereat to a relatively splayed position collectively to form an arch (26,27,28).

A first arch (26) is joined to a second arch (27) by a first cross-brace (29) and a second cross-brace (30) each slidably coupled to beam assemblies of the first and second arches. Similarly, a third cross-brace (31) and a fourth cross-brace (32) join the third arch (28) to the second arch (27) located between the first and third arches. Each cross-brace is slidably coupled to each of an opposing pair of successive arches to reversibly expand therebetween to separate the joined successive arches permitting a concertina-like expansion and collapse of the frame in a direction generally transverse to the plane containing a given arch to draw the arches into close proximity or contact.

A pair of collapsible top braces (33,34) join the apices of the second and third arches while a second pair of collapsible top braces (35,36) join the apices of the second and first arches (27,26). Each top brace is pivotably coupled to, and between, adjacent pairs of arches and possesses a fold pivot midway along its length permitting the given top brace to fold in half to accommodate the complete collapse of the frame as between the adjacent arches connected by the top brace. When fully extended, however, each top brace acts as a restraint to prevent further expansion or separation between adjacent arches thereby preventing over-expansion between such arches.

Figure 2:
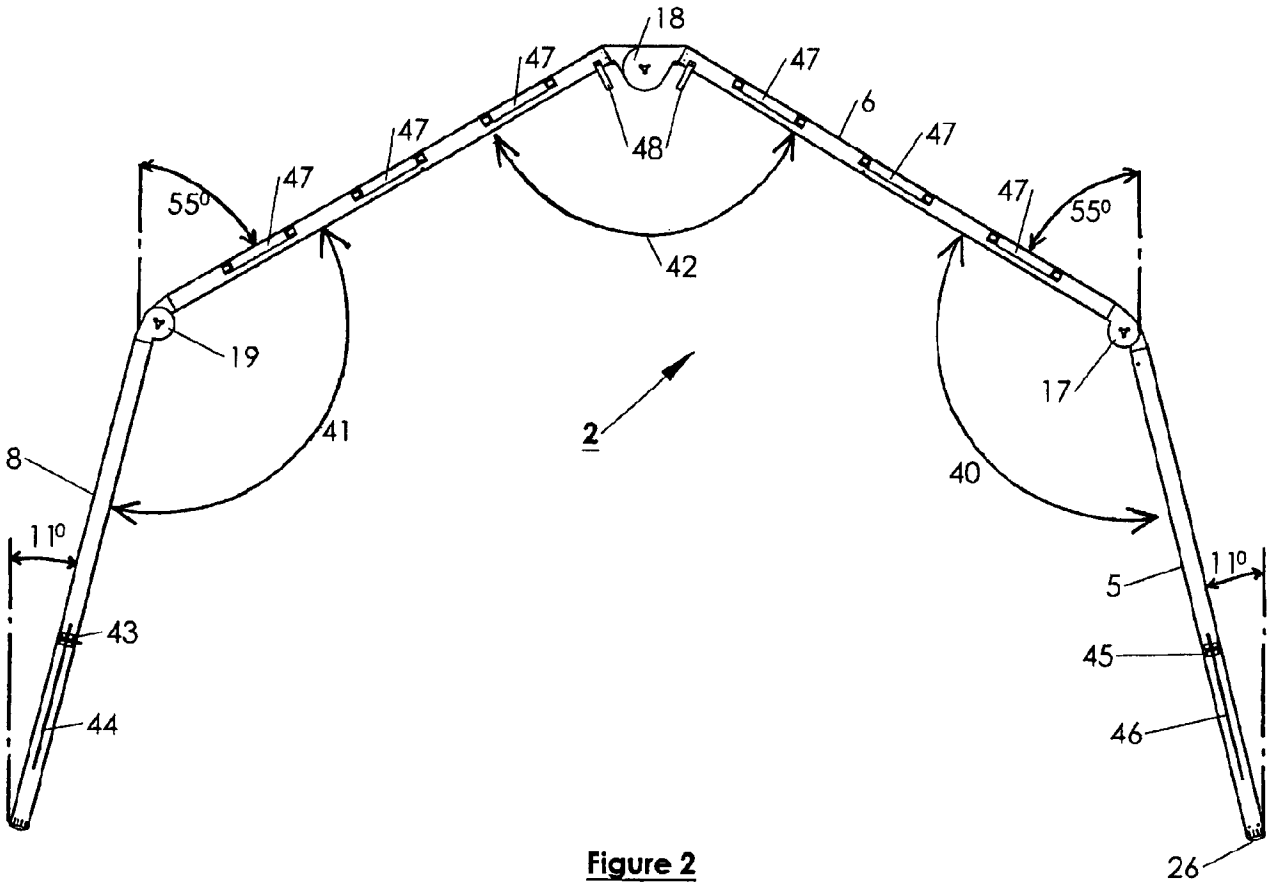
FIG. 2 illustrates the erected tent frame of FIG. 1 in front view.

FIG. 2 illustrates a frontal view of the first (26) arch (or the third (28) arch) of the fully erected tent frame (1) of FIG. 1 along the long axis of the frame. A first upper beam member (6) is pivotably connected to a second upper beam member (7) at a first top pivot unit (18) forming a hinge operable to permit the first and second beam members to separate from a closed position in which they are substantially parallel to an open position in which they are splayed about the hinge (18). The top hinge is structured to slidably open from a closed position to a maximally open position at which it is releasably lockable by locking pins. The maximal splayed angular separation permitted by the top hinge when locked, is substantially 110 degrees (or thereabouts). When not in the locked state, the top hinge (18) permits continuous angular displacement of the first and second beam members through substantially all lesser angles as indicated by arrows 42 in FIG. 2.

The end of the first upper beam (6) member free of the top hinge (18) is pivotably connected to an end of a beam member (5) defining a side beam of the frame. Similarly, the end of the second upper beam (7) of the arch free of the top hinge (18) is also pivotably coupled to an end of a third beam member (8) defining a side beam of the frame. Each such side beam is pivotably coupled to a respective upper beam member via a respective pivot unit (17,19) defining a side hinge. Each such side hinge is constructed and arranged to allow pivotal movement of a side beam member relative to the upper beam member to which it is coupled from a closed state in which the side beam member and upper beam member are substantially parallel and in close proximity, to an open state in which the side beam and upper beam members are splayed apart by a maximum angle (40,41) determined by the side hinge coupling them. Each such side hinge is releasably lockable by locking pins operable to lock the respective upper beam and side beam members when in the maximally splayed position, and unlockable to permit a continuous pivoting movement of the respective beams through all of the angles leading to a closed position. Each such side hinge is structured and arranged to permit a maximal splay angle (40,41) of substantially 136 degrees, or thereabouts. As a result, when in the fully opened state in use, the first arch (2) disposes the long axes of each of its upper beam members at an inclination of 35 degrees from the horizontal, and disposes the long axes of each of its side beam members at an angle of 11 degrees from the vertical concurrently. This arrangement has been found to provide good stability and strength against lateral stresses such as side winds acting upon the frame in use as a tent frame.

Figure 2B:
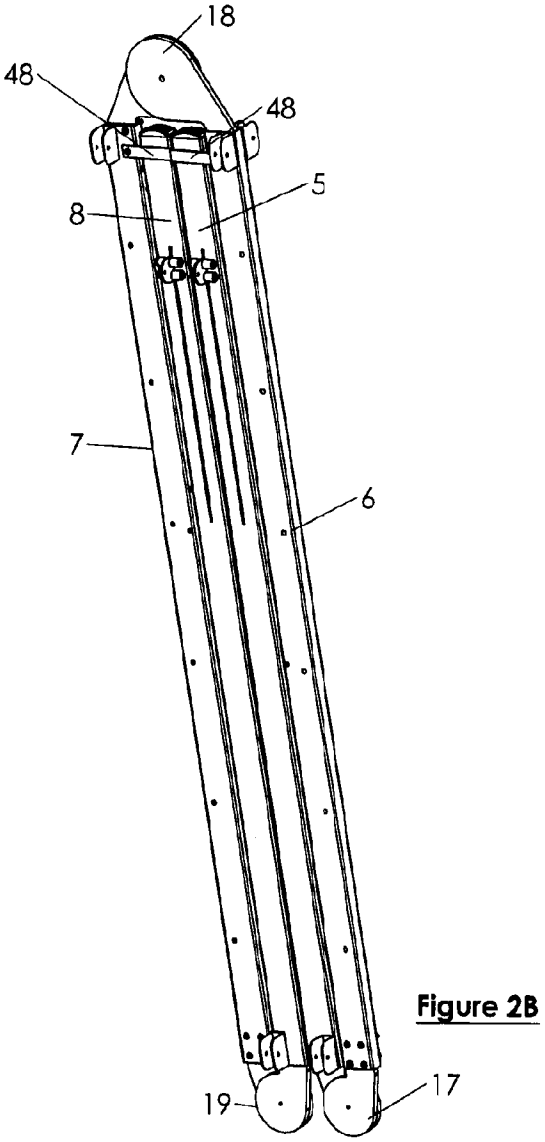
FIG. 2B illustrates a beam assembly in collapsed state.

When in the fully closed state, each side beam member may be folded against the accessible side of the upper beam member to which it is coupled, and the distal end of each side beam member secured in a stirrup (48) attached to the beam assembly adjacent to the top hinge and arranged to receive the distal end of the side beam for storage. Subsequent closure of the two top beam members (6,7) close all beam members (5,6,7 and 8) of the beam assembly together as illustrated together in FIG. 2B.

Each side beam member (5,8) possesses a slot formation (44,46) passing through the side beam in question and extending along a portion of the axial length of that beam member. Being formed through and accessible via surfaces of the beam member adapted in use to oppose a corresponding beam member of an adjacent beam assembly of the frame. Housed within the slot formation (44,46) of the given side beam member is a shuttle member (43,45). The shuttle member is retained within, but freely slidable along, the slot formation within which it is housed and is dimensioned to project outwardly from the slot formation at each of the two opposite sides of the side beam member within which the slot formation is presented. This enables other components of the frame assembly to be coupled to the shuttle member and thereby slidingly coupled to the side beam member which houses the shuttle member in question. Each such slot formation possesses closed slot ends collectively defining a closed slot. The shuttle member associated with the given slot formation is operable to be abutted against the closed slot end nearmost the side hinge (17,19) to which the side beam member (5,8) within which it housed, is attached. Each shuttle member has attached to it a tensioning cable (not shown) which is simultaneously attached to a part of the associated side beam member, or side hinge, and operable to be tensioned to urge the shuttle member attached to it against the closed end of the slot formation nearmost the side hinge associated with the side beam in question. In this way the tensioning cable acts to effectively lock the shuttle member in a substantially fixed position within its associated side beam member when the tensioning cable is appropriately tensioned. Releasing tension in the tension cable thus enables the shuttle member to slide along the slot formation. The tensioning cable (not shown) may comprise a rigging strap or a loop operable to be reversibly shortened to apply an urging force to the shuttle member as a result.

Handles (47) are arrayed upon the first and second upper beam members being spaced along the axial length of each respective beam upon the outer surface thereof outwardly presented from the erected arch (2) when operated in use. This positioning enables a user to use the handles to pull the beam assembly in the process of expanding the frame into the position shown in FIG. 1.

It is to be noted that each of the first (2), second (3) and third (4) beam assemblies of the frame is structured and operable in a manner substantially identical to that described with reference to FIG. 2 above with the optional exception that the second beam assembly (3) intermediate the first (2) and third (4) beam assemblies may omit any handles (47) as shown in FIG. 1, and may possesses side hinges (20,22) which are not lockable in their maximally open splayed state or are operable to be maximally opened/splayed without being locked in that position. This enables a degree of flexibility in the frame at the intermediate arch (27) formed by the second beam assembly (3) and permits the feet of the intermediate arch to adjust to uneven ground surfaces relatively higher or lower than the ground surface heights at other feet of the frame. To this extent, a certain small degree of twisting is permitted by the frame.

Figure 3:
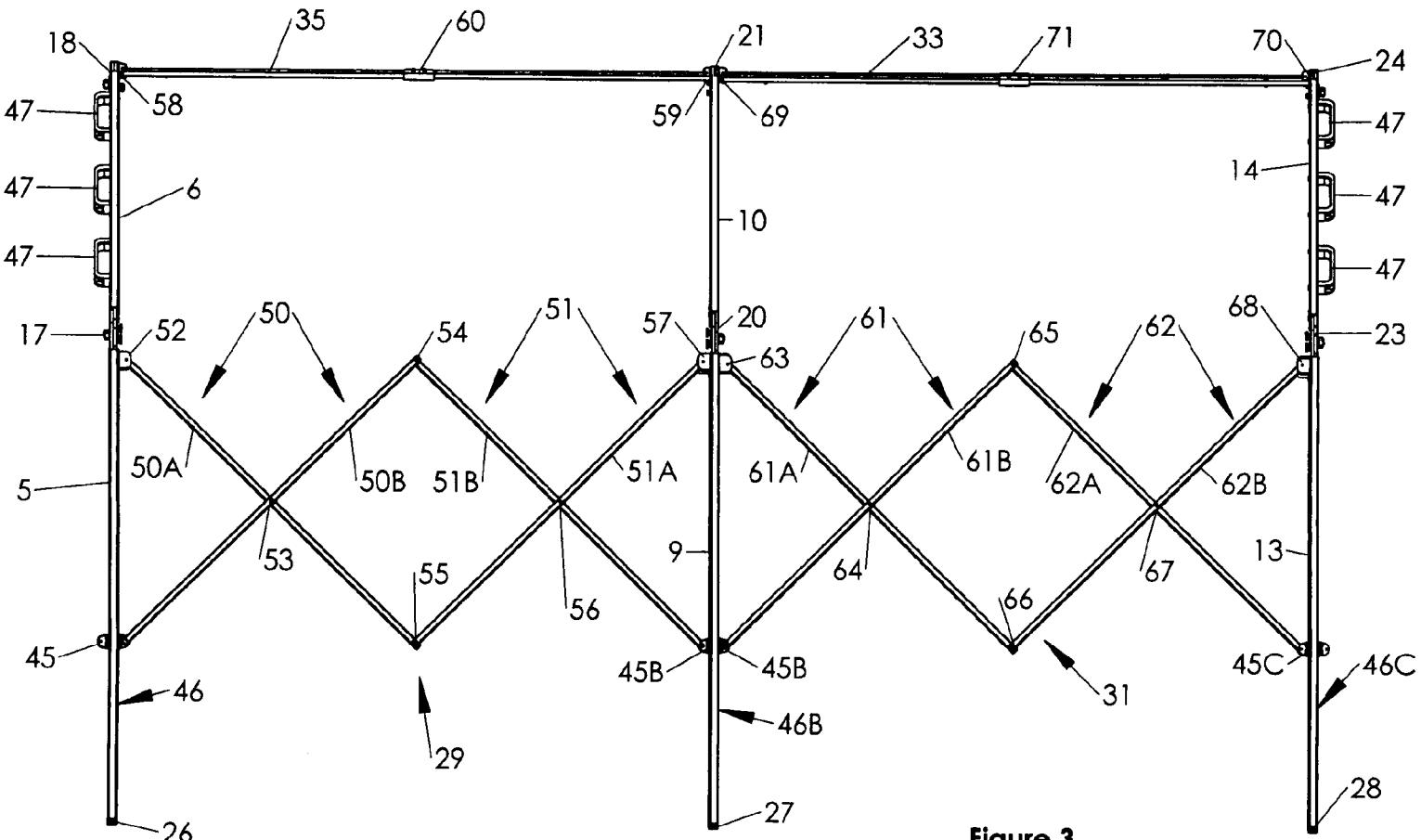
FIG. 3 illustrates the erected tent frame of FIG. 1 in side view.

FIG. 3 illustrates a side view of the fully expanded and erected tent frame illustrated in FIGS. 1 and 2.

The first cross-brace (29) includes a first pair (50) of crossed arms (50A, 50B) joined at a pivot member (53) where they cross. The crossed arms of the first pair are operable to pivot about the pivot joint (53) in a scissor-like action.

An end of a first crossed arm (50A) is pivotably attached to the side beam member of the first arch (26) of the frame assembly at a hinge (52) fixed in location adjacent to a side hinge (17) of the first arch. Simultaneously, an end of the second crossed arm (50B) of the first pair (50) is pivotably attached via a hinge to a shuttle unit (45) slidably attached to the side beam member (5) to which the end of the first arm (50A) of the first pair of crossed arms (50) is attached.

The first cross-brace (29) includes a second pair (51) of crossed arms (51A, 51B) joined at a pivot member (56) where they cross. The crossed arms of the second pair are operable to pivot about the pivot joint (56) joining them in a scissor-like action.

An end of a first crossed arm (50B) is pivotably attached to the side beam member of the first arch (26) of the frame assembly at a hinge (57) fixed in location adjacent to a side hinge (20) of the second arch. Simultaneously, an end of the second crossed arm (51B) of the first pair (51) is pivotably attached via a hinge to a shuttle unit (45B) slidably attached to the side beam member (9) to which the end of the first arm (51A) of the second pair of crossed arms (51) is attached.

The first arm (50A) of the first pair of crossed arms (50) of the first cross-brace (29) is pivotably attached (via a pivot join (55), to the first arm (51A) of the second pair of crossed arms of the first-brace (29). Simultaneously, the second crossed arm (50B) of the first pair of crossed arms (50) is pivotably connected, via a pivoted joint (54), to the second arm (51B) of the second pair (50) of crossed arms of the first cross-brace (29).

Separation of the first (26) and second (27) arches results in an expansion of the first cross-brace (29) along the direction of increasing arch separation. Such separation causes the ends of the first cross-brace (29) slidably coupled to arches via a shuttle unit (45,45B) to upwardly slide, along associated slot formations (44,46 etc) towards those parts of the first cross-brace coupled to an arch via a fixed hinge (52,57 etc), whilst simultaneously pairs of collapsible top braces (35, 36) unfold about a mid-hinge assembly (60) as the hinges (58,59) via which the terminal ends of each top of brace is pivotably attached (to and between) adjacent beam assemblies are separated.

The second cross-brace (31) includes a third pair (61) of crossed arms (61A, 61B) joined at a pivot joint (64) where they cross. The crossed arms of the third pair are operable to pivot about the pivot joint (64) in a scissor-like action.

An end of a first crossed arm (61A) is pivotably attached to the side beam member of the second arch (27) of the frame assembly at a hinge (63) fixed in location adjacent to a side hinge (20) of the second arch. Simultaneously, an end of the second crossed arm (61B) of the third pair (50) is pivotably attached via a hinge to a shuttle unit (45B) slidably attached to the side beam member (9) to which the end of the first arm (61A) of the third pair of crossed arms (61) is attached.

The second cross-brace (31) includes a fourth pair (62) of crossed arms (62A, 62B) joined at a pivot member (67) where they cross. The crossed arms of the fourth pair are operable to pivot about the pivot joint (67) in a scissor-like action.

An end of a first crossed arm (62B) is pivotably attached to the side beam member of the third arch (28) of the frame assembly at a hinge (68) fixed in location adjacent to a side hinge (23) of the third arch. Simultaneously, an end of the second crossed arm (62A) of the fourth pair (62) is pivotably attached via a hinge to a shuttle unit (45C) slidably attached to the side beam member (13) to which the end of the first arm (62B) of the fourth pair of crossed arms (62) is attached.

The first arm (61A) of the third pair of crossed arms (61) of the second cross-brace (31) is pivotably attached (via a pivot joint (66), to the first arm (62B) of the fourth pair of crossed arms of the second cross-brace (31). Simultaneously, the second crossed arm (61B) of the third pair of crossed arms (62) is pivotably connected, via a pivoted joint (65), to the second arm (62A) of the fourth pair (62) of crossed arms of the second cross-brace (31).

Separation of the first (26) and second (27) arches results in an expansion of the first cross-brace (29) along the direction of increasing arch separation. Such separation causes the ends of the first cross-brace (29) slidably coupled to arches via a shuttle unit (45,45B) to upwardly slide, along associated slot formations (44,46 etc) towards those parts of the first cross-brace coupled to an arch via a fixed hinge (52,57 etc), whilst simultaneously pairs of collapsible top braces (35, 36) unfold about a mid-hinge assembly (60) as the hinges (58,59) via which the terminal ends of each top of brace is pivotably attached (to and between) adjacent beam assemblies, are separated.

Separation of the third (28) and second (27) arches results in an expansion of the second cross-brace (31) along the direction of increasing arch separation. Such separation causes the ends of the second cross-brace slidably coupled to arches via a shuttle unit (45B,45C) to upwardly slide, along associated slot formations (44,46 etc) towards those parts of the second cross-brace coupled to an arch via a fixed hinge (63, 68 etc), whilst simultaneously pairs of collapsible top braces (33, 34) unfold about a mid-hinge assembly (71) as the hinges (69,70) via which the terminal ends of each top of brace is pivotably attached (to and between) adjacent beam assemblies, are separated.

Figure 4:
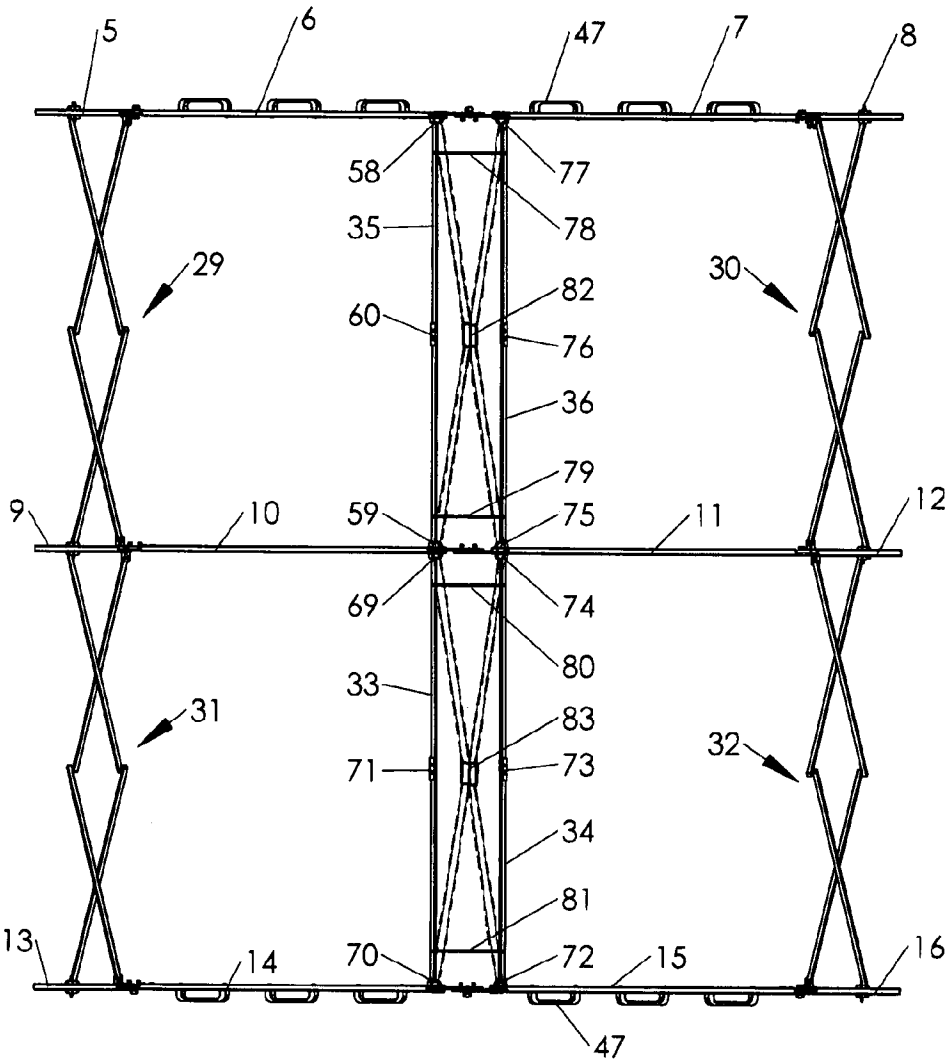
FIG. 4 illustrates the erected tent frame of FIG. 1 in top view.
Figure 4A:
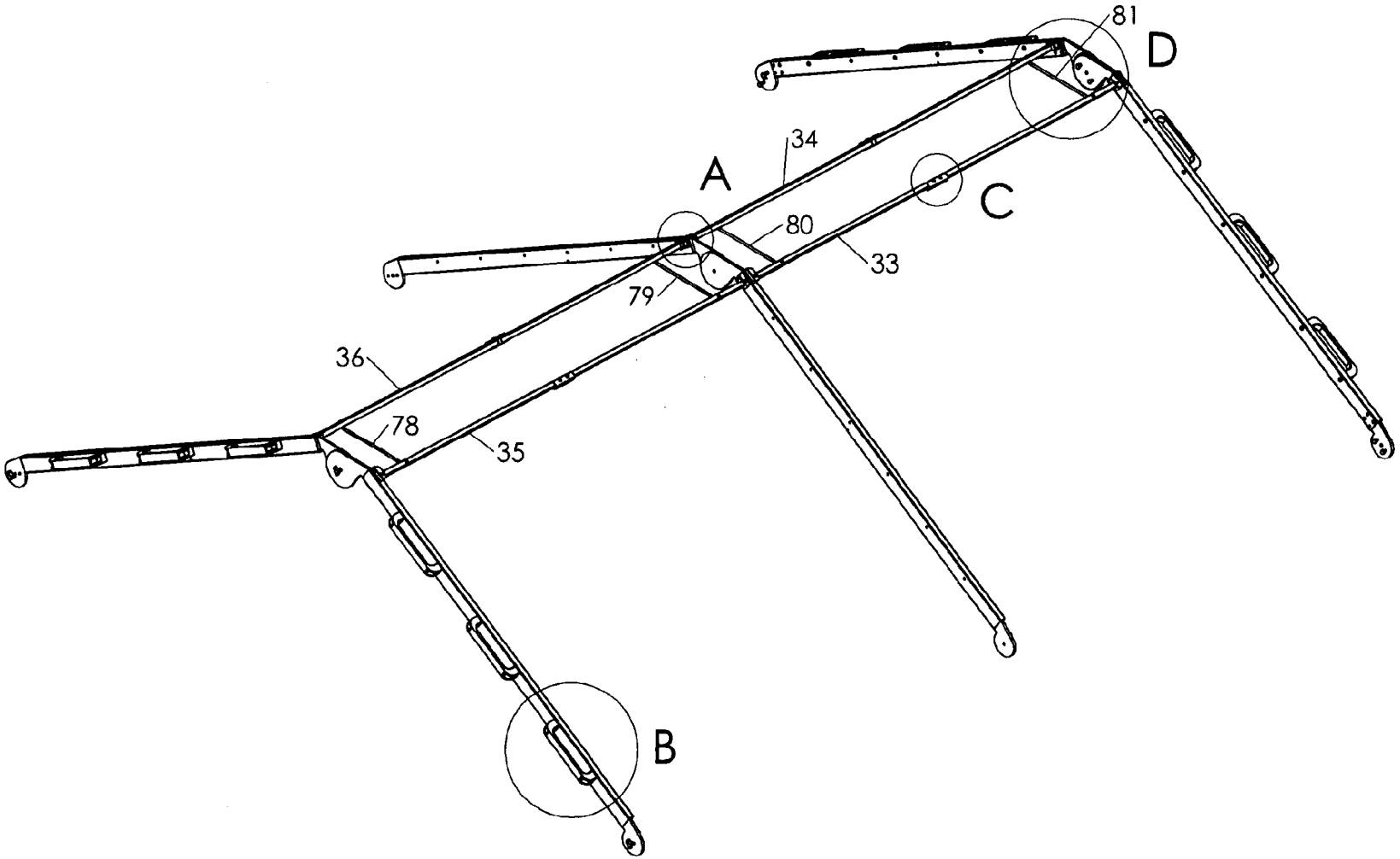
FIGS. 4A, 4B, 4C, 4D and 4E illustrate detailed magnified perspective views of parts of the erected tent frame of FIG. 1.
Figure 4B:
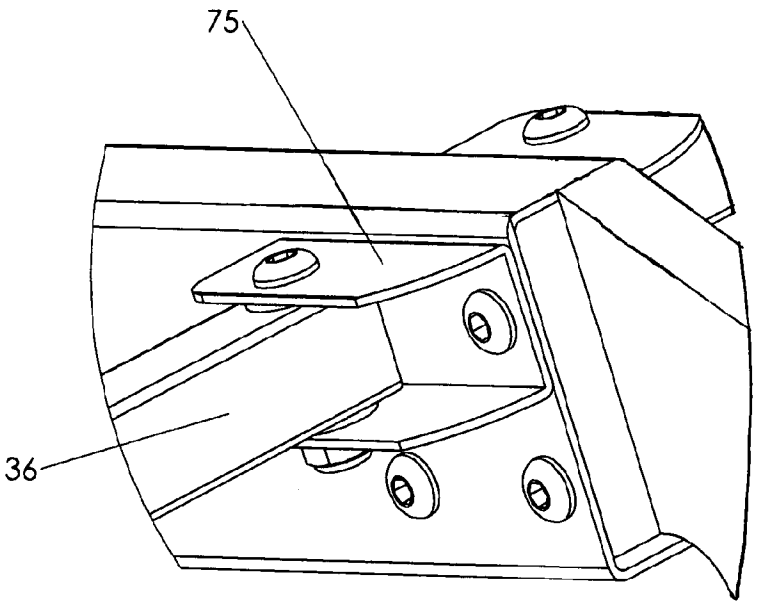

FIG. 4 illustrates a top view of the collapsible frame illustrated in FIGS. 1 to 3.

The first pair of collapsible braces (33,34) are joined to each other by a first intermediate tensioning member (80) extending between them and also by a second intermediate tensioning member (81) extending between them. Each intermediate tensioning member is dimensioned and arranged to urge together the two collapsible top braces to which they are attached. The result is that a pair of collapsible top-braces otherwise in a substantially parallel relative state when the frame assembly is fully expanded, are urged into a state of contact midway, at the intermediate fold pivot thereof (71,73) midway along each top brace and, in that orientation, to continue to urge the two opposing fold pivots. This positioning is illustrated in FIG. 4 by dashed lines representing all four collapsible top braces (33,34,35 and 36) in the quiescent state.

This arrangement permits increased structural stability in the collapsible top braces when the frame is in an expanded state and a greater degree of support for tent material or sheeting replaced over the frame when in use as a tent frame.

FIGS. 4A, 4B, 4C, 4D and 4E each show, in isolation, more detailed views of aspects of the two pairs of collapsible top braces of the frame of FIGS. 1 to 4. 54B illustrates a magnified view of a hinge (75) via which a collapsible top brace (36) is attached to a beam assembly. This is representative of each of the hinges via which collapsible top braces are attached to beam assemblies in the frame.

Figure 4C:
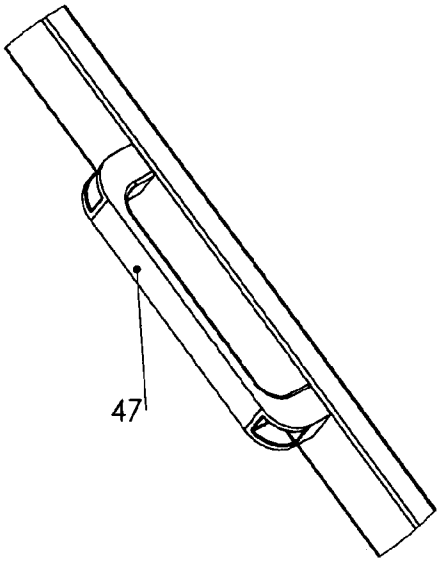

FIG. 4C illustrates a detailed view of a handle (47) attached to the outwardly presented surface of terminal beam assemblies of the frame.

Figure 4D:
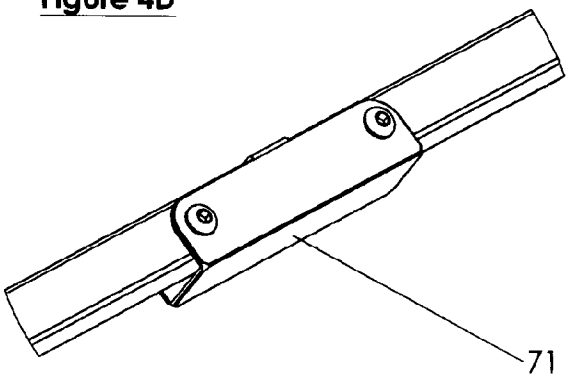

FIG. 4D illustrates a magnified view of a fold pivot (71) midway along the length of a top brace permitting the top brace to fold in half. The fold pivot independently articulates an end of each of the two top brace halves separately and at locations spaced sufficiently to permit each such half to fold together in a parallel and closed (e.g. touching along their lengths) state when the top brace in question is collapsed. Each such collapsible top brace possesses such a fold pivot midway along its length (60,73,76). The fold pivot is arranged to allow the top brace halves of a respective top brace of the pair of top braces, to fold about the fold pivot in a direction outwardly and away from the other of the pair of top braces towards the closed state in which the top brace halves are disposed in parallel adjacency to the beams to which they are pivotably joined.

Figure 4E:
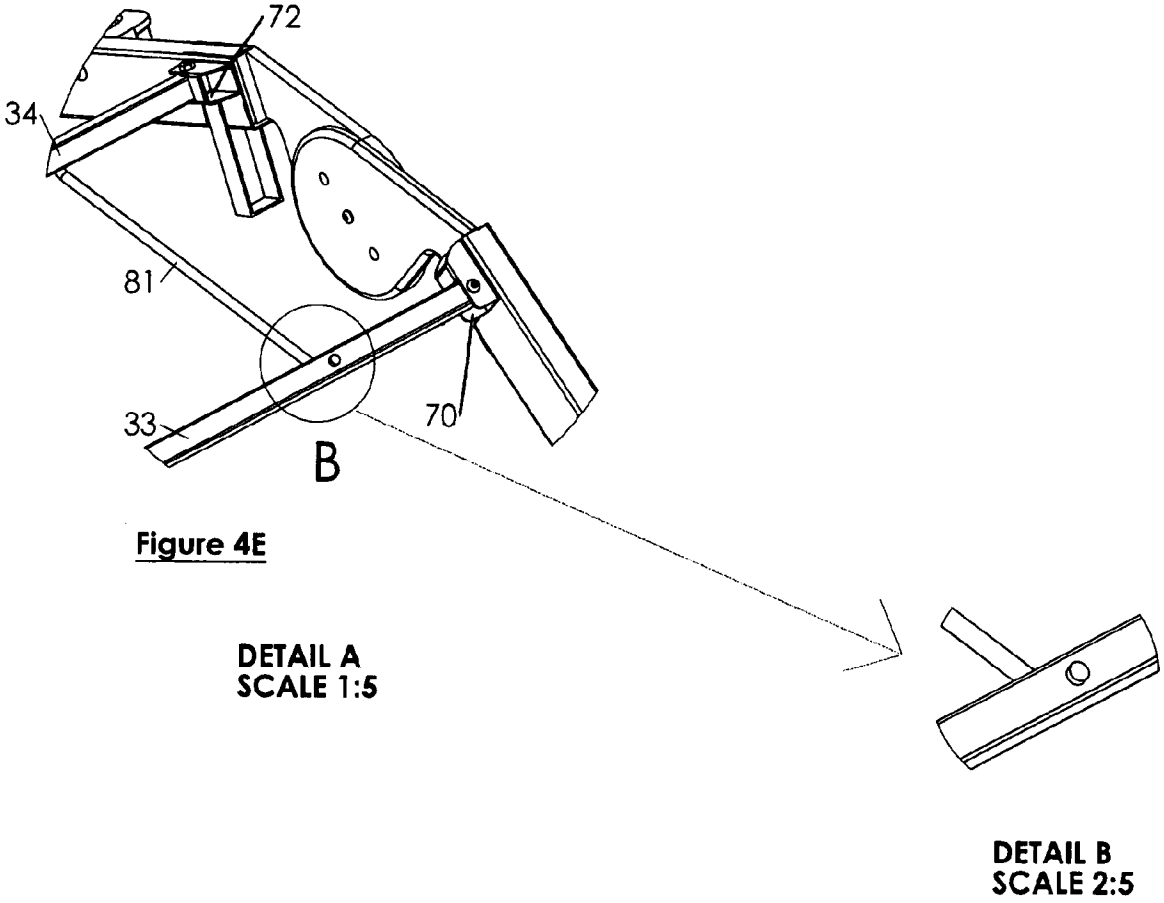

FIG. 4E shows a magnified view of a tensioning member (81) disposed in-between and connected to, each of the first and second collapsible top braces of the frame. The tensioning member (81) comprises a length of bungee, the ends of which are fixed to respective top braces of the pair of top braces via holes formed therethrough. FIG. 4E illustrates the bungee in a state of tension.

Figure 5:
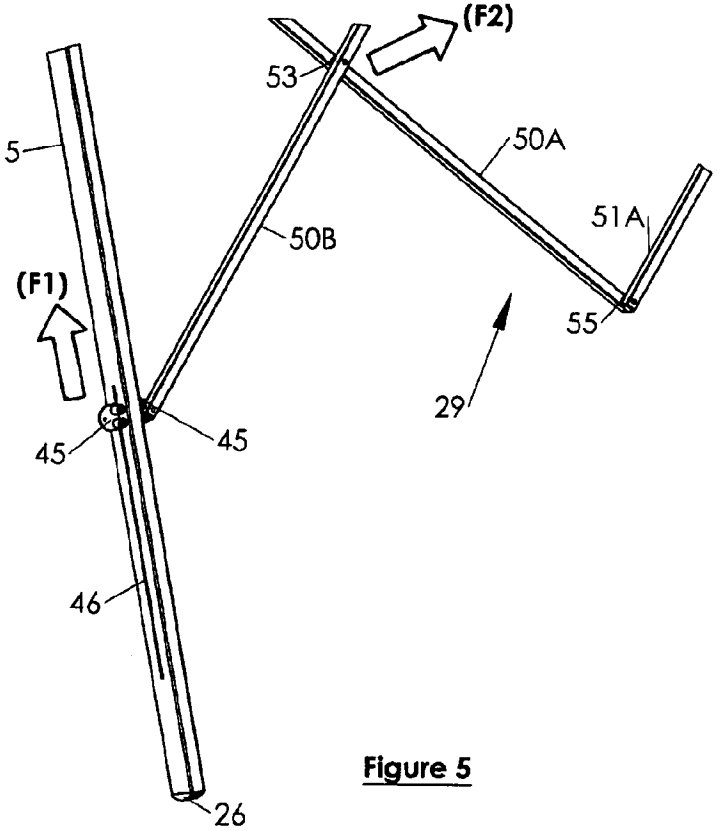
FIG. 5 illustrates parts of the erected tent frame of FIG. 1 in magnified view.

FIG. 5 illustrates a magnified view of a side beam member (5) of the first arch (26) of the erected frame assembly schematically illustrated by an arrow (F1) is a direction of movement or of force supplied by the tensioning means (not shown) associated with each respective shuttle member (45) of at least the terminal arches of the assembled frame (2,4) and optionally also associated with each shuttle unit (45B) of the second/intermediate arch (3).

Motion of a shuttle unit (45) upwardly along a slot formation (6) in the direction indicated (F1) urges a corresponding motion (F2) of the pivot joint (53) via which a cross arm (50B) of the cross brace (29) attached to the shuttle unit is pivotably connected to another cross arm thereof (50A) pivotably connected to the side beam member (5) at a fixed location thereon. In this way, a shuttle unit (45) may be drawn or urged upwardly along a slot formation within which it is housed, to induce expansion of a cross-brace assembly (29).

Figure 6:
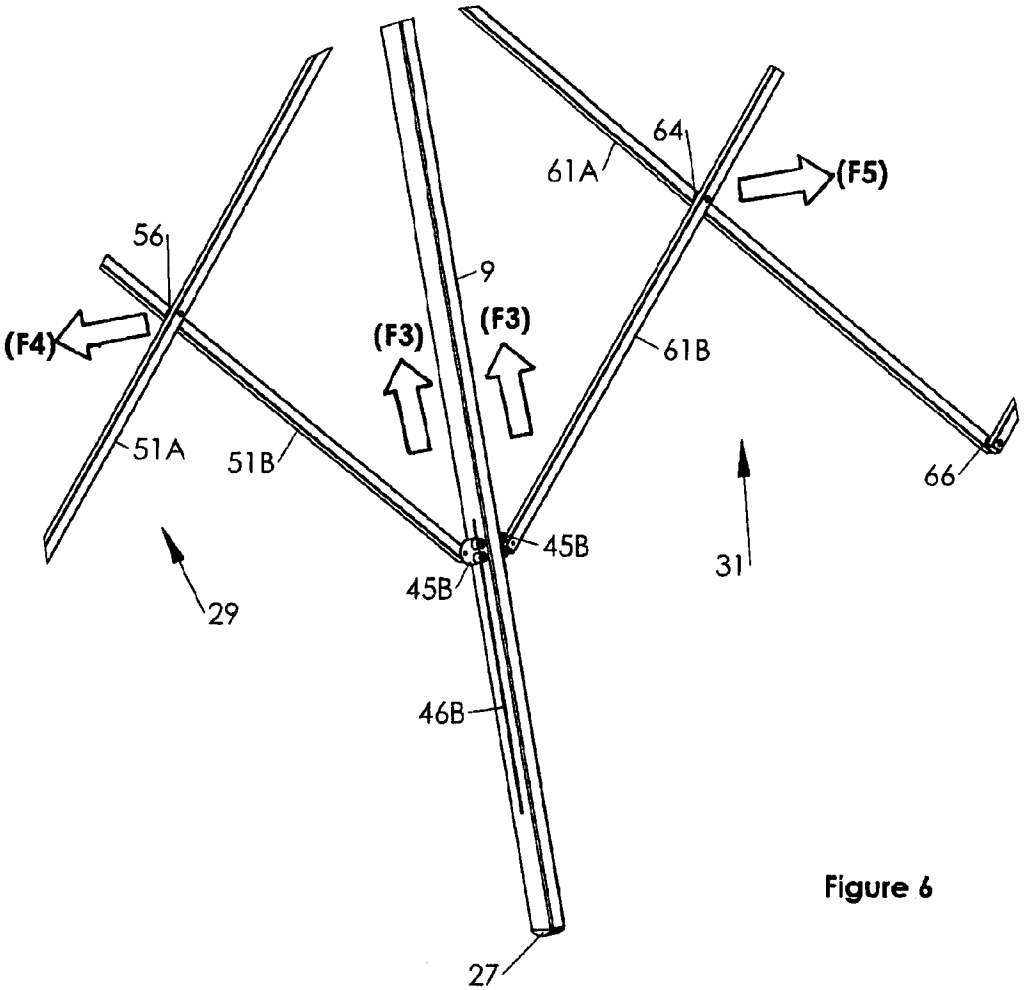
FIG. 6 illustrates parts of the erected tent frame of FIG. 1 in magnified view.

FIG. 6 illustrates a magnified view of a side beam member (9) of the second arch (3) and indicates how an upward motion or urging (F3) of a shuttle unit (46B) of the second arch induces an expanding/opening motion or urging (F4 and F5) in each of the cross-brace assemblies (29, 31) coupled to the shuttle unit in common. Reversal of the direction of the motion (F3) of the shuttle unit accordingly induces a closing/collapsing motion in the cross-brace assemblies coupled to it.

Figure 7:
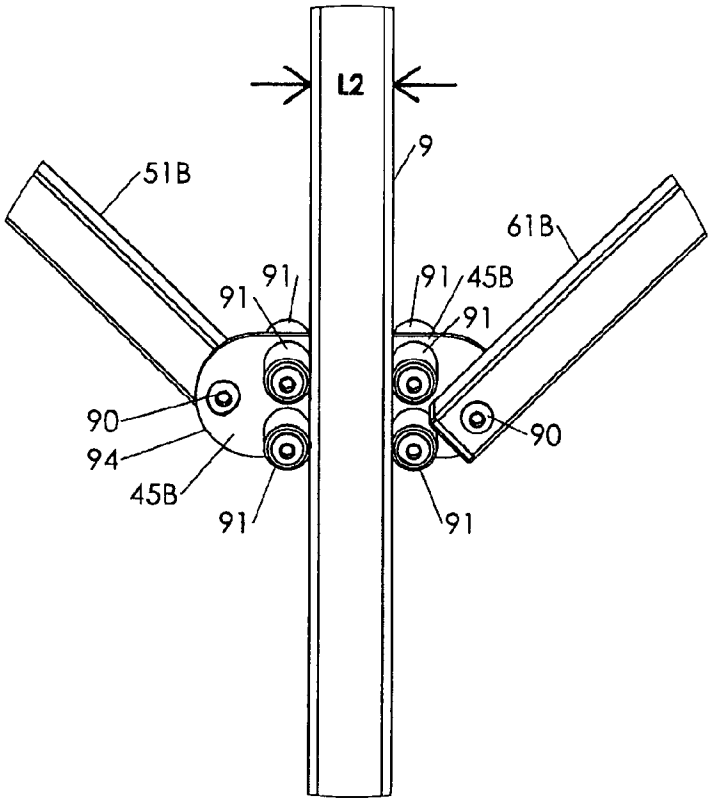
FIG. 7 illustrates parts of the erected tent frame of FIG. 1 in magnified view.
Figure 8:
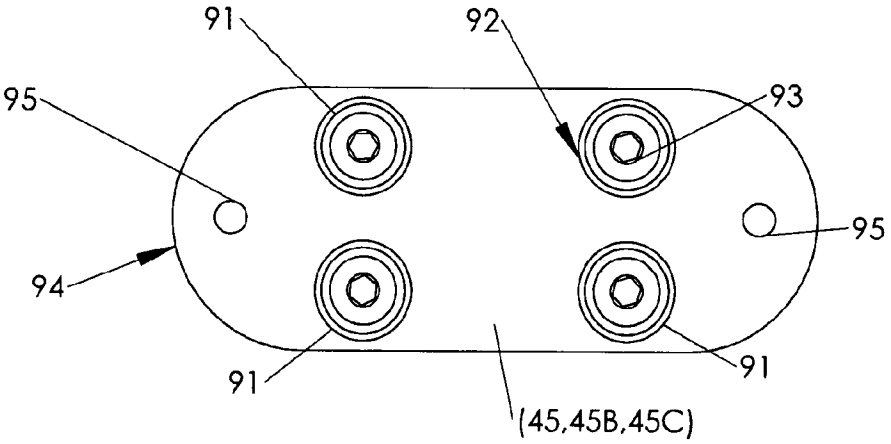
FIGS. 8, 9, 10 and 11 illustrate different perspectives of a shuttle member of the erected tent frame of FIG. 1 in magnified view.
Figure 9:
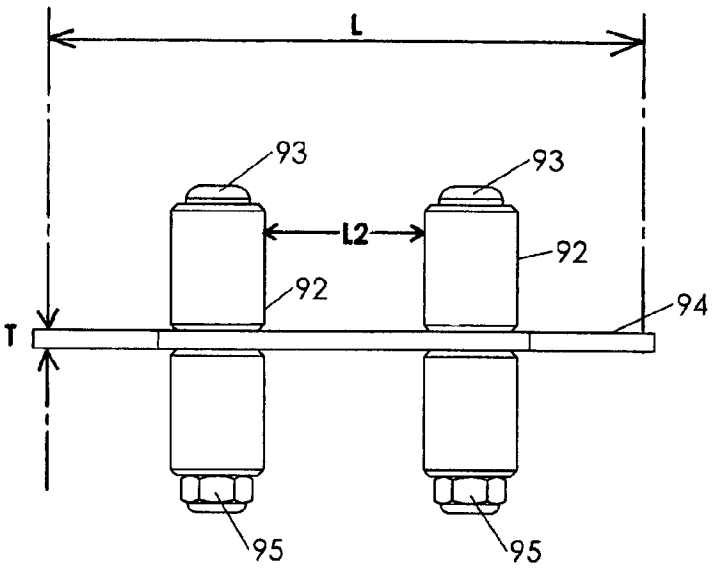
Figure 10:
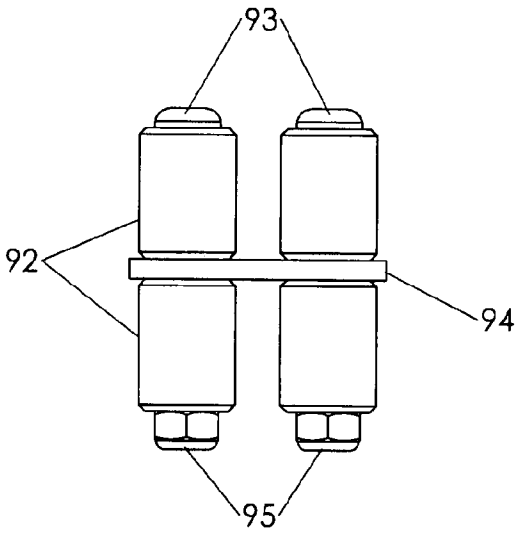
Figure 11:
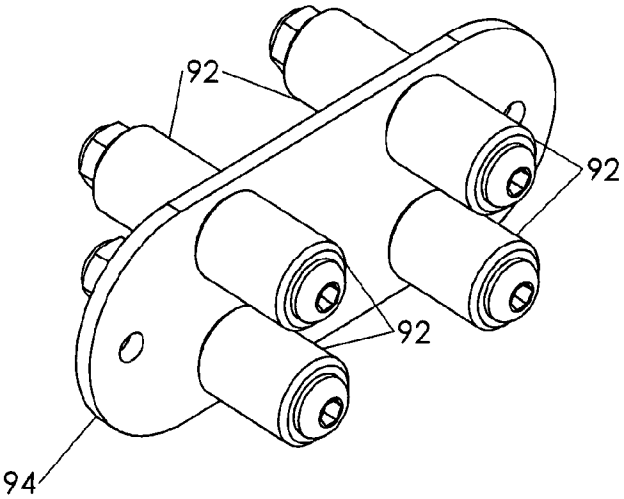

FIG. 7 illustrates a magnified view of a side beam member (9) of the second arch (3), and the shuttle unit (45B) housed within it. FIGS. 8, 9, 10 and 11 illustrate a shuttle unit in isolation and from a number of different perspectives. All shuttle units of the frame are substantially identical. The shuttle unit comprises an elongate plate (94) of thickness (T) sufficient to allow it to pass through and along the slot formation (46, 46B, 46C) formed within a given side beam member of the frame assembly. The plate has a length (L) along its long axis sufficient to allow terminal ends of the elongate plate to project simultaneously beyond opposite sides of the beam member (9) through when it extends, via the slot formation (FIG. 7).

Two pairs of separate plate-mounted roller bearings (91) are disposed in parallel array on each side/face of the plate.

Each roller bearing of a pair is separated from an opposing roller bearing of the other pair on that side of the plate by a spacing (L2) sufficient to accommodate the width of the side beam member. The spacing (L2) is also dimensioned and to permit roller bearings of opposed roller bearing pairs to simultaneously roll across the surface parts of the side beam member adjacent the slot formation as the shuttle unit slides therealong.

Each roller bearing (91) on one side of the plate is coupled to a roller bearing on the other side of the plate by a common axle about which both rollers bearings turn in use. Each roller bearing comprises a tubular roller (92) enveloping a part of the shaft of an axle (not shown) and arranged to freely rotate therearound. Each axle comprises a threaded bolt extending along the inner tubular space of a first of two tubular rollers, through an opening in the plate (not shown) and thence along the inner tubular space of a second of the two tubular rollers. The first tubular roller is retained between a head (93) of the bolt and a face of the plate. The second tubular roller is retained between a nut (95) attached to the threaded end of the bolt, and the other face of the plate.

Attachment through-openings (95) are provided adjacent each of the two terminal ends of the plate (94). A through-opening nearmost a cross-brace assembly accepts a pivot bolt (90) via which the shuttle unit pivotably couples to that cross-brace assembly. When the shuttle unit is in use in an intermediate arch or beam assembly (27), each through-opening is so coupled to a respective cross-brace assembly (FIG. 7). When the shuttle unit is employed in a terminal arch or beam assembly, (item 45, FIG. 5), a through opening may be employed to couple the shuttle unit to a tensioning means such as rigging or tensioning cables, straps of the like as described above.

Figure 12:
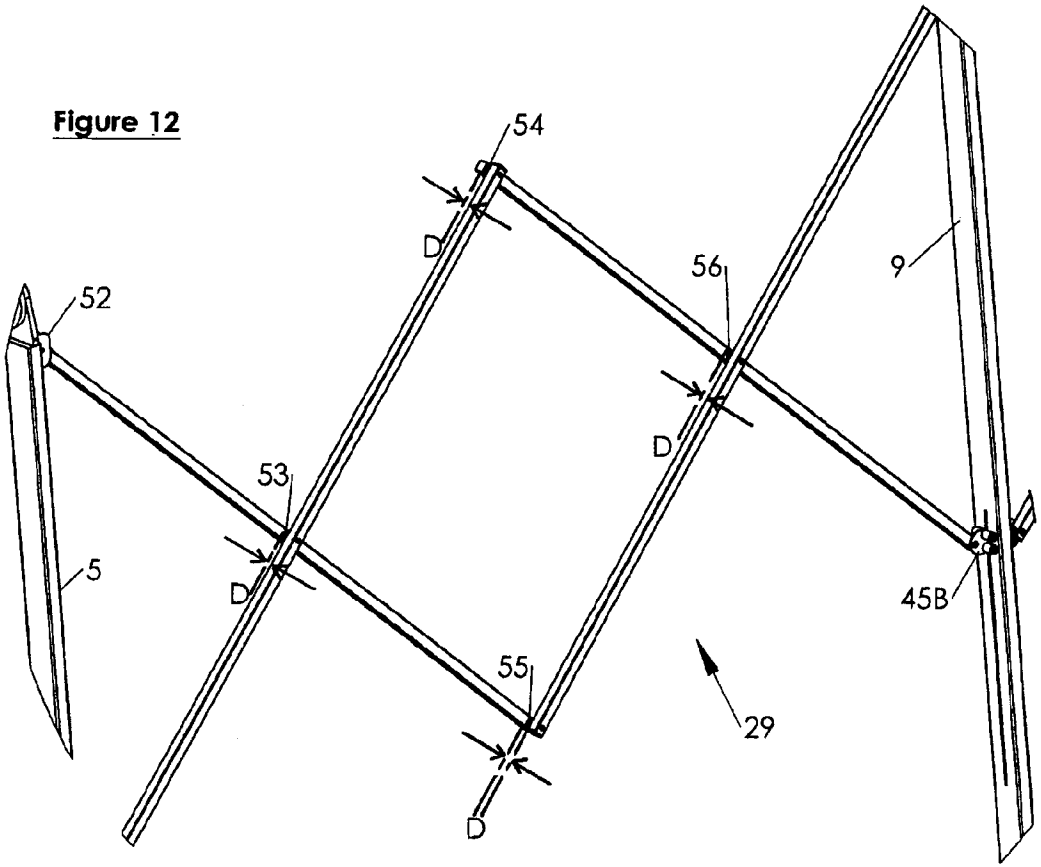
FIG. 12 illustrates the part of a cross-brace assembly of the erected tent frame of FIG. 1 in magnified view.
Figure 13:
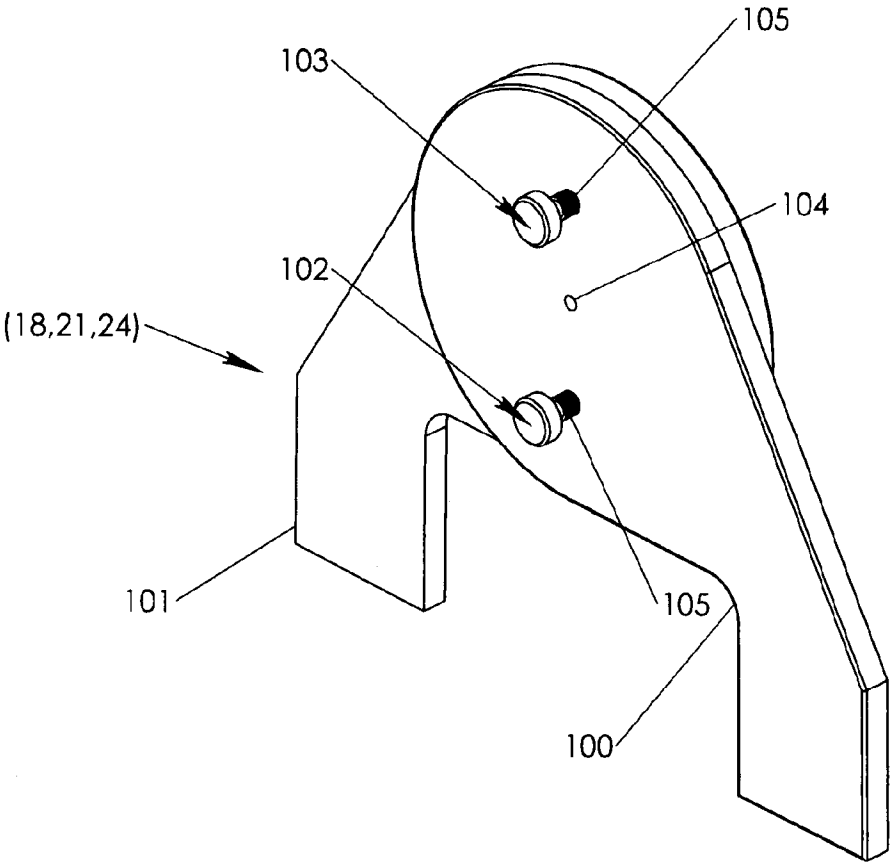
Figure 14:
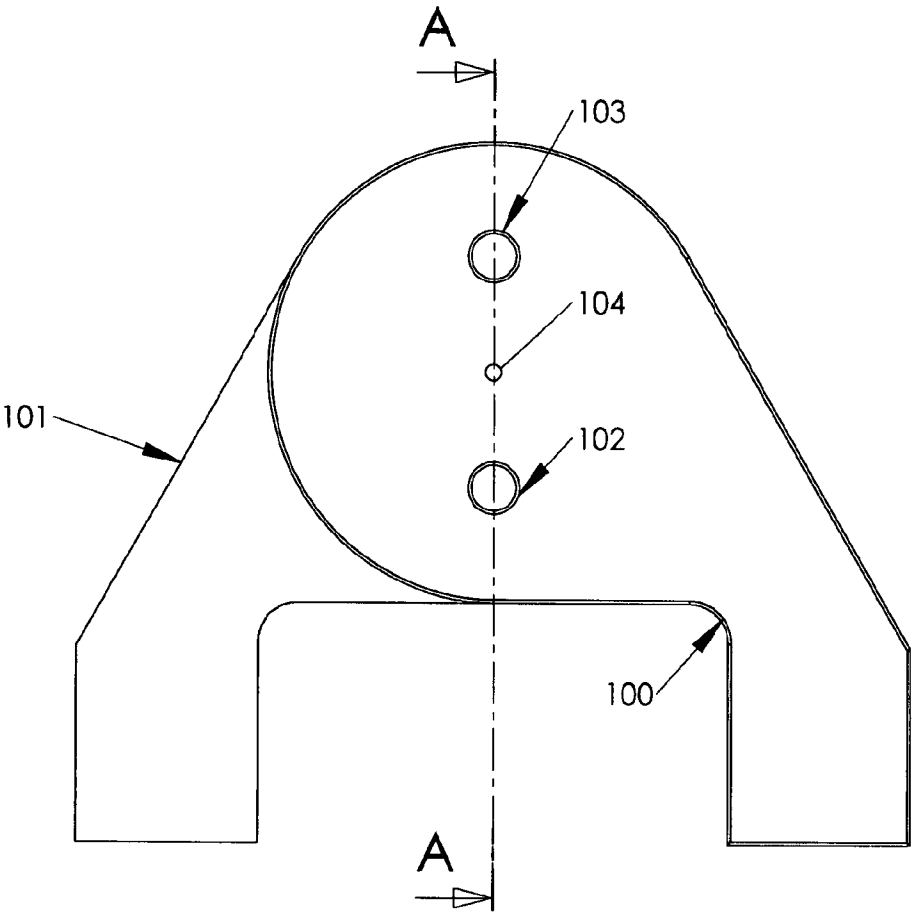

FIG. 12 illustrates a magnified view of parts of a cross-brace assembly (29) in an expanded state. Crossed arms of each of the two pairs of crossed arms of the cross-frame assembly are pivotably joined by pivot joints (53, 54, 55, 56) which separate the crossed arms so joined by a common separation (D). This separation may be reduced, in other embodiments by use of one or more washers to space the arms where they cross and provide a bearing surface.

FIGS. 13, 14 15 and 16 collectively illustrate views of a top hinge unit (18, 21, 24) comprising a pair of opposed plates (100, 101) joined at a common axle (104) about which a face of one plate of the pair is slidingly rotatable over a face of the other plate of the pair in parallel opposition thereto. In use, a beam member of a beam assembly is connected to one plate of the pair and another beam member of the beam assembly is connected to the other plate of the pair.

Figure 17:
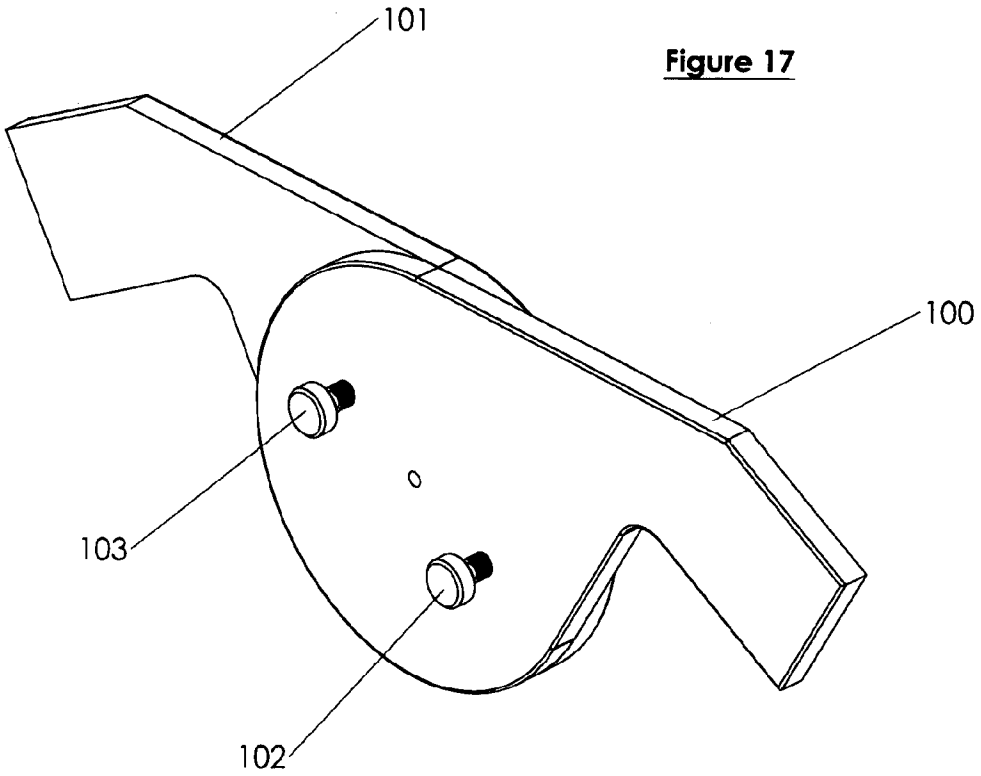
Figure 18:
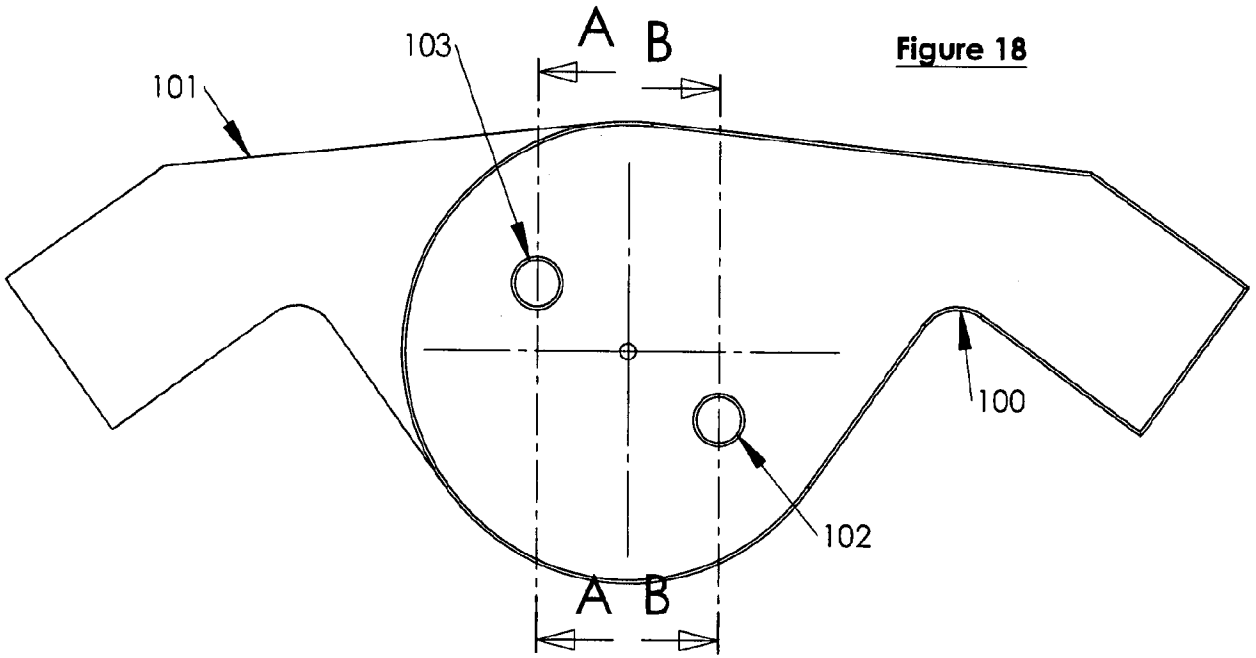
Figure 19:
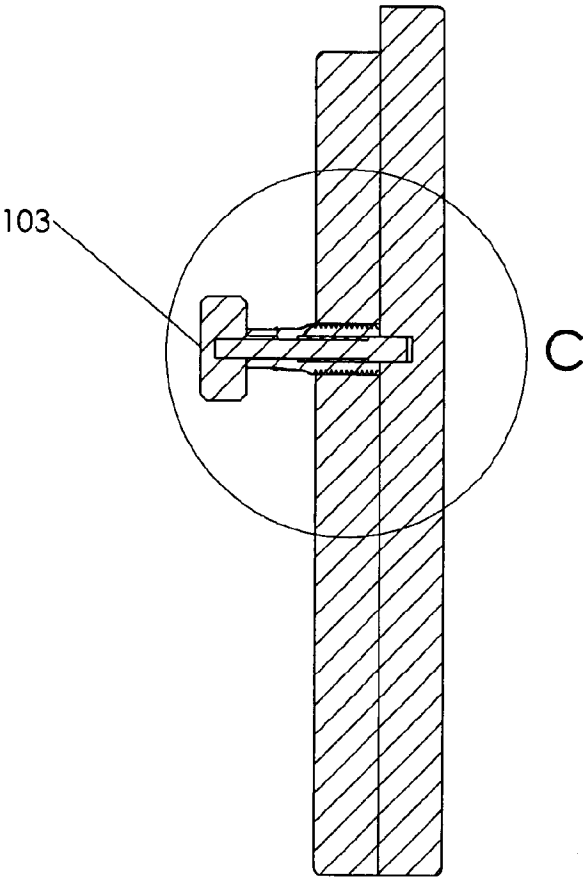
Figure 20:
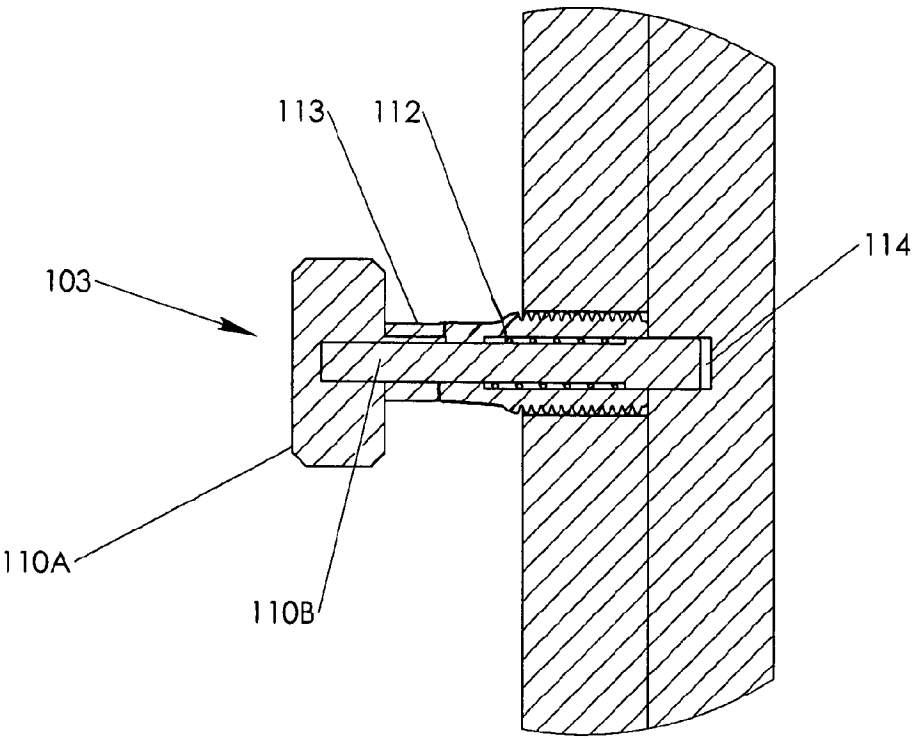
Figure 21:
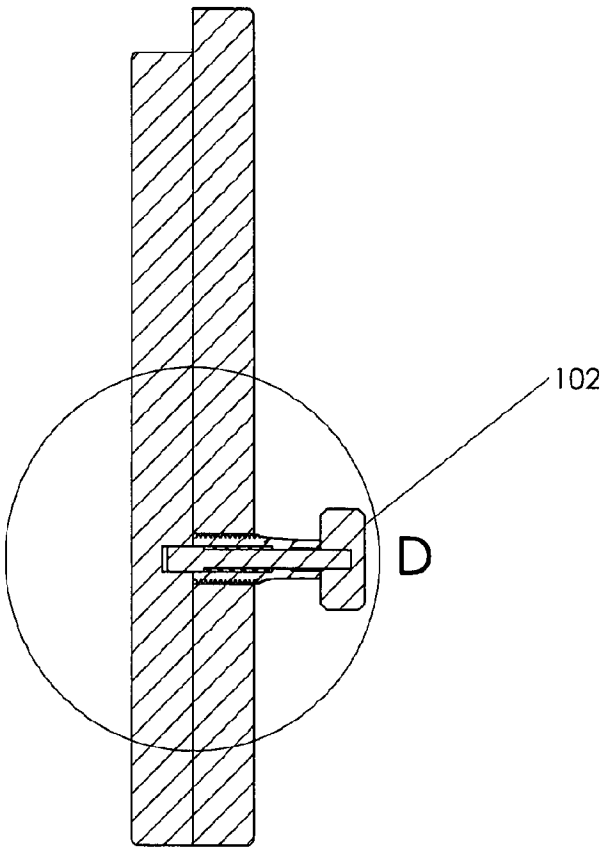
Figure 22:
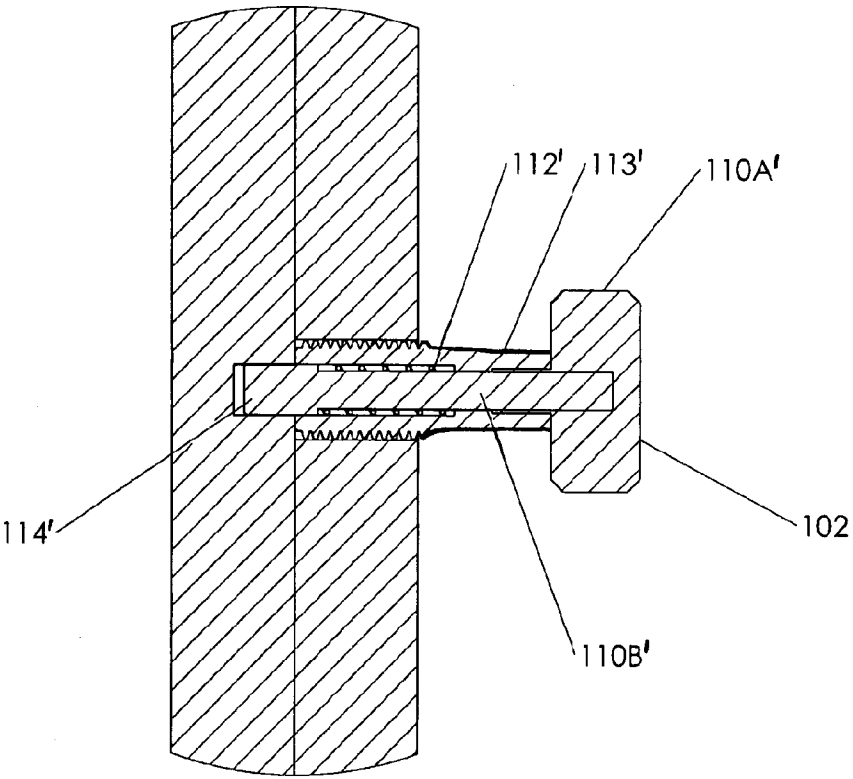

One plate (100) of the pair may possess two through-openings (105) extending from the outwardly presented side of the plate to the opposed face thereof, and the other plate (101) of the pair has a pair of orifices (114 of FIG. 20, 114' of FIG. 22) disposed in the opposing face thereof to be positionable in register with the through-opening by rotation of one or both plates about their common axle to the position shown on FIG. 17. The through-openings and corresponding orifices are disposed in a respective plate at opposite sides of the common axle.

The top hinge includes two pins (102, 103) each insertable into a respective through-opening (105) and dimensioned to extend along the through-opening and into an orifice (114 of FIG. 20, 114' of FIG. 22) of the opposed face of the other plate (101) when the through-openings and orifices are concurrently in register.

Each pin has a moveable shaft part (110B, 110B') moveable relative to the body of the pin along a long axis thereof along an associated through-opening (105) and into the associated orifice (114, 114') when in register.

The body of each pin comprises a sleeve part (113, 113') through which an axial bore extends within which the shaft part of the pin is slidingly moveable. The shaft and sleeve parts may be structured and arranged to retain the shaft part within the sleeve part.

Figure 15:
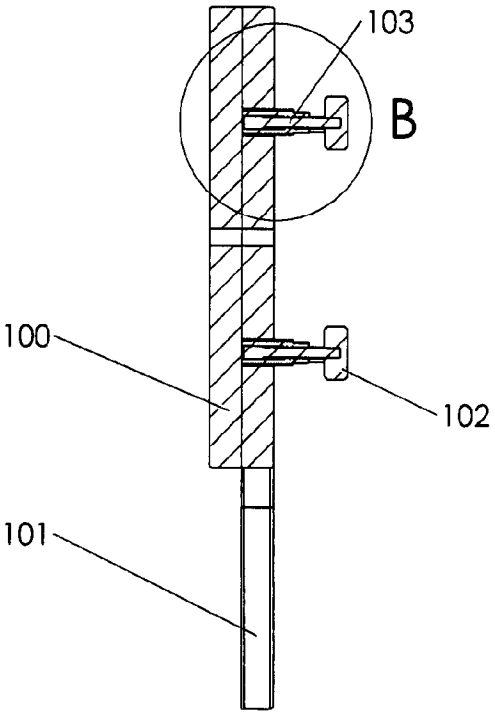
Figure 16:
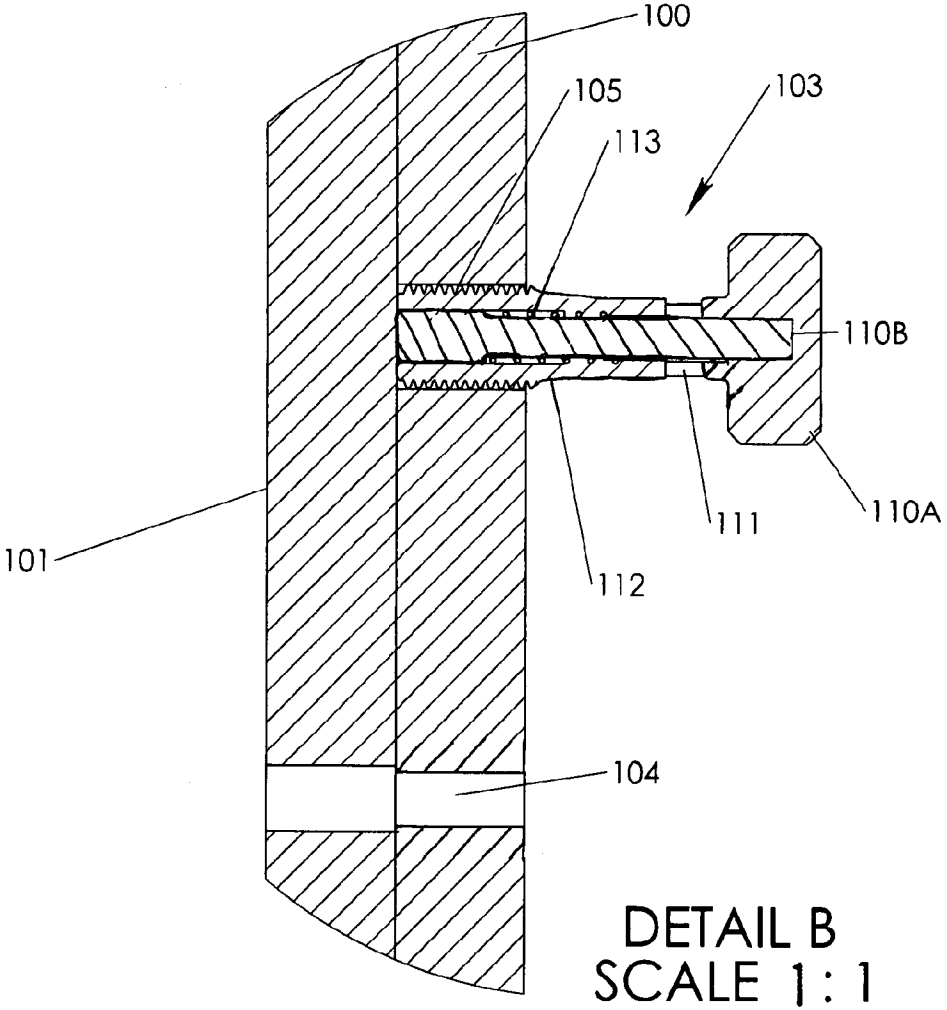

The moveable shaft part of each pin is moveable along the bore between a retracted state (FIG. 16) in which the shaft part does not extend from the sleeve part via an end of the bore, and a projecting state (FIGS. 20, 22, 24 and 25) in which the shaft part projects from the sleeve part via an end of the bore. In the projecting state, the shaft part is dimensioned to project from the sleeve part into an orifice of a plate of the top hinge (FIGS. 20, 22) when in register with a through-opening in an opposing said plate within which the sleeve part is housed but does not project (e.g. does not project into the through-opening when in register). When a through-opening and orifice are not in register, the shaft portion of an associated pin is arranged to adopt the retracted state (FIGS. 15 and 16). The opposing faces of the plates (100, 101) of the top hinge are disposed such that the opposing face of the plate (101) containing the orifice covers the end of the through-opening (105) via which the shaft part is moveable to project into the orifice when in register therewith. This covering maintains the shaft in one plate (100) in the retracted state until in register with the orifice (114, 114') in the opposing plate (101). The plates of the top hinge may thus be slidingly rotatable about their common axle (104) when the shaft of the pins (102, 103) are retracted, and locked in relative position by the pins when brought into register.

The top hinge achieves a maximally splayed/opened state of beam members joined thereby when the through-opening (105) and orifice (114, 114') of respective opposed plate faces are in register.

The moveable shaft part (110B, 110B') of a pin includes a hand-operable head part (110A, 110A') turnable by hand to turn the shaft part about its axis within the bore of the sleeve part. Each sleeve part has an end part nearmost the head part of the shaft part of the pin which is shaped (111) to engage with the head part (110A, 110A', 116) when the shaft part is in a projecting state (FIG. 23, FIG. 24), and to disengage from the head part when the shaft part is in a retracted state (FIG. 16).

The head part of the shaft has a projecting part (116) disposed to be reversibly moveable, by movement of the head part relative to the sleeve part, from a first position in which it engages a recess part (111) of the sleeve part when the shaft part is in the projecting state (as shown in FIGS. 23 and 24), to a second position (FIG. 16) in which it is retracted from the recessed part (111) and engaged with parts (111B) of the sleeve part adjacent the recessed part thereof to retain the shaft part in the retracted state. A pull and turn action upon the head of the shaft part may effect this movement from the projecting state to a maintained state of retraction.

Furthermore, in the engaged state (between projecting part 116 and recess part 111) the moveable shaft of a pin is turnable only if the sleeve part is so turnable, while in the disengaged state the shaft part is turnable independently of the sleeve part.

The head part and sleeve part of each pin possess reciprocally-shaped opposable parts (111, 116; FIG. 24) dimensioned to intermesh when engaged such that the shaft part becomes turnable about its axis by turning the head part. This enables a pin as a whole to be turned in unison about its axis when the shaft part is projecting into an orifice of a plate from a through-opening of an opposed plate containing the sleeve part of the pin. As such, the sleeve part of each pin is externally threaded with a thread (115, FIG. 23) arranged to engage a reciprocal threading disposed on the walls of the bore of the through-opening containing it. This enables the pin, with projecting shaft part, to be screwed down along the bore of the through-opening to urge until stopped by the opposing plate containing the orifice in register.

The moveable shaft part of each pin is spring-loaded within the sleeve part so as to be urged in to a quiescent state of projection therefrom. The bore of the sleeve part is separated by a spring (112, 112'; FIGS. 16, 20, 22 and 23) from an opposed abutment surface of the moveable shaft part such that retraction of the shaft into the bore compresses the spring.

Figure 25:
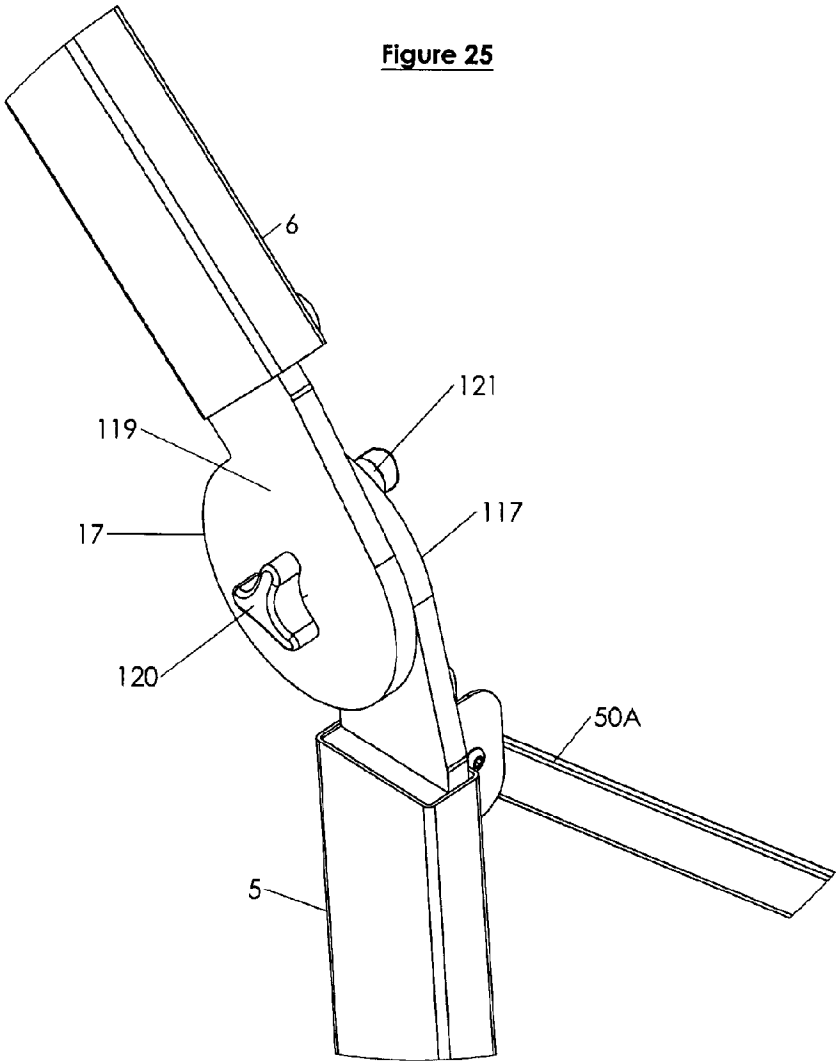
Figure 26:
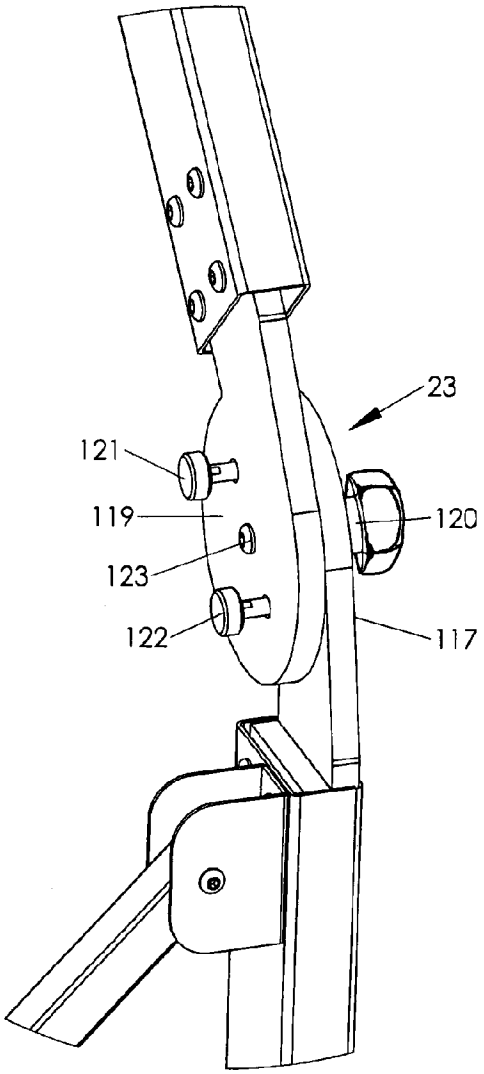

FIGS. 25, 26 and 27 illustrate views of side hinges (17, 23) structured and operable as described above with reference to the top hinge of FIGS. 13 to 22. FIG. 27 is an exploded view showing components in separation and including a pair of spring-loaded locking pins (121, 122) as described above, and opposed plates (117, 119) rotatable about a common axle (130) of the type described above possessing through-holes (134, 135) and associated orifices (133, 132) positionable in register to accommodate locking pins parts in common to lock the side hinge in an open state.

Each of the side hinges possesses this structure, whereas only the top and side hinges of terminal arches (26, 28) possess a tightening nut (120) turnable against a nut (123) about the common axle (130) of the side hinge to force the opposed plates together (e.g. into a frictional contact). This enables a strengthening of the frame. FIG. 28 illustrates an exploded view of a top hinge with a tightening nut.

FIG. 29 illustrates a top hinge in which a face of one plate (119) thereof is marked with the word "FRAME" at a location which is brought into adjacency to a part of the second plate marked "closed" only when the top hinge is closed, and which is brought into adjacency to a part of the second plate marked "open" only when the top hinge is fully opened. The tightening nut (120) may be tightened in either position to further secure the top hinge in the open of closed state.

FIG. 30 illustrates a tent (130) comprising the tent frame described above over which a tent covering (145) is draped and attached. Door drapes (135) are located at a first arch (26), side-wall drapes (140) are located over side beam members and cross-beam assemblies (29, 31) which provide strength at the side walls (140) of the tent.

Slot-openings (not shown), according to any embodiment of the invention, may be provided in the tent covering (145) at locations which coincide, when the tent covering is applied to the erected tent frame (1), with the locations of handles (47) being such that handles at opposite ends of the frame may be slotted through the slot-openings to assist in securing the tent covering to the tent frame. The tent covering is preferably of a length selected such that slotting the frame handles through slot openings in this way applies a tension to the covering along the long axis of the frame thereby to apply a compressive force to the frame which is resisted by the frame. This opposition of forces assists in "holding" the tent frame more firmly in an upright or erected state.

In alternative embodiments of the invention, a side hinge (17, 20, 23, 19, 22, 25) and/or a top hinge (18, 21, 24) may be structured and arranged as is illustrated in FIGS. 31A to 31C and 32A to 32C, or 33A to 33C and 34A to 34C respectively.

FIGS. 31A, 31B and 31C show different views of one part of a top hinge unit possessing a plate (150) across a face of which a pair of circularly arcuate channels (154, 155) extend in diametrical opposition about an aperture (151) arranged to receive the axle of the hinge unit.

FIGS. 32A, 32B and 32C show different views of a second part of the top hinge of which the parts of FIGS. 31A to 31C form a part. The second part includes a plate (156) with two lugs (157B and 157A) extending therefrom in a direction parallel to the axis of the common axle (not shown) about which the first and second hinge parts are adapted to rotate when opposed in use. The two lugs are disposed on the face of the second plate (156) in diametrical opposition about an aperture (152) arranged to receive the axle of the hinge unit so as to extend into a respective one of the two arcuate channels (154, 155) formed across the opposing face of the first plate of the pair of plates in use. A first lug (157A) is slideable along a first arcuate channel (155) from a first end (155A) of the channel to a second end (155B) thereof by action of relative rotation of the opposed plates. The first lug abuts the first end of the channel when the top hinge unit is in a fully splayed/opened state, and the lug abuts the second end of the channel when the top hinge unit is in the closed state.

A second lug 157B is slideable along the second arcuate channel (154) from a first end (154A) of the channel to a second end (154B) thereof by action of relative rotation of the opposed plates. The second lug abuts the first end of the channel when the top hinge unit is in a fully splayed/opened state, and the lug abuts the second end of the channel when the top hinge unit is in the closed state.

FIGS. 33A, 33B and 33C show different views of one part of a side hinge unit possessing a plate (158) across a face of which a pair of circularly arcuate channels (160, 161) extend in diametrical opposition about an aperture (159) arranged to receive the axle of the hinge unit.

FIGS. 34A, 34B and 34C show different views of a second part of the side hinge of which the parts of FIGS. 33A to 33C form a part. The second part includes a plate (162) with two lugs (164B and 164A) extending therefrom in a direction parallel to the axis of the common axle (not shown) about which the first and second hinge parts are adapted to rotate when opposed in use. The two lugs are disposed on the face of the second plate (162) in diametrical opposition about an aperture (163) arranged to receive the axle of the hinge unit so as to extend into a respective one of the two arcuate channels (160, 161) formed across the opposing face of the first plate of the pair of plates in use. A first lug 164A is slideable along a first arcuate channel (160) from a first end (160A) of the channel to a second end (160B) thereof by action of relative rotation of the opposed plates. The first lug abuts the second end of the channel when the side hinge unit is in a fully splayed/opened state, and the lug abuts the second end of the channel when the side hinge unit is in the closed state.

A second lug 164B is slideable along the second arcuate channel (161) from a first end (161A) of the channel to a second end (161B) thereof by action of relative rotation of the opposed plates. The second lug abuts the first end of the channel when the top hinge unit is in a fully splayed/opened state, and the lug abuts the second end of the channel when the top hinge unit is in the closed state.

One or more pins such as illustrated in FIGS. 23 and 24 may be incorporated with either of both of the top hinge and side hinge of these alternative embodiments, wherein on of the two opposed plates of a hinge has a through-opening housing the sleeve part and retractably extendible shaft part of the pin, while the other of the two opposed plates possesses an orifice disposed to be brought into register with the through-opening (e.g. when the hinge is in the fully splayed state) to admit a projecting end of the shaft part of the pin therein.

Referring to FIGS. 35, 36 and 37, FIG. 35 illustrates an exploded view of a lockable hinge shown in FIG. 36 in assembled (unexploded) form. The hinge includes a pair of opposed hinge members (204, 207) including plate portions connected at a common axle (202) about which a face of the plate portion of the first hinge member (204) of the pair is by operation of the hinge slidingly rotatable over a face (not shown) of the plate portion of the second hinge member (207) of the pair in parallel opposition thereto. The hinge includes a lock means operable to rotate a locking member (211) reversibly into a position which obstructs the sliding rotation of one of the pair of hinge members relative to the other of the pair hinge members from a position which does not so obstruct thereby reversibly to lock the hinge. Each of the first and second hinge members (204, 207) is so slidingly rotatable relative to the other. The hinge members are flat plates with opposing faces bounded by a circular edge (in part) and have extension parts (204*a*, 207*a*) extending away from a part of the circular edge to define an arm via which a hinge member is connectable to an article/assembly to be articulated by the hinge. An example is a frame, ladder, scaffold, platform or other structure with articulated parts which may be so articulated via the hinge. For example, a connector arm of opposing hinge members may be connected to different articulated assembly members. Screw holes or bolt holes (e.g. four in square array) may be provided in the distal end of a connector arm of a hinge member for fixing or connecting the hinge member to an assembly part to be articulated. The four illustrated hinge members, and all their spacer or guide plates (205, 206, 208, 210) discussed below are bound together at the extension parts via mutual screws or bolts or the like (not shown) passing through each if a respective one of four screw holes as shown. A first spacer plate (205) is bound between, and separates, the extension parts of the second and fourth hinge members (207, 201) and presents a concave peripheral edge in intimate opposition to the convex circular peripheral edge (slidable) of the first hinge member. A second spacer plate (208) is a guide plate (discussed below) bound between, and separates, the extension parts of the first and third hinge members (204, 209) and presents a concave peripheral edge in intimate opposition to the convex circular peripheral edge (slidable) of the second hinge member. Outer guide plates (206, 210) are bound to the extension parts of the third and fourth hinge members respectively and disposed to present a concave peripheral edge in intimate opposition to the convex circular peripheral edge (slidable) of, respectively, the third and fourth hinge members.

The lockable hinge includes a third hinge member (209) comprising a plate portion connected to the second hinge member (207) at the common axle (202) about which a face of the plate portion of the third hinge member (not shown) is by operation of the hinge slidingly rotatable over an opposing surface of the plate portion of the second hinge member (207) in parallel opposition thereto. The plate portion of the second hinge member is sandwiched between the plate portions of the first and third hinge members which are slidingly rotatable thereover in unison. The first and third hinge members are fixed together at opposing extension parts (arms 209*a*, 204*a*) thereof which extend from, and in the plane of, a respective first and third plate portions. Screws (not shown) are provided through screw holes formed in the extension parts (204*a*, 209*a*) of the first and third hinge members to fix the two members together. In this way a laminate structure is provided comprising four opposing slidable surfaces, two of which are opposite sides of the plate portion of the second hinge member (207) sandwiched between two outer plate portions of the first and third hinge members. The first and third hinge members are joined via their extension parts so as to be rotatable together in unison relative to the second hinge member.

The hinge includes a fourth hinge member (201) comprising a plate portion connected to the first hinge member (204) at said common axle about which a surface of a plate portion of the fourth hinge member is by operation of the hinge slidingly rotatable over a surface (not shown) of the first hinge member (204) in parallel opposition thereto. Accordingly, parts of the plate portion of the first hinge member are sandwiched between the plate portions of the fourth (201) and second (207) hinge members which are slidingly rotatable thereover in unison. The second and fourth hinge portions are fixed together at opposing extension parts thereof (201*a*, 207*a*) which extend from, and in the plane of, a respective second and fourth plate portions. Screws (not shown) are provided through screw holes formed in the extension parts of the second and fourth hinge members to fix the two members together.

Accordingly, a laminate structure is provided comprising six opposing slidable surfaces: one inwardly-facing surface of each of the third (209) and fourth (201) hinge members and each face (both sides) of the first (204) and second (207) hinge members. Each such sliding surface is in contact with the neighbouring opposing surface of the laminate. The locking member is attached to the first and third hinge members (204, 208) of the laminate and a locking recess is formed in the peripheral edge of the intermediate opposing plate part of the second hinge member sandwiched therebetween.

Between the inwardly-facing surface of the fourth hinge member (201) and an opposing face (not shown) of the second hinge member (207) extend two lug parts (203) each fixed within (e.g. screwed) and extending between associated opposing pairs of lug holes formed in opposing faces of the plate parts of the second and fourth hinge members. The lug parts each extend from the plate portions in question into and through a respective separate one of two separate associated circularly curved, closed slots (214, 215) formed across (and through) the surface of the plate portion of the first hinge member. Each one of the two lug parts is slideable along a respective slot from one end thereof to another end thereof by action of relative rotation of the first and fourth hinge members. The ends of the respective slits are disposed such that both lugs are slideable to abut an end of (either end) their slot in unison. The slots have the same angular extent of 120° between extreme configuration of which one is an "open" configuration and one is a "closed" configuration—each defined by the abutting of each lug at one or other end of their respective slots.

The circularly curved slots are dimensioned such that a lug part abuts an end thereof when the hinge members are positioned such that the locking member (211) is rotatable to lock the hinge as illustrated in FIG. 35.

In other configurations, the peripheral circular edge of the second hinge member prevents rotation of the cam (211) into an obstructing position. Referring to FIGS. 35, 36 and 37 the locking member (211) comprises a cam (211) with a cam shaft (212). The first hinge member and the third hinge member each include a cam shift bore (218, 224) within which is intimately received a respective part of the cam shaft on opposite sides of the cam. The cam shaft is rotatable about its axis, so received, to correspondingly rotate the cam attached to it. The cam is sandwiched between the plate portions of the first and third hinge members. An inner terminal end (212*a*) of the cam shaft is located within the cam bore of the first hinge member. An outer terminal end of the cam shaft (212*b*) protrudes from the outermost surface of the third hinge member and has attached to it a handle (212) fixed to the cam shaft by a screw (213).

The handle (212) extends generally transversely from the axis of the cam shaft to point in a first direction (e.g. generally away from, such as radially away from the axle) relative to the third hinge member (209) when the hinge is in the unlocked state and to point in a second direction (e.g. generally towards the common axle) relative to the third hinge member when the hinge is in the locked state.

The common axle extends through the first, second, third and fourth hinge members via axle through-holes (226, 222, 225, 227 respectively) in the opposing surfaces of the four hinge members. The circular peripheral edges of each of the four hinge members is circumferential to the axle through openings of that hinge member.

The locking member including the cam (211) mounted upon the rotatable cam shaft, is shown in FIGS. 38 and 38. The cam shaft is operable reversibly to rotate the cam such that an eccentric portion (211*a*) of the cam is positioned to obstruct sliding rotation of second and fourth hinge members (fixed together) relative to the first and third hinge members (fixed together). This reversibly locks the hinge. The cam has an eccentric portion (211*a*) shaped substantially as a circular segment of 110° extent circumferential to the axis of the cam shaft (212). The circular segment has a distal peripheral edge defined by a constant maximal radius centred upon the cam shaft. The cam defines elsewhere a peripheral edge (211*b*) closer to the cam shaft. The cam is dimensioned such that when no part of the distal peripheral edge obstructs sliding rotation of the hinge members, then nor does any other part of the peripheral edge of the cam.

In alternative embodiments, the locking member may be linearly slideable radially to and from the obstructing position by a action of applying a radial force to the cam shaft towards or away from the common axle. In that example, the cam shaft bores (218, 224) of the first and third hinge members may be replaced by slots which extend linearly radially towards the common axle to permit sliding movement of the cam shaft (212) therealong to accommodate sliding movement of the cam (211) to and from the obstructing position. The guide recess (219) may then also be replaced by a slot dimensioned to slidingly admit the whole cam (211). In other embodiments, the cam (211) may be replaced by a rod, bolt or block so moveable radially to/from a reciprocally shaped recess in an edge of the second hinge member positionable to accept it in the obstructing position to lock the hinge by a linear movement.

The locking member is attached to the first and third hinge members to place the cam adjacent the peripheral edge of the plate portion of the second hinge member which contains a locking recess (220). The locking recess (220) is defined where the peripheral edge of the plate portion of the second hinge member is closer to the common axle (202) than are parts of that edge immediately adjacent the locking recess i.e. the convex circular edge parts bounding the concave circular edge part defining the recess. It is shaped and adapted to admit the cam eccentric to lock the hinge.

The locking recess is positionable, by relative rotation of the hinge members, between the cam shaft and the common axle (202) of the hinge to place the locking recess in a position to admit the cam by rotation of the cam shaft.

The locking recess and those parts of the cam to be admitted into the locking recess are complementarily shaped. The cam is dimensioned and arranged to be positionable to substantially fully occupy the locking recess. The eccentric parts of the cam adapted to be positionable within the locking recess have an outermost edge which has a constant radius of curvature. The locking recess presents a concave recess edge having a radius of curvature centred on the same point of curvature (the cam shaft central axis) as the cam eccentric. The angular extent of the eccentric is 110 degrees which is greater than the angular extent of the correspondingly shaped locking recess (220).

The first hinge member includes a separable guide plate part (208) which is fixed to the extension part (204*a*) of the first hinge part. See FIGS. 43A and 43B. The guide plate part defines a concave guide edge (208*a*) positioned to oppose the peripheral edge of the plate part of the second hinge member. Opposed edges of second hinge member (207) and the guide plate (208) of the first hinge member (204) collectively define a discharge conduit (280). This extends from a discharge inlet opening (280*a*) immediately adjacent the locking recess (220) to a discharge outlet opening (280*b*) at the periphery of the hinge (see FIGS. 45 and 46). It is adapted to conduct debris urged therein from the locking recess by action of rotation of the locking member into the locking recess and towards the discharge inlet. Turning the cam eccentric into the locking recess serves to push unwanted debris out of the locking recess and into a dedicated conduit. The guide plate (208) of the first hinge member includes a rotation stop (230, FIG. 43A) arranged to prevent continued rotation in one direction of the cam beyond a position in which the cam eccentric does not obstruct relative rotation of said hinge members and in the opposite direction beyond a position in which the cam eccentric does so obstruct.

FIGS. 39A and 39B, 40A and 40B, 41A and 41B and 42A and 42B show plan and side views of the first, second, third and fourth hinge members respectively.

FIGS. 43A and 43B show a plan and a side view of the guide plate of the first hinge member.

FIGS. 40A and 40B show a plan and a side view of the guide plates (202, 203, 209) attached to hinge members by screws (not shown) via screw holes. One of each of the guide plates presents a concave edge in opposition to the peripheral curved edge of the plate portion of one of each of the hinge members.

FIG. 45 shows first and second hinge members in the locked state with the cam eccentric fully occupying the locking recess and abutting one side of the cam stop. Third and fourth hinge members are not shown and may be omitted.

FIG. 46 shows first and second hinge members in the unlocked state with the cam eccentric fully vacated from the locking recess and abutting the other side of the cam stop. The hinge is rotated into position in which the cam cannot lock the hinge. Third and fourth hinge members are not shown and may be omitted.

FIG. 47 shows first and second hinge members in the locked state with the cam eccentric fully occupying the locking recess and abutting one side of the cam stop. Third and fourth hinge members are not shown and may be omitted. The second hinge member (270) is an alternative hinge member (e.g. a replacement hinge member from a kit of parts comprising such replacements) having two spaced locking recesses (220, 220*a*) permitting different locking configurations of the hinge. The hinge member comprising the locking recess may include a plurality of separate such locking recesses spaced about that edge to permit the locking of the hinge in any one of a respective plurality of hinge configurations.

FIG. 48 shows first and second hinge members in the locked state with the cam eccentric fully occupying the locking recess and abutting one side of the cam stop. Third and fourth hinge members are not shown and may be omitted. The second hinge member (700) is an alternative hinge member (e.g. a replacement hinge member from a kit of parts comprising such replacements) having two spaced arcuate channels for guiding lug portions fixed to and extending from the opposing face (not shown) of the first hinge member (400). This embodiment comprises a first hinge member having none of the arcuate channels shown in FIG. 35.

FIG. 49 shows a transparent plan view of the hinge of FIG. 35 showing the lug portions abutted against terminal ends of respective arcuate channels (thereby preventing onward rotation of the hinge) when the locking recess is fully in register with the cam and positioned to admit the cam to lock the hinge.

FIGS. 50A to 50C, 51A to 51C, 52A to 52C and 53A to 53C show alternative embodiments of the invention excluding the aforesaid lock means and optionally excluding the third and fourth hinge members.

FIGS. 50A to 50C show different views of one part (e.g. a first hinge member) of a hinge unit possessing a plate (350) across a face of which a pair of circularly arcuate channels (354, 355) extend in diametrical opposition about an aperture (351) arranged to receive the axle of the hinge unit.

FIGS. 51A to 51C show different views of a second part of the hinge (e.g. a second hinge member) of which the parts of FIGS. 50A to 50C form a part. The second part includes a plate (356) with two lugs (357B and 357A) extending therefrom in a direction parallel to the axis of the common axle (not shown) about which the first and second hinge parts are adapted to rotate when opposed in use. The two lugs are disposed on the face of the second plate (356) in diametrical opposition about an aperture (352) arranged to receive the axle of the hinge unit so as to extend into a respective one of the two arcuate channels (354, 355) formed across the opposing face of the first plate of the pair of plates in use. A first lug (357A) is slideable along a first arcuate channel (355) from a first end (355A) of the channel to a second end (355B) thereof by action of relative rotation of the opposed plates. The first lug abuts the first end of the channel when the hinge unit is in a fully splayed/opened state, and the lug abuts the second end of the channel when the hinge unit is in the closed state.

A second lug (357B) is slideable along the second arcuate channel (354) from a first end (354A) of the channel to a second end (354B) thereof by action of relative rotation of the opposed plates. The second lug abuts the first end of the channel when the hinge unit is in a fully splayed/opened state, and the lug abuts the second end of the channel when the hinge unit is in the closed state.

FIGS. 52A to 52C show different views of one part (e.g. a first hinge member) of a hinge unit possessing a plate (358) across a face of which a pair of circularly arcuate channels (360, 361) extend in diametrical opposition about an aperture (369) arranged to receive the axle of the hinge unit.

FIGS. 53A to 53C show different views of a second part of the hinge (e.g. a second hinge member) of which the parts of FIGS. 52A to 52C form a part. The second part includes a plate (362) with two lugs (364B and 364A) extending therefrom in a direction parallel to the axis of the common axle (not shown) about which the first and second hinge parts are adapted to rotate when opposed in use. The two lugs are disposed on the face of the second plate (362) in diametrical opposition about an aperture (363) arranged to receive the axle of the hinge unit so as to extend into a respective one of the two arcuate channels (360, 361) formed across the opposing face of the first plate of the pair of plates in use. A first lug (364A) is slideable along a first arcuate channel (360) from a first end (360A) of the channel to a second end (360B) thereof by action of relative rotation of the opposed plates. The first lug abuts the second end of the channel when the hinge unit is in a fully splayed/opened state, and the lug abuts the second end of the channel when the hinge unit is in the closed state.

A second lug (364B) is slideable along the second arcuate channel (361) from a first end (361A) of the channel to a second end (361B) thereof by action of relative rotation of the opposed plates. The second lug abuts the first end of the channel when the hinge unit is in a fully splayed/opened state, and the lug abuts the second end of the channel when the hinge unit is in the closed state.

One or more lock means such as described hereinbefore may be incorporated with any of the hinges of these alternative embodiments, in the manner described hereinbefore. For example, one of the two opposed plates of a hinge may have a lock means attached thereto including a lock member moveable (e.g. rotatable or linearly slideable) to move by a movement parallel to the opposed sliding surfaces of the hinge plates, reversibly move a lock member into a recess or notch formed by the other of the two opposed plates thereat to obstruct or prevent sliding rotation of one plate relative to the other.

FIG. 54 schematically shows an alternative embodiment of the invention in which a first hinge member (350) has extending into a peripheral circular edge a linear slot (342) adapted to intimately receive a complimentarily shaped bolt plate (310) when in register with the bolt plate. The bolt plate is slidingly connected to a first hinge member (360) for sliding movement into and out of a guide slot in the guide plate thereof. Linear sliding movement of the locking bolt (310) by a movement substantially parallel to the opposing sliding surfaces of the first and second hinge members is permitted when the locking recess (340) is revolved into register with the locking bolt (310).

FIG. 55 schematically illustrates an alternative embodiment in which the locking recess is in the form of a chord (330) defining a linear peripheral edge part of the otherwise circular peripheral edge of a second hinge member plate (370) against and away from which a bolt (320) is slideable by a linear movement substantially parallel to the opposing surfaces of the plates of the first and second hinge members (370, 380) of this embodiment. A guide recess is provided in the guide plate of the first hinge member (380) to accommodate the locking bolt (320) when in a non-obstructing position. The guide edge also provides an edge against which the locking bolt may register when also registered against the opposite surface of the chord of the locking recess in the locked state. In this way the locking bolt (320) may be sandwiched between the edge of the chord (330) and an opposing edge of the guide plate (380) to retain the locking bolt (320) in the obstructing position.

It is to be understood that the frame described herein may comprise any hinge described herein (e.g. the lockable hinge, or otherwise).

The scope of the foregoing descriptions are not intended to limit the scope of the invention and are intended merely to provide some examples of embodiments of the invention. Alternatives and variants to aspects of these embodiments, such as would be readily apparent to the skilled person, are encompassed within the scope of the invention, e.g. as defined by the claims.

The invention claimed is:

1. A one-piece collapsible shelter frame comprising:

two or more beam assemblies each including at least two beam members joined by a pivot and reversibly pivotable thereat to a relatively splayed position collectively to form an arch, wherein each one of the at least two beam members is articulated and comprises two beam portions including a roof beam portion adapted to be uppermost in use, and a wall beam portion pivotingly joined to the roof beam portion and adapted to be lowermost in use;

wherein said two beam members are joined at their respective roof beam portions via said pivot which comprises a pair of opposed plates joined at a common axle about which a face of one plate of the pair is slidingly rotatable over a face of the other plate of the pair in parallel opposition thereto to permit the joined roof beam portions to reversibly splay from a closed state of parallel adjacency to a maximally splayed state disposing the joined roof beam portions at a selected angle of splay;

wherein a face of one plate of the pair of plates possesses one or more lug parts extending therefrom and disposed thereupon to extend into a respective arcuate channel formed across the opposing face of the other plate of the pair of plates, the lug part being slideable along the arcuate channel from one end of the channel to another end thereof by action of said relative rotation of the opposed plates and the channel is dimensioned such that the lug part abuts or engages said one end of the channel when the joined roof beam portions are in the maximally splayed state; and a cross-brace slideably coupled to join the at least two said beam assemblies, the cross-brace structured to reversibly expand between the two beam assemblies to separate the joined beam assemblies permitting concertina-like expansion and collapse of the one-piece shelter frame.

2. A one-piece collapsible shelter frame according to claim 1 in which beam assemblies are joined at an apex of the frame by a pair of collapsible top-braces articulated at a joint between ends thereof.

3. A one-piece collapsible shelter frame according to claim 2 in which the top braces are joined by a tensioning member operable to urge the opposed joints together to abut each other at their articulated joints.

4. A one-piece collapsible shelter frame according to claim 1 in which the channel is dimensioned such that the lug parts abut or engage the other end of the channel when the pivot is in the closed state.

5. A one-piece collapsible shelter frame according to claim 1 including a second lug and a second corresponding said arcuate channel formed in the opposed plates.

6. A one-piece collapsible shelter frame according to claim 5 in which the two said lugs are formed to extend from the same face of a common plate at locations thereupon diametrically opposed across the common axle.

7. A one-piece collapsible shelter frame according to claim 5 in which the two said channels are formed in the same face of a common plate such that an end of any one of the two channels is diametrically opposed across the common axle from an end of the other of the two channels.

8. A one-piece collapsible shelter frame according to claim 5 in which one or more of said lugs is slideable along a respective arcuate channel to the other end thereof by action of said relative rotation of the opposed plates.

* * * * *